US011455977B2

(12) United States Patent
Stocksmith

(10) Patent No.: US 11,455,977 B2
(45) Date of Patent: Sep. 27, 2022

(54) ACOUSTICAL MUSICAL DEVICES

(71) Applicant: Play Music With Friends LLC, Minneapolis, MN (US)

(72) Inventor: Christopher Sever Stocksmith, Minneapolis, MN (US)

(73) Assignee: Play Music With Friends LLC, Minneapolis, MN (US)

( * ) Notice: Subject to any disclaimer, the term of this patent is extended or adjusted under 35 U.S.C. 154(b) by 0 days.

(21) Appl. No.: 17/462,143

(22) Filed: Aug. 31, 2021

(65) Prior Publication Data

US 2022/0068247 A1 Mar. 3, 2022

Related U.S. Application Data

(60) Provisional application No. 63/074,030, filed on Sep. 3, 2020.

(51) Int. Cl.
*G10D 13/20* (2020.01)
*G10D 13/02* (2020.01)

(52) U.S. Cl.
CPC ..... *G10D 13/20* (2020.02); *G10D 13/02* (2013.01)

(58) Field of Classification Search
CPC ..... G10D 13/20; G10D 13/02
See application file for complete search history.

(56) References Cited

U.S. PATENT DOCUMENTS

| | | | | |
|---|---|---|---|---|
| 4,242,937 | A | 1/1981 | Pozar | |
| 6,091,010 | A | 7/2000 | Gauger | |
| 7,488,882 | B2 * | 2/2009 | Curet Troche | G10D 13/02 84/411 R |
| 2007/0163422 | A1 | 7/2007 | Rogers et al. | |
| 2009/0038465 | A1 | 2/2009 | Whalley et al. | |
| 2015/0020673 | A1 | 1/2015 | Millender, Jr. | |
| 2016/0155432 | A1 * | 6/2016 | Krol | G10D 13/02 248/206.5 |
| 2022/0068247 | A1 * | 3/2022 | Stocksmith | G10D 13/02 |

OTHER PUBLICATIONS

International Search Report and Written Opinion of the ISA/US in PCT/US2021/048458, dated Nov. 30, 2021, 6 pgs.

* cited by examiner

*Primary Examiner* — Robert W Horn
(74) *Attorney, Agent, or Firm* — Fredrikson & Byron, P.A.

(57) ABSTRACT

A drum includes a low volume drum head, a pellet chamber, and a magnetic choke. The pellet chamber is located beneath the low volume drum head. The pellet chamber is configured to hold a plurality of pellets, and the pellet chamber defines a plurality of apertures in a wall of the pellet chamber. The magnetic choke carries at least one magnet. The magnetic choke is configured to move relative to the pellet chamber so as to adjust a magnetic force imparted on the pellet chamber.

20 Claims, 46 Drawing Sheets

ACOUSTICAL MUSICAL DEVICES

RELATED APPLICATION

This application claims priority to U.S. provisional patent application No. 63/074,030, filed on Sep. 3, 2020.

TECHNICAL FIELD

This disclosure generally relates to musical devices, systems, and related methods. Embodiments are described herein in the context of acoustical musical devices, systems, and related methods, such as a low volume acoustical drum, a low volume acoustical drum set, and related methods.

BACKGROUND

Musical instruments are utilized in a wide variety of professional and recreational contexts. Acoustical musical instruments are a type of musical instrument that does not rely on external power for operation, as do electronic musical instruments. In general, acoustical musical instruments include a driver and a resonator. To produce sound, the driver applies energy to the resonator which responds to the applied energy by vibrating for a period of time. The frequency of the resulting vibration at the resonator can vary depending on the size and material of the resonator. One example of an acoustical musical instrument is an acoustic drum.

However, traditional acoustic drums have a number of characteristics that complicate their use. For one, traditional acoustic drums are generally high volume, relatively loud instruments. As such, the use of traditional acoustic drums is typically confined to select environments where high volume output is permitted. This can restrict utilization of a traditional acoustic drum set, for instance to only select hours or complete nonuse at one's home. Another characteristic that complicates the use of traditional acoustic drum sets is the relatively robust and complex setup. Traditional acoustic drum sets are relatively heavy and the setup to support the relatively heavy drum components includes a large number of parts needing to be independently interconnected during setup. This can make portability of such traditional acoustic drum sets difficult and, as a result, further restrict their utilization.

SUMMARY

In general, various embodiments relating to musical devices, systems, and related methods are disclosed herein. In particular, disclosed herein are embodiments of acoustical musical devices, systems, and related methods, such as an acoustical drum, an acoustical drum set, and related methods.

The embodiments disclosed herein can provide a number of useful advantages over traditional acoustical musical devices. For example, acoustical drum embodiments disclosed herein, when played, can provide the same, or similar, tactile feel as a traditional acoustical drum but at the same time produce a comparatively lower volume sound output. This can provide an acoustical drum that plays like a traditional acoustical drum but is quieter, thereby enabling increased utilization of the acoustical drum while maintaining feel and other performance characteristics typically associated with a louder, traditional acoustical drum. As another example, acoustical drum and drum set embodiments disclosed herein can be relatively light weight and easier to setup as compared to traditional acoustical drums and drum sets. For instance, certain acoustical drum and drum set embodiments disclosed herein can include light weight components needing relatively few interconnections. This, in turn, can make such acoustical drum and drum set embodiments disclosed herein more portable, thereby enabling increased utilization.

One embodiment includes a low volume acoustical drum. This low volume acoustical drum embodiment includes a low volume drum head and a drum shell. The low volume drum head includes a first complementary connector and the drum shell includes a second complementary connector, and the low volume drum head is secured to the drum shell via the first and second complementary connectors. The low volume drum head can include a material that is configured, when struck, to output a relatively low volume, as compared to a traditional acoustic drum head. The material included at the low volume drum head can be a closed cell polymer material having a density of 1 to 5 pounds per cubic foot. In some embodiments, this material can be included at the low volume drum head at a thickness of 0.5 to 5 inches (e.g., 1 to 3 inches). And, this material can extend along a width of the low volume drum head from one end secured to the drum shell to another opposite end secured to the drum shell.

Another embodiment includes a low volume snare drum. This low volume snare drum embodiment includes a low volume drum head and a pellet chamber. The low volume drum head and the pellet chamber can be secured together such that a bottom surface of the low volume drum head can define a closed top of the pellet chamber. The pellet chamber can enclose a plurality of pellets. The low volume drum head can include a material that is configured, when struck, to output a relatively low volume, as compared to a traditional snare drum. The material included at the low volume drum head can be a closed cell polymer material having a density of 1 to 5 pounds per cubic foot. In some embodiments, this material can be included at the low volume drum head at a thickness of 0.5 to 5 inches (e.g., 1 to 3 inches). And, this material can extend along a width of the low volume drum head from one end secured to the pellet chamber to another opposite end secured to the pellet chamber.

A further embodiment includes an acoustical drum set. This acoustical drum set includes a first low volume acoustical drum, a first mounting ring, a first stand, a second low volume acoustical drum, a second mounting ring, and a second stand. The first low volume acoustical drum is supported at the first mounting ring, and the first mounting ring is coupled to the first stand so as to support the first mounting ring, and first low volume acoustical drum supported thereat. Likewise, the second first low volume acoustical drum is supported at the second mounting ring, and the second mounting ring is coupled to the second stand so as to support the second mounting ring, and second low volume acoustical drum supported thereat. Each of the first mounting ring and the second mounting ring includes a plurality of cord holder mechanisms and an elastic cord strung through the plurality of cord holder mechanisms to configured to elastic cord to receive the respective low volume acoustical drum and hold the respective low volume acoustical drum at the respective first and second mounting rings. Each of the first low volume acoustical drum and the second low volume acoustical drum includes a low volume drum head. The low volume drum head includes a material that is configured, when struck, to output a relatively low volume, as compared to a traditional acoustic drum head. And, this material can extend along a width of the low volume drum head from one end secured to the drum shell to another opposite end secured to the drum shell.

An additional embodiment includes a drum (e.g., a snare drum). This drum embodiment a low volume drum head, a pellet chamber, and a magnetic choke. The pellet chamber is located beneath the low volume drum head. The pellet chamber is configured to hold a plurality of pellets, and the pellet chamber defines a plurality of apertures in a wall of the pellet chamber. The magnetic choke carries at least one magnet. The magnetic choke is configured to move relative to the pellet chamber so as to adjust a magnetic force imparted on the pellet chamber.

In a further embodiment of this drum, the low volume drum head includes a closed cell polymer material that has a density of one to five pounds per cubic foot. For example, in addition, such low volume drum head can have a thickness of 1 to 3 inches.

In a further embodiment of this drum, the pellet chamber includes a wall structure component and a selective sound control component positioned adjacent to the wall structure component. The wall structure component includes the wall and the plurality of apertures defined in the wall, and the selective sound control component includes at least one blocking baffle. For example, in addition, the at least one blocking baffle is configured to move relative to the plurality of apertures so as to close the plurality of apertures when the at least one blocking baffle is moved into alignment with the plurality of apertures and open the plurality of apertures when the at least one blocking baffle is moved away from the plurality of apertures. The selective sound control component can be coupled to the wall structure component, and the selective sound control component can be configured to move relative to the wall structure component so as to move the at least one blocking baffle relative to the plurality of apertures. In some examples, the selective sound control component can further include an actuation member, and the actuation member can be configured to move the at least one blocking baffle relative to the plurality of apertures. Also, in some examples, the pellet chamber can further include a chamber floor plate that includes a metallic material, and the chamber floor plate can be located at a first side of the pellet chamber and the low volume drum head can be located at a second, opposite side of the pellet chamber.

In a further embodiment of this drum, the drum can also include a throw off mechanism that is configured to move the magnetic choke relative to the pellet chamber. In some such examples, the throw off mechanism can be configured to move between an off position and an on position. When the throw off mechanism is in the off position, the magnetic choke can be positioned adjacent the pellet chamber. When the throw off mechanism is in the on position, the magnetic choke can be positioned further from the pellet chamber than when the throw off mechanism is in the off position. For instance, when the throw off mechanism is in the off position, the magnetic choke can be positioned adjacent the pellet chamber such that the at least one magnet is configured to impart the magnetic force on the pellet chamber to cause pellets to be held within the pellet chamber to resist movement within the pellet chamber. And, when the throw off mechanism is in the on position, the magnetic choke can be positioned further from the pellet chamber such that the at least one magnet is configured to impart magnetic force less than when the throw off mechanism is in the off position to permit the pellets to be held in the pellet chamber to move within the pellet chamber. The throw off mechanism can include a throw off lever and a throw off actuation arm, with the throw off lever connected to the throw off actuation arm via a throw off gear, and the throw off actuation arm configured to transfer a motive force from the throw off lever to the magnetic choke to move the magnetic choke relative to the pellet chamber when the throw off lever is moved. The throw off gear can include a first set of teeth that mesh with a second set of teeth at the throw off actuation arm to transfer the motive force from the throw off lever to the magnetic choke. The throw off mechanism can further include a throw off support member, and the throw off support member can be configured to serve as a stop for the magnetic choke such that the magnetic choke comes to rest at the throw off support member when the throw off mechanism is in an on position. The throw off support member can be configured to move independent of the throw off lever.

In a further embodiment of this drum, the drum can also include a rim and a securement structure. The rim can include a metallic material. The securement structure can be configured to removably retain the rim at the snare drum at a position spaced apart from the low volume drum head. In some such examples, the securement structure includes a securement arm and a securement base, with the securement arm defining a first rim receptacle and the securement base defining a second rim receptacle aligned with the first rim receptacle. The rim can be received at the first rim receptacle and the second rim receptacle to removably retain the rim at the snare drum at the position spaced apart from the low volume drum head. In addition, in some such examples, the drum can also include an accessory holding mechanism configured to hold a musical accessory. The accessory holding mechanism can include an arm bracket and an accessory holding lever. The arm bracket can be configured to couple to the musical accessory, and the arm bracket can be configured to be secured at the securement arm. The accessory holding lever can be rotatably coupled to the arm bracket such that the accessory holding lever can rotate relative to the arm bracket to a locked position at which the accessory holding lever is configured to lock the arm bracket in place at the securement arm.

In a further embodiment of this drum, the drum can also include a leg. The leg can support the low volume drum head and the pellet chamber. The leg can define a carrying handle configured to receive a hand of a user to carry the drum, and the leg can define a weight receptacle configured to receive one or more weight elements to add additional mass to the drum. In addition, in some such examples, the leg includes an adjustable leg structure. The adjustable leg structure can include a movable foot, a foot locking mechanism coupled to the movable foot, and a foot support coupled to the movable foot. The movable foot can include a leg fitting, and the leg can includes a foot receptacle at which the leg fitting is received. The leg fitting can move relative to the foot receptacle to move the foot support relative to the leg.

The details of one or more examples are set forth in the accompanying drawings and the description below. Other features, objects, and advantages will be apparent from the description and drawings.

BRIEF DESCRIPTION OF THE DRAWINGS

The following drawings are illustrative of particular embodiments of the present invention and, therefore, do not limit the scope of the invention. The drawings are intended for use in conjunction with the explanations in the following description. Embodiments of the invention will hereinafter be described in conjunction with the appended drawings, wherein like numerals denote like elements. The features illustrated in the drawings are not necessarily to scale, though embodiments within the scope of the present invention can include one or more of the illustrated features (e.g., each of the illustrated features) at the scale shown.

FIG. 2A is a perspective view of a top region of the snare drum. FIG. 2B is a perspective view of a bottom region of the snare drum. FIG. 2C is an exploded view of the snare drum. FIG. 2D is a cross-sectional view, along a longitudinal centerline, of the snare drum. FIG. 2E is a perspective view of a head latch feature of the snare drum. FIG. 2F is an exploded view of the magnetic choke, magnets, and magnet plugs of the snare drum. FIG. 2G is a perspective view of the snare drum with the drum head and a chamber floor plate removed. FIG. 2H is a perspective view of the snare drum along with a sound reflector plate. FIG. 2I is an exploded view showing assembly lines between the snare drum and the sound reflector plate. FIG. 2J is a perspective view of a holder component attached to a leg of the snare drum. FIG. 2K is an exploded view of the holder component, fastener, and leg of the snare drum. FIG. 2L is a perspective, partially transparent view of the holder component to illustrate exemplary fastening apertures thereat.

FIG. 3A is a perspective view of the acoustical drum. FIG. 3B is a cross-sectional view, along a longitudinal centerline, of the acoustical drum. FIG. 3C is perspective view of a bottom region of a drum head of the acoustical drum. FIGS. 3D and 3E are perspective views of a bass acoustical drum.

FIG. 4A is perspective view of the mounting ring without an elastic cord component. FIG. 4B is a perspective view of the mounting ring with the elastic cord component. FIG. 4C is a perspective view of a pulley clamp, pulley wheel, and spacer of the mounting ring. FIG. 4D is a perspective view of the pulley clamp, pulley wheel, and spacer installed at the mounting ring. FIG. 4E is an exploded view of the pulley clamp, pulley wheel, and spacer. FIG. 4F is a perspective view of a clutch clamp and elastic cord clutch of the mounting ring. FIG. 4G is an exploded, partially transparent view of the clutch clamp and elastic cord clutch to illustrate exemplary assembly therebetween. FIG. 4H is a perspective view of a diagram illustrating exemplary pathways, shown with the arrow lead lines, for threading one or more elastic cords through the clutch clamp and elastic cord clutch. FIG. 4I is a perspective view of the diagram of FIG. 4H from an opposite side of that shown in FIG. 4H. FIG. 4J is a perspective view of an acoustical drum secured in place at the mounting ring.

FIG. 5A is perspective view of a stand leg of the stand. FIG. 5B is an exploded view of the stand leg. FIGS. 5C and 5D are exploded views, from opposite sides, of a stand ring coupler. FIG. 5E is a perspective view of an exemplary stand. FIG. 5F is a close-up perspective view of two mounting rings and a double ring connector of the stand of FIG. 5E.

FIG. 6A is a perspective view of a top region of the snare drum. FIG. 6B is perspective view of a bottom region of the snare drum. FIG. 6C is an exploded view of the snare drum. FIG. 6D is perspective view of a throw off mechanism of the snare drum. FIG. 6E is an exploded view of the throw off mechanism and associated magnetic choke of the snare drum. FIG. 6F is a perspective view of the throw off mechanism in one exemplary off position. FIG. 6G is a perspective view of the throw off mechanism in one exemplary on position. FIG. 6H is an exploded view of an adjustable leg structure of the snare drum. FIG. 6I is a perspective view of a securement structure in a locked position. FIG. 6J is a perspective view of the securement structure, of FIG. 6I, in an unlocked position. FIG. 6K is an exploded view an accessory holding mechanism of the snare drum. FIG. 6L is a perspective view of the accessory holding mechanism secured at the snare drum.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
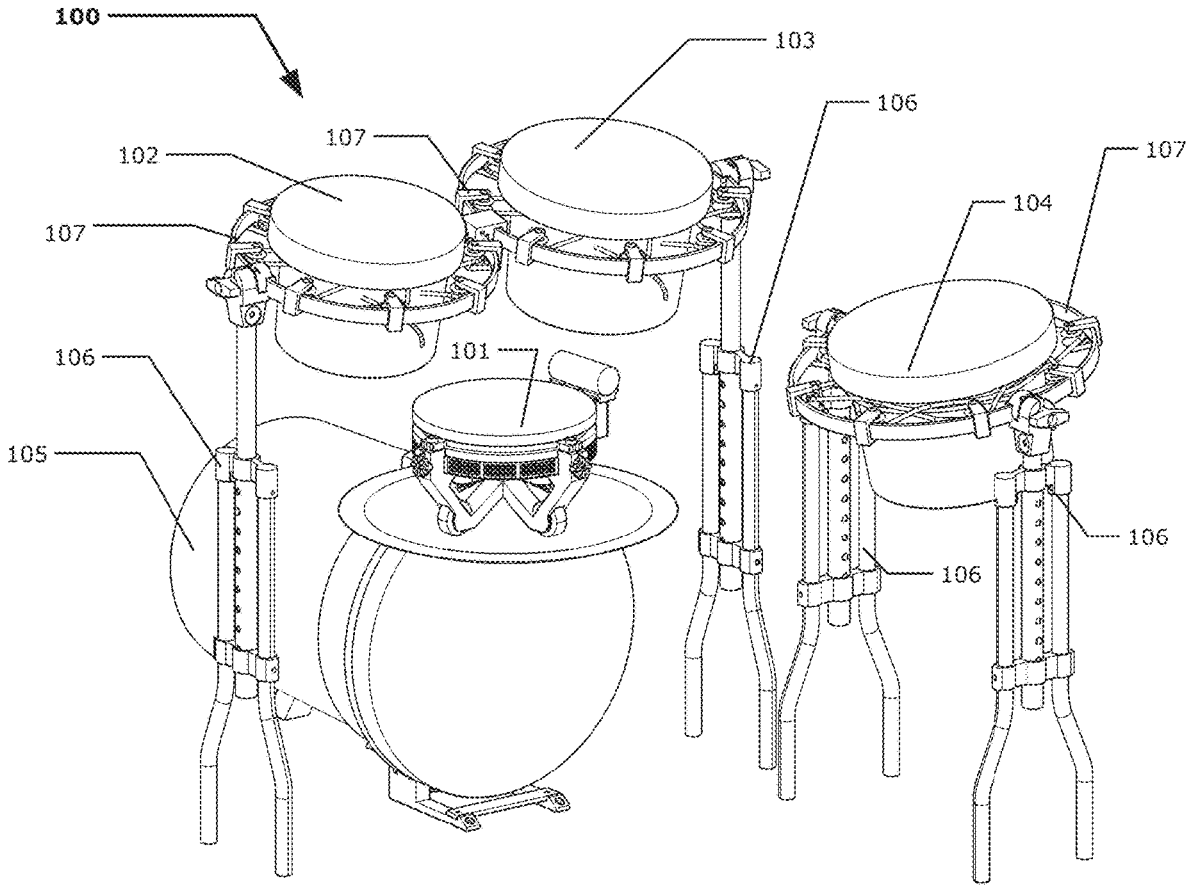
FIG. 1 is a perspective view of an embodiment of an acoustical drum set.
Figure 2A:
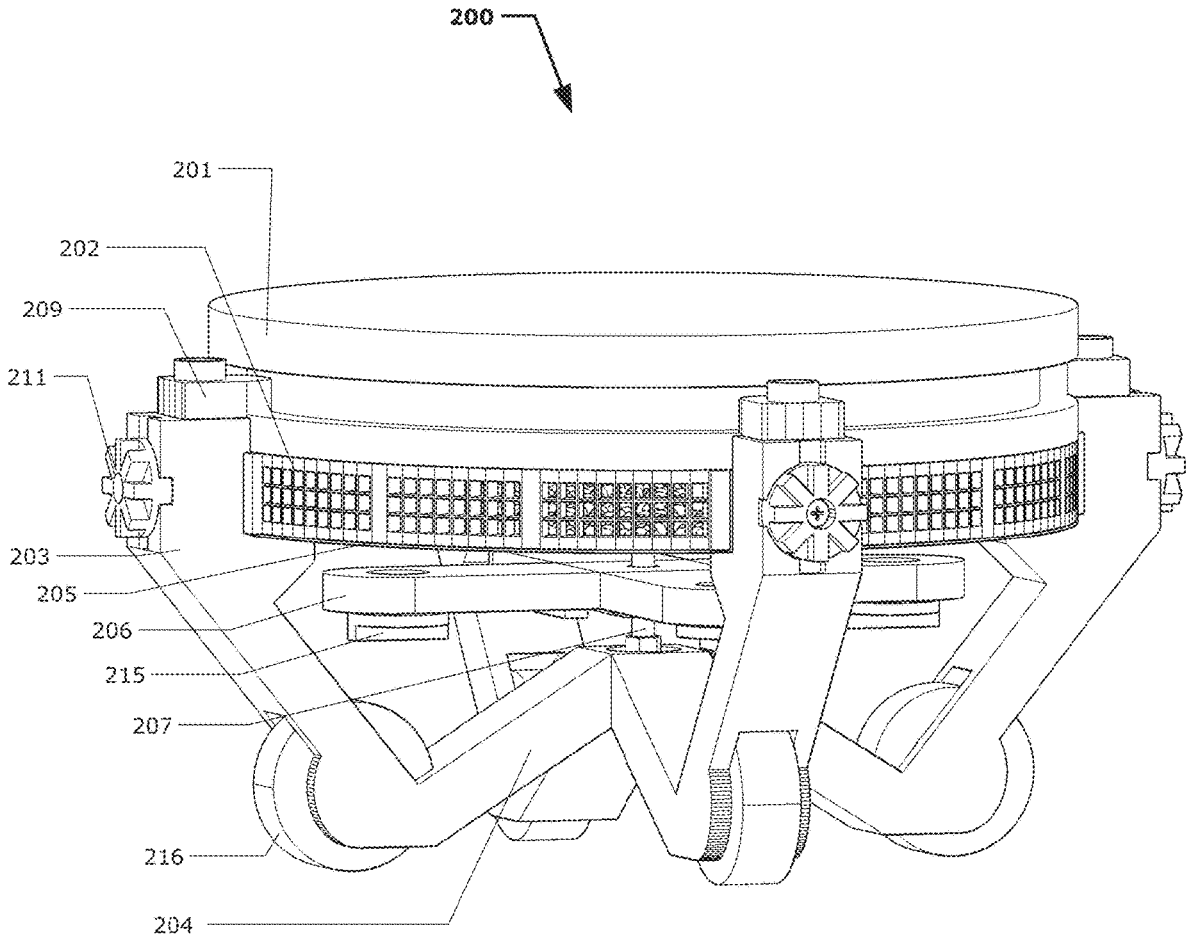
FIGS. 2A-2L show an embodiment of a snare drum that, for instance, can be included in the acoustical drum set of FIG. 1.
Figure 2B:
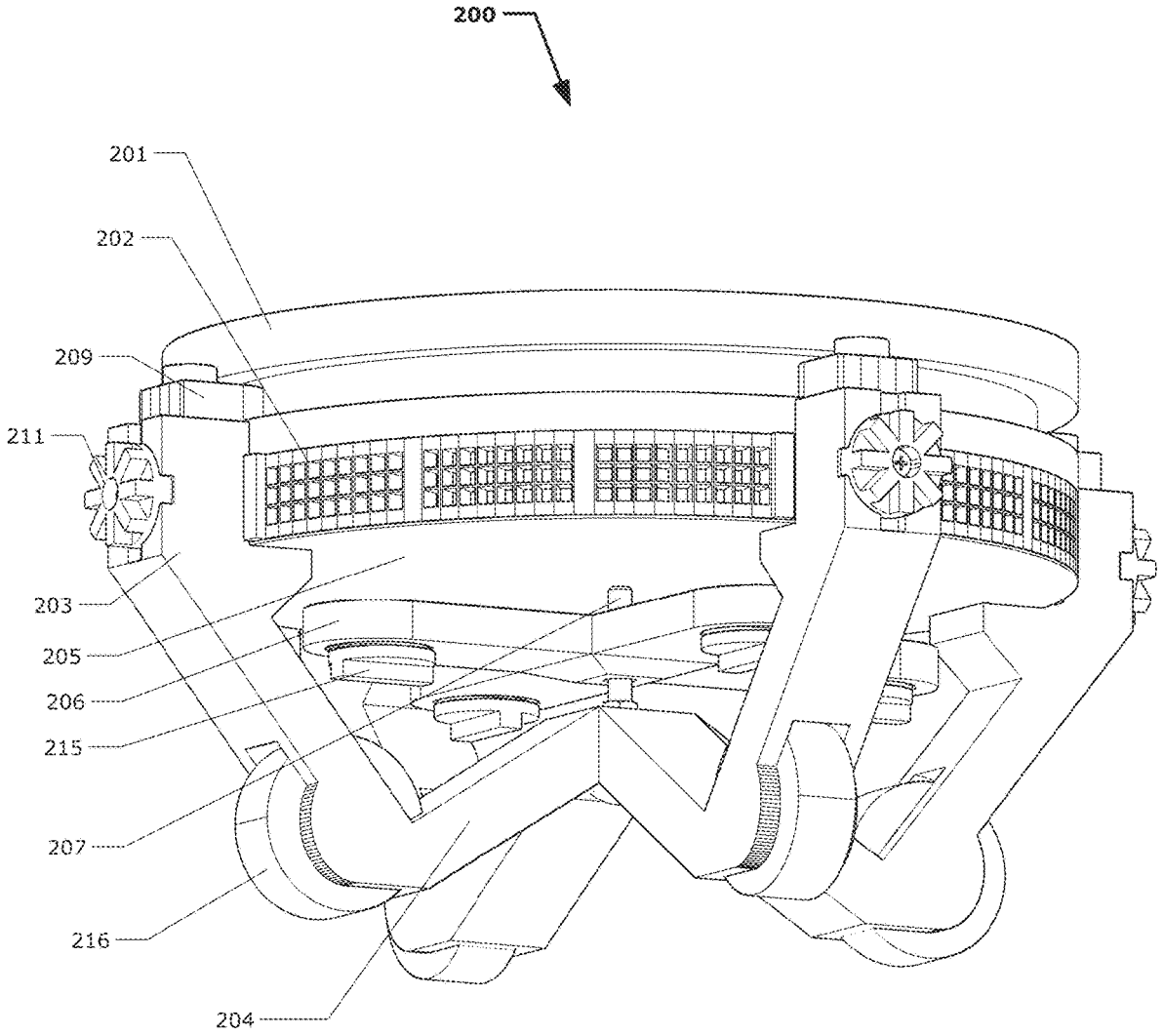
Figure 2C:
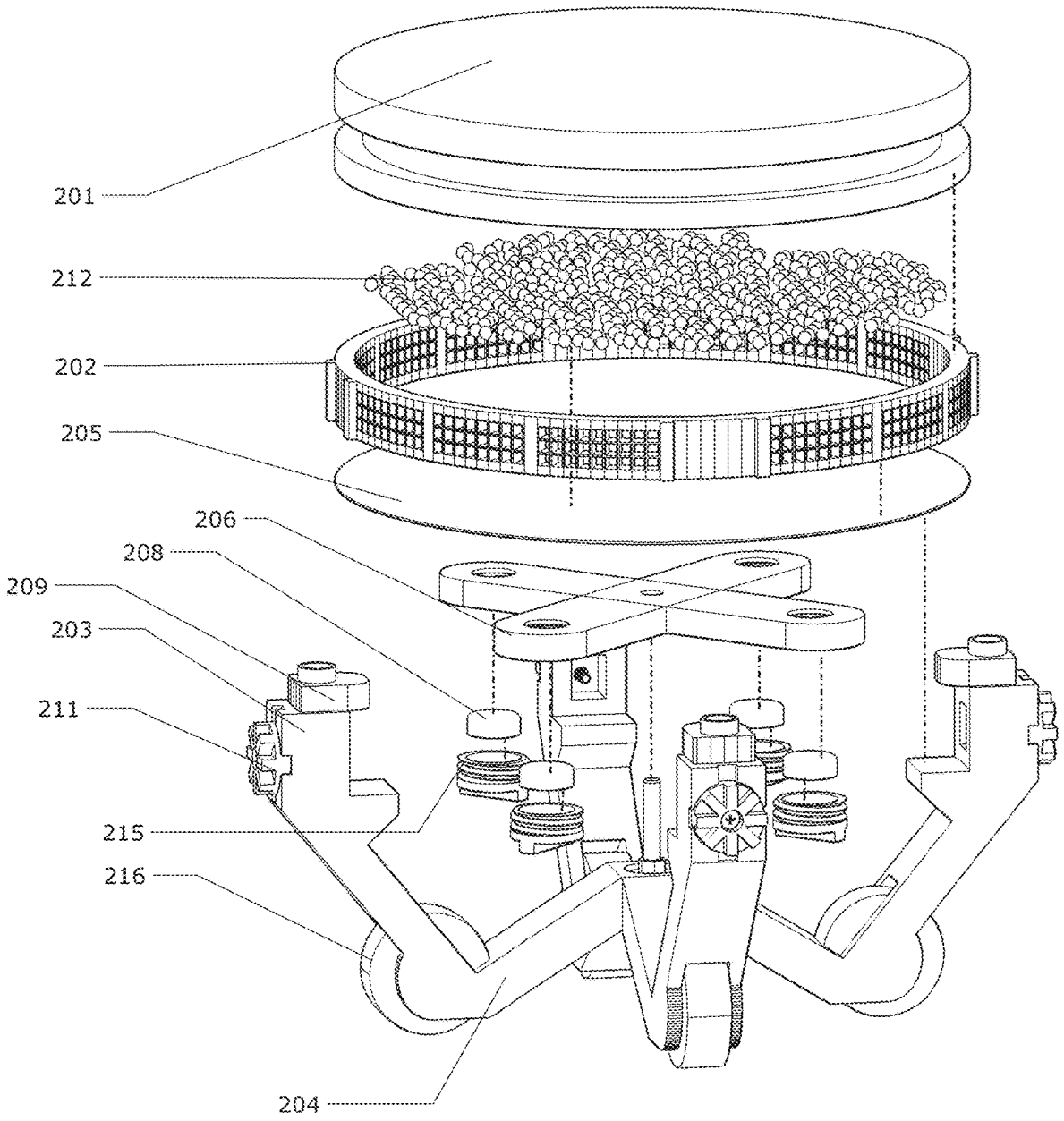
Figure 2D:
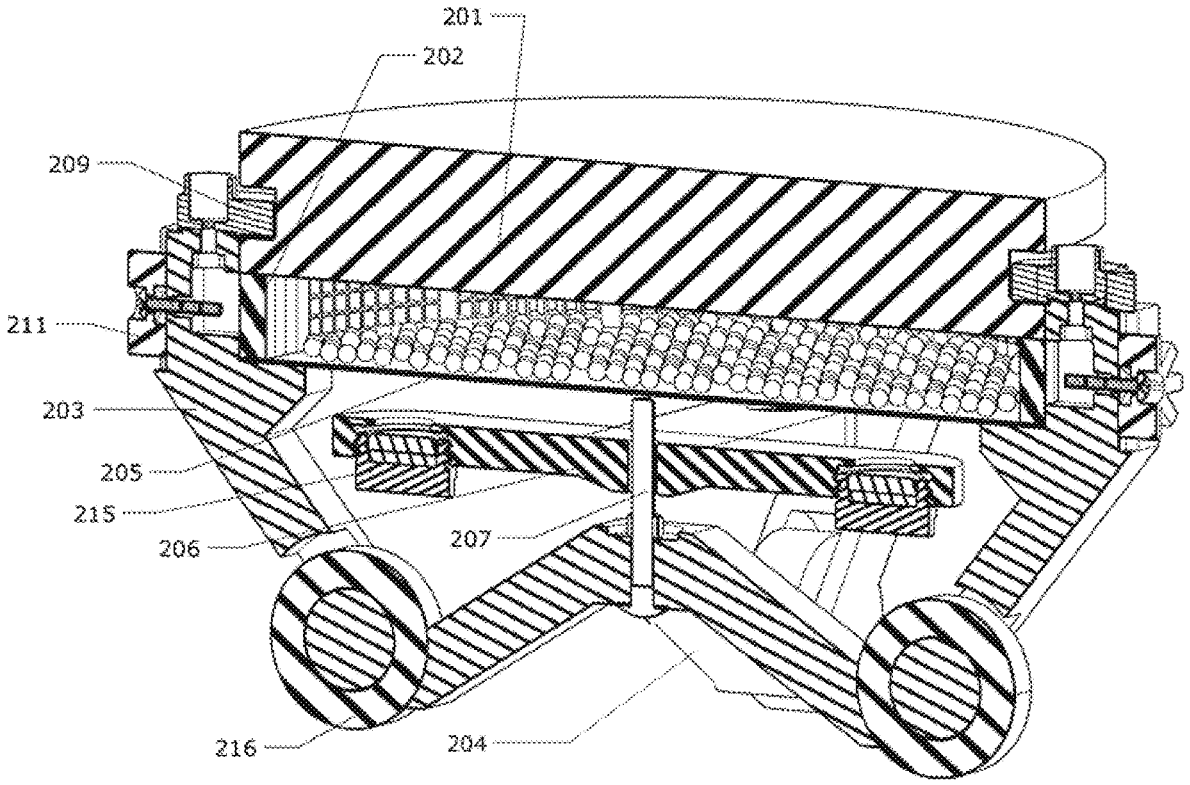
Figure 2E:
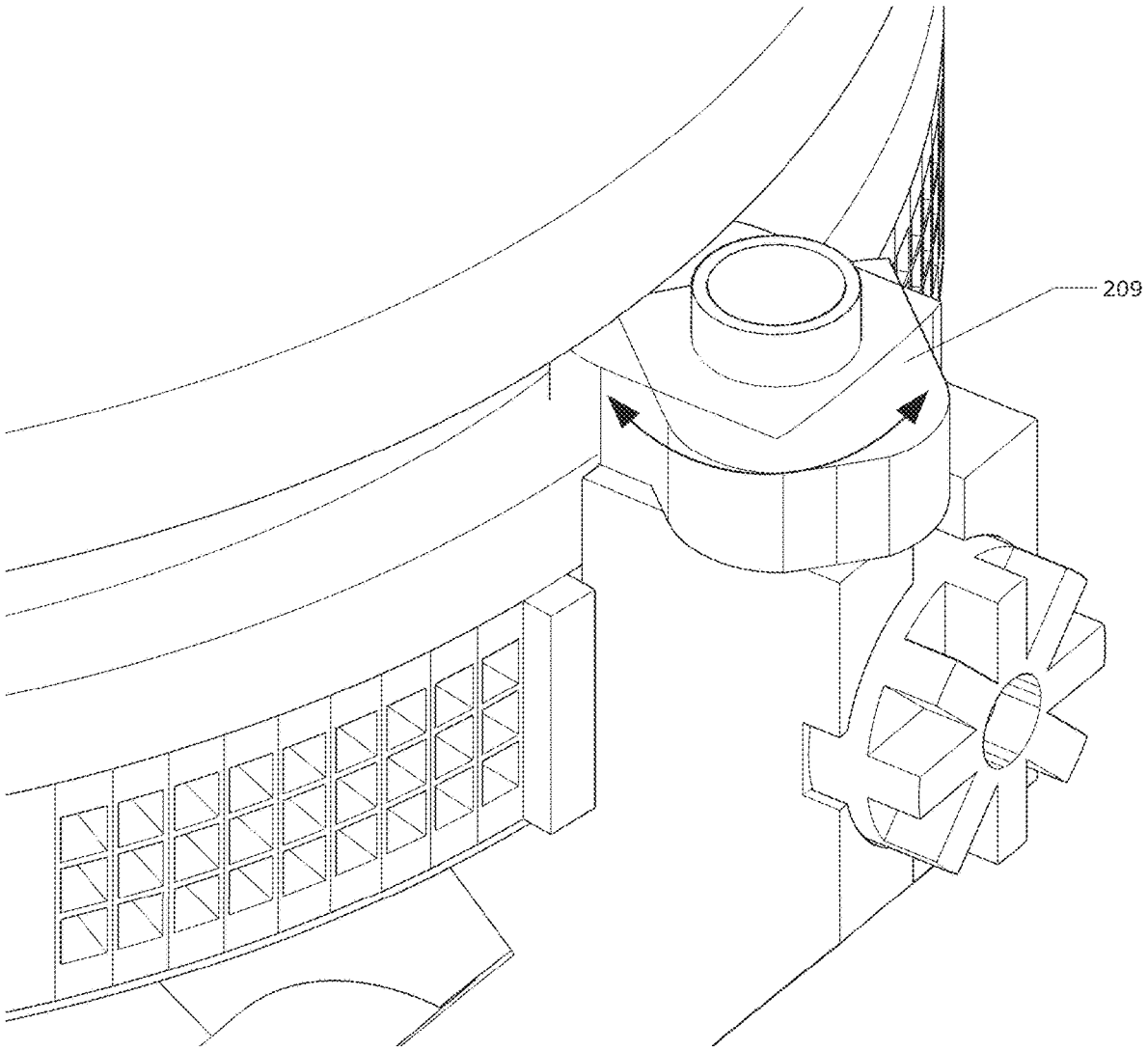
Figure 2F:
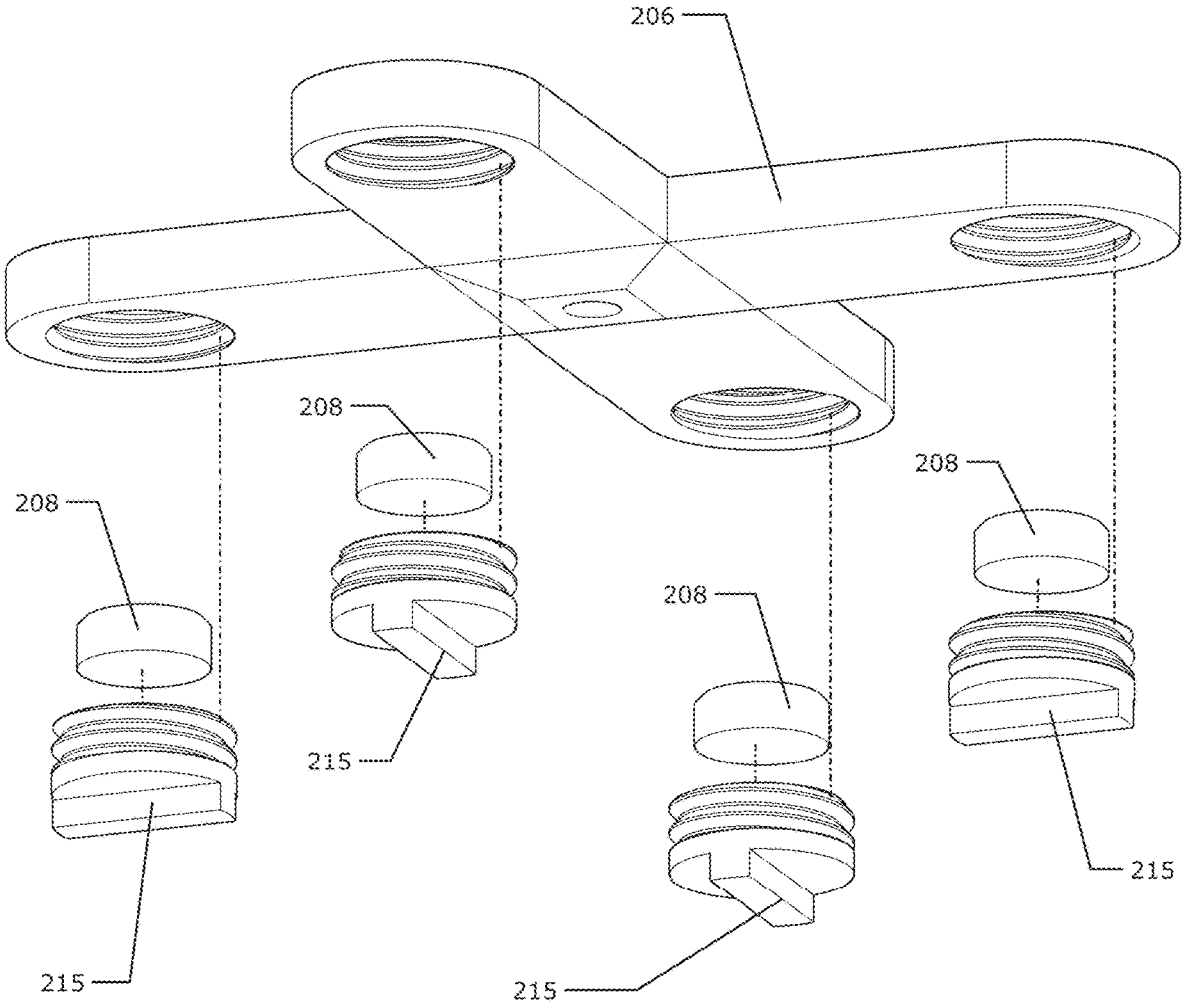
Figure 2G:
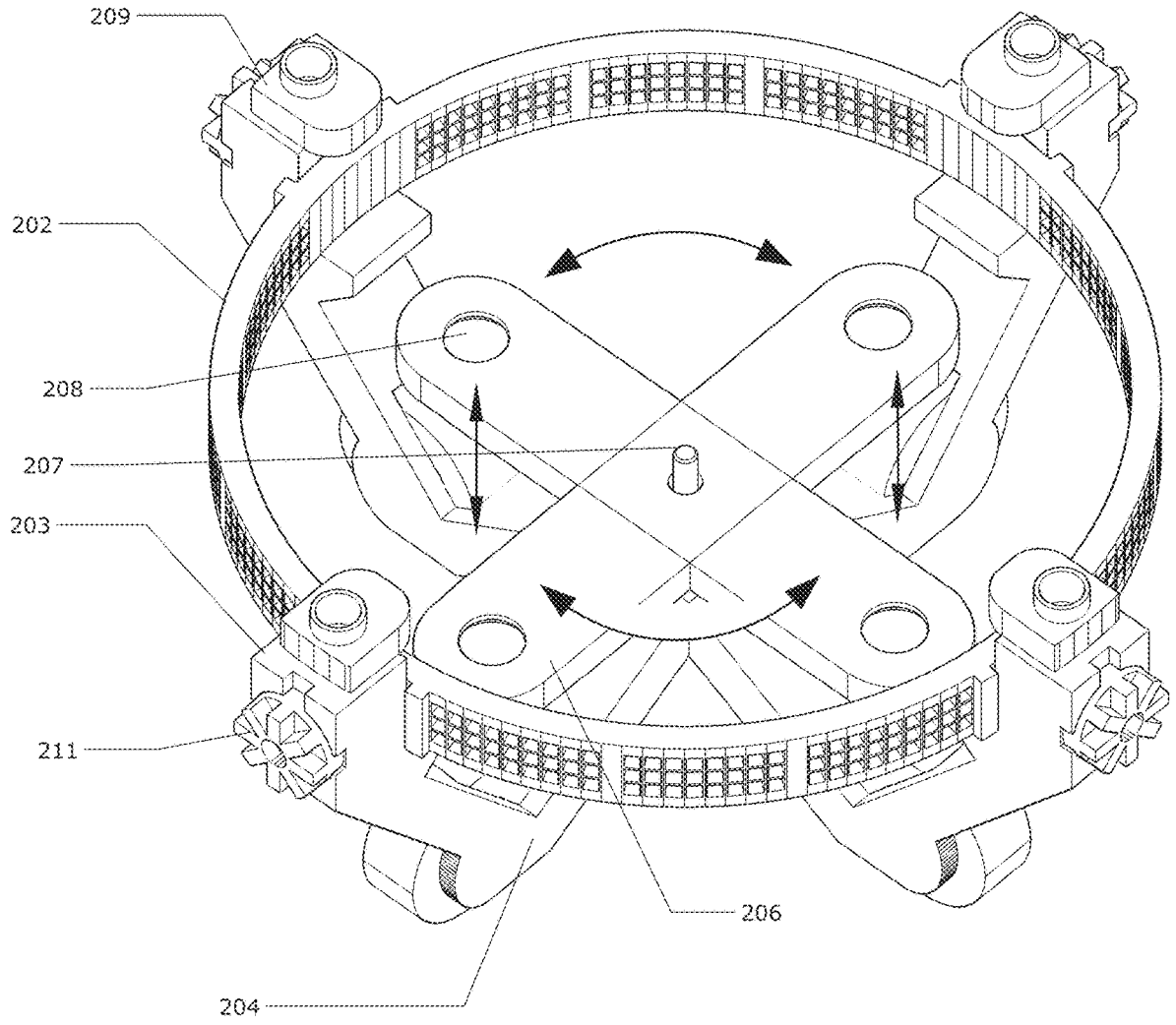
Figure 2H:
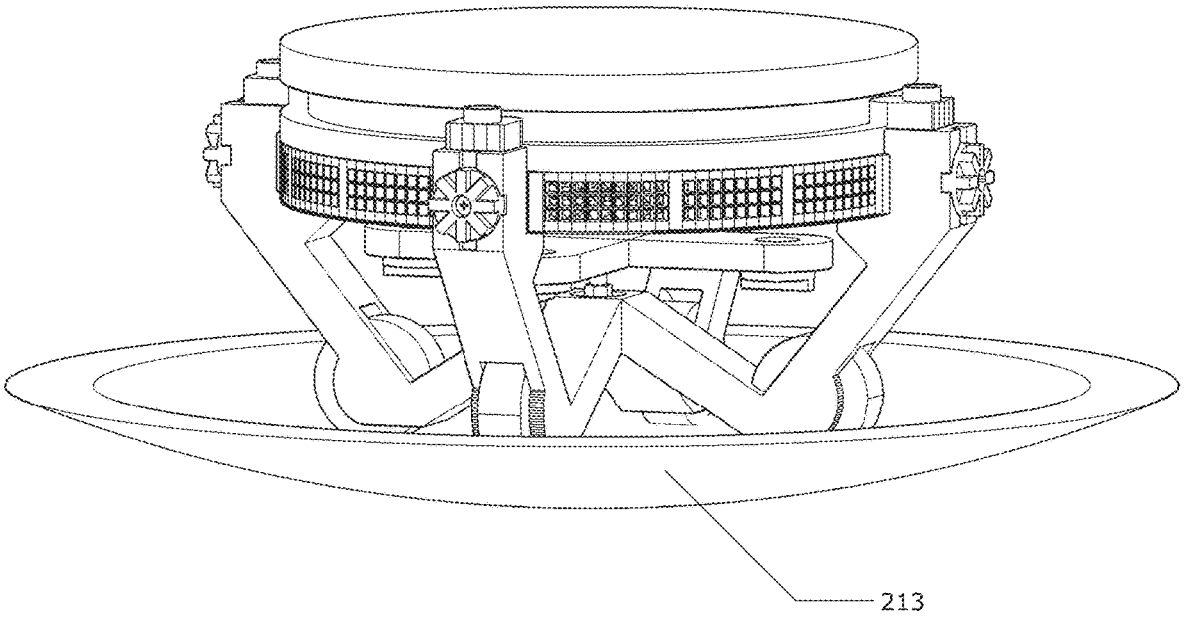
Figure 2I:
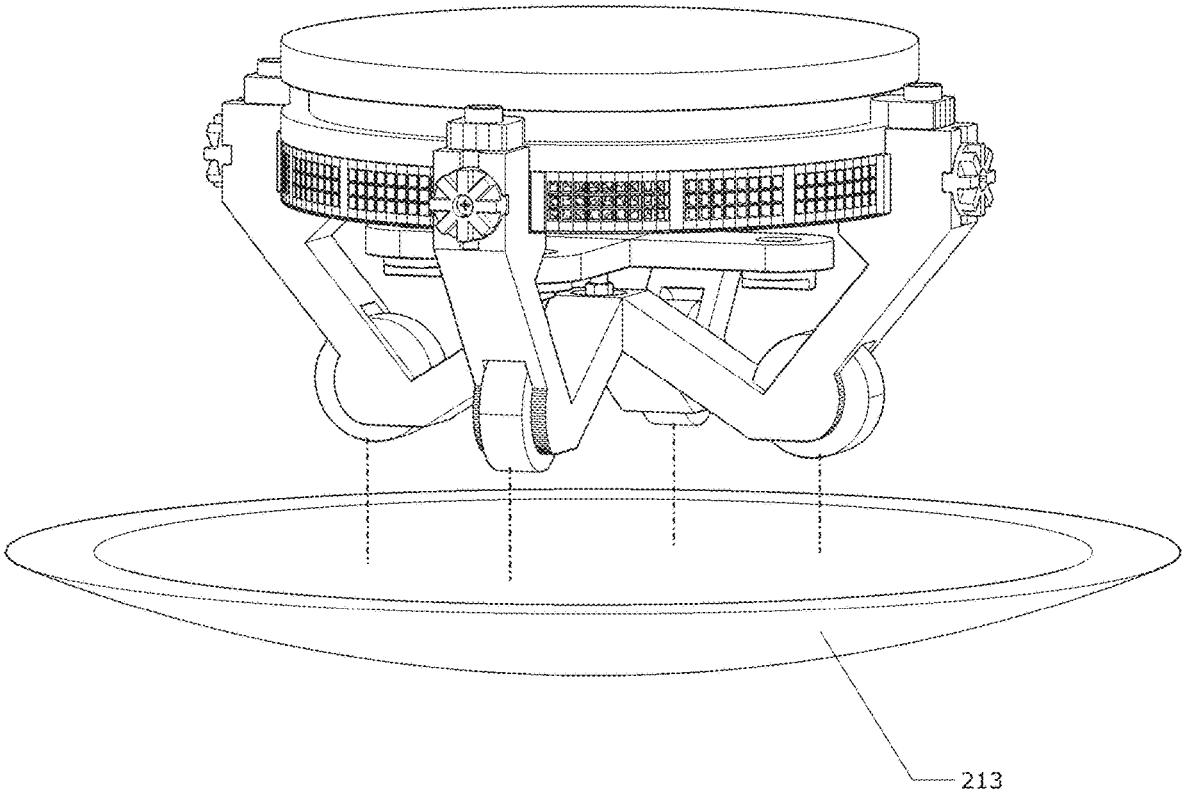
Figure 2J:
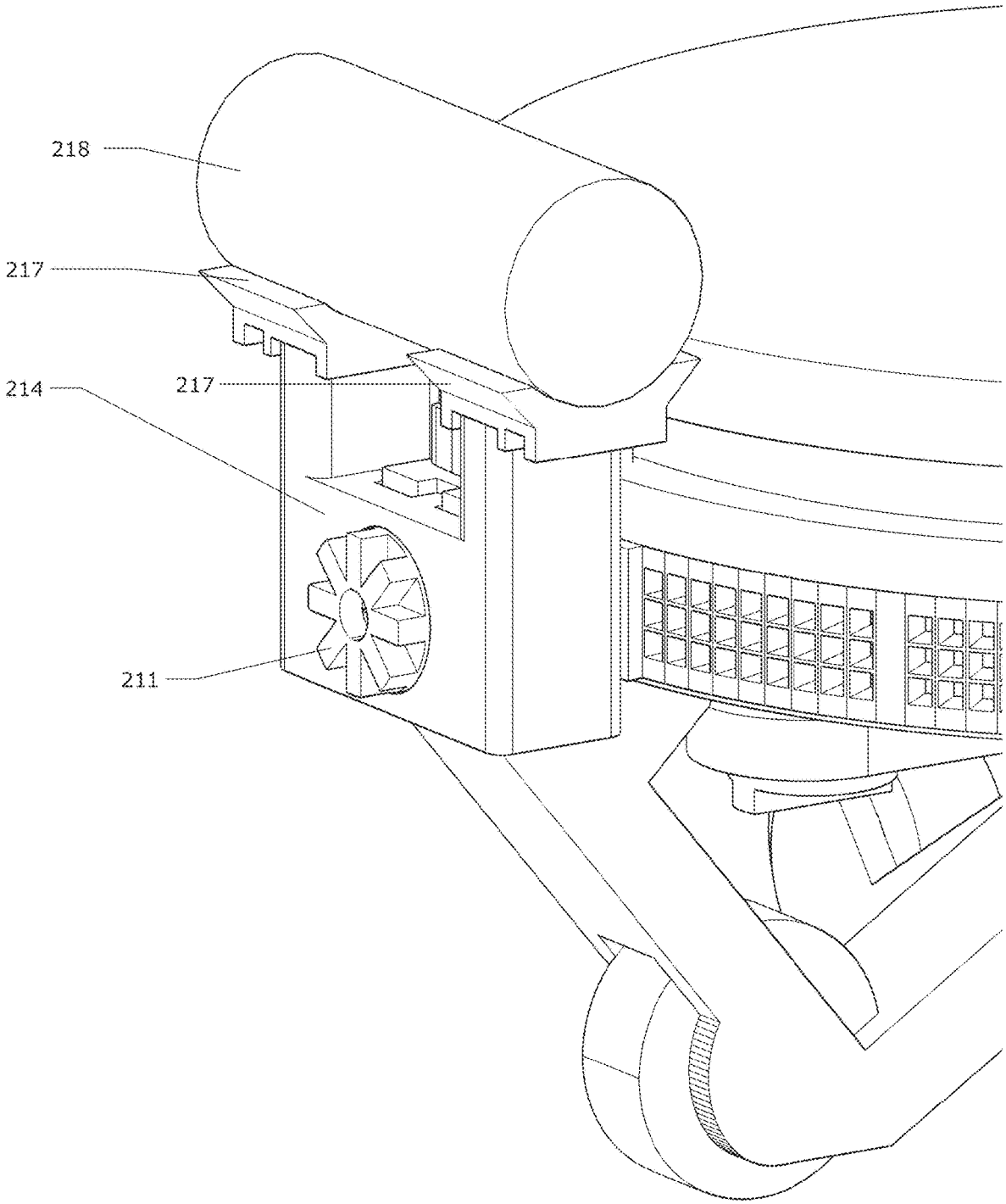
Figure 2K:
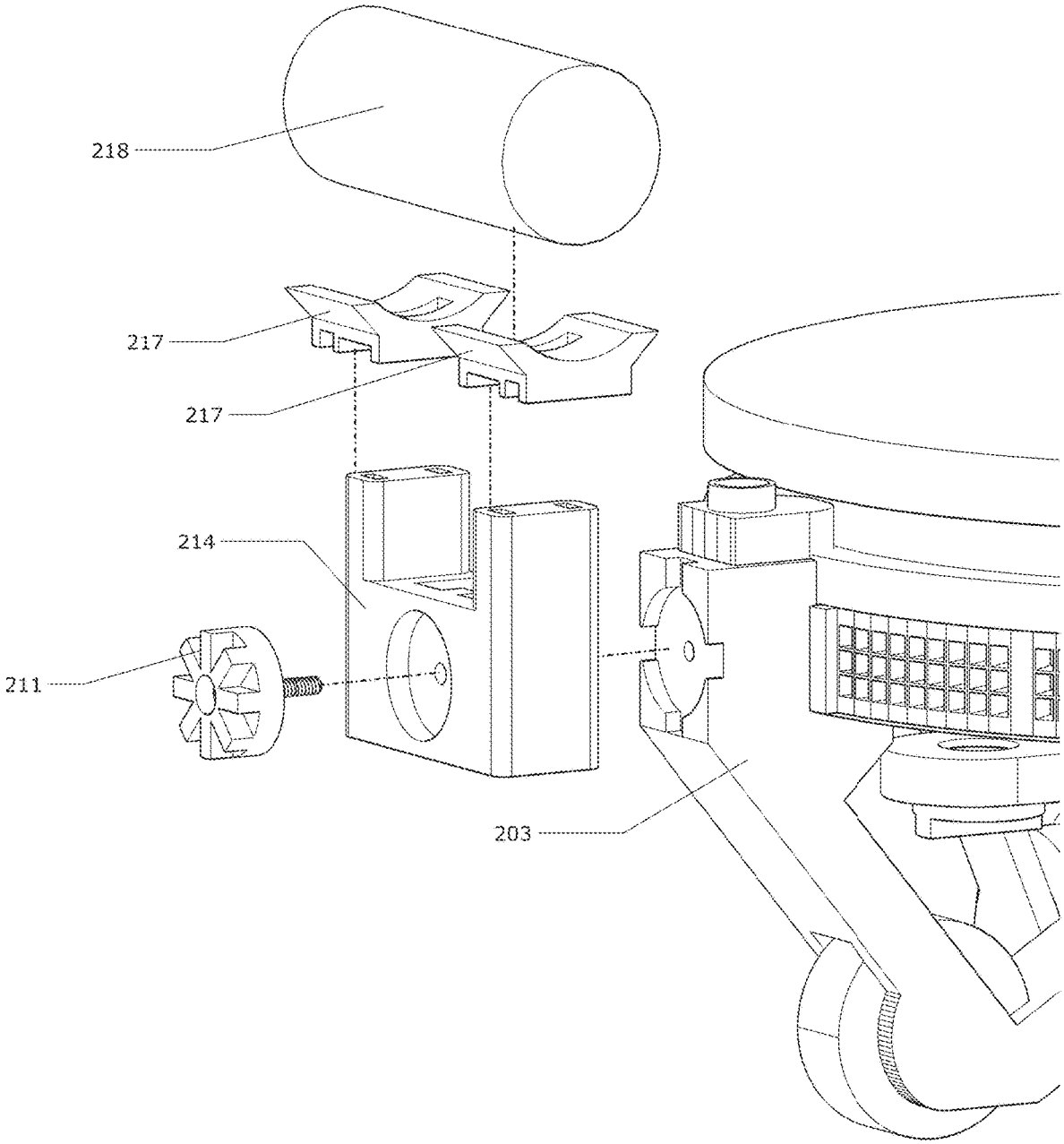
Figure 2L:
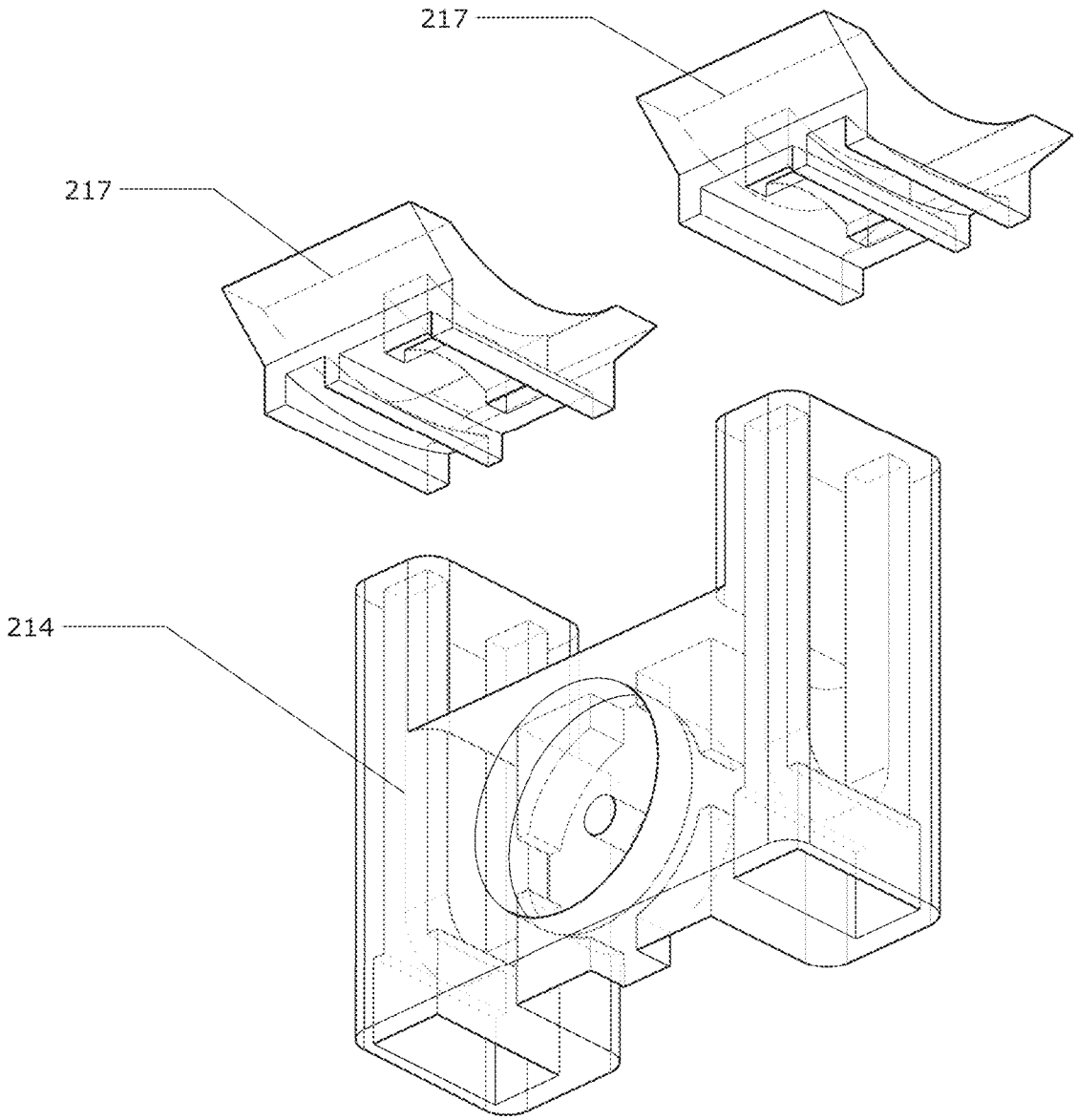

FIG. 1 shows a perspective view of an exemplary embodiment of an acoustical drum set 100. The exemplary acoustical drum set 100 shown in FIG. 1 includes a snare drum 101, a high rack tom 102, a low rack tom 103, a floor tom 104, and a bass drum 105. To support one or more of these drum components, the acoustical drum set 100 includes a support system that includes one or more stands 106 and one or more mounting rings 107.

One or more (e.g., each) of the drum components 101-105 can include one or more features configured to output a relatively low volume when energized (e.g., struck, such as with a drum stick) as compared to traditional acoustic drums. Accordingly, the one or more drum components 101-105 that include the one or more features configured to output a relatively low volume can thus be referred to as a "low volume acoustic drum". In one example, each drum component 101-105 of the acoustical drum set 100 is a low volume drum. In another example, some, but not all, of the drum components 101-105 of the acoustical drum set 100 can be a low volume drum. In yet a further example, a single drum component 101-105 of the acoustical drum set 100 can be a low volume drum. Herein, the term low volume drum can refer to any one or more (e.g., each) of the drum components 101-105 that include one or more features configured to output a relatively low volume, as compared to traditional acoustic drums, when struck.

The low volume drum can include a drum head ("low volume drum head") that is configured to provide a surface to be struck when played. The drum head can include one or more features configured to produce a relatively low volume, as compared to traditional acoustic drum head, when struck.

For example, the low volume drum head can include a material that is configured, when struck, to output a relatively low volume, as compared to traditional acoustic drum head yet at the same time can provide a similar feel to a user as a traditional acoustic drum head. Such material of the drum head can be a material having a density of 1 to 5 pounds per cubic foot, 1.5 to 4.5 pounds per cubic foot, 2 to 4 pounds per cubic foot, 2.5 to 3.5 pounds per cubic foot, or 3 pounds per cubic foot. Such a material, with the noted density, of the low volume drum head could be, for instance, a closed cell polymer, or closed cell foam, material. For example, the low volume drum head can include (e.g., be made of) a closed cell foam such as: ethylene-vinyl acetate (EVA, also known as PEVA, polyethylene-vinyl acetate), polyethylene foam, expanded polyethylene foam (EPE foam), or cross-linked polyethylene (PEX, XPE or XLPE).

The low volume drum head can include the material that is configured, when struck, to output a relatively low volume at a particular thickness. For example, the noted material of the low volume drum head can have a thickness of 0.5 to 5 inches, 1 to 4 inches, 1.25 to 3.5 inches, 1 to 3 inches, or 1.5 to 3 inches. And, this material can extend along a width of the low volume drum head from one end secured to the drum shell to another opposite end secured to the drum shell. In one embodiment, the thickness of the material of the low volume drum head can be uniform along its width from one end secured to the drum shell to another opposite end secured to the drum shell.

Notably, one or more of the above described characteristics of the low volume drum head can create a low volume drum head while at the same time providing the same, or similar, feel as a traditional acoustic drum head when struck. Namely, the low volume drum head can provide the same, or similar, bounce and tactile feel when struck with a drum stick. This can allow a user to play the low volume drum head comfortably with the same technique as a traditional acoustic drum yet while producing a relatively low volume sound output. The low volume acoustic drum does not require a high-tension drum head surface, as does a traditional acoustic drum, to create this comfortable, familiar playability. A traditional acoustic drum head is pulled across the open end of a drum shell (typically a round cylinder made of wooden plies) by a series of threaded tension rods tightened into metal hardware attached around the circumference of the drum shell. When tightened, a traditional acoustic drum head creates a "bounce" when played with drum sticks. The low volume drum head, on the other hand, doesn't require the high-tension of a traditional acoustic drum head to create a comfortable, familiar playability. As such, the low volume drum head can be secured to the drum shell via a more simplistic complementary coupling therebetween. The bounce produced when striking the low volume drum head can instead be created by the structure (e.g., density) of the material that makes up the low volume drum head. It is not necessary to tighten tension the low volume drum head firmly against the drum shell, and instead the coupling therebetween may only need to be sufficient to provide securement between the low volume drum head and drum shell. Accordingly, the low volume drum head may not change tone with added, or otherwise changed, tension thereat. In certain embodiments, the pitch of the low volume drum can be determined by the size and shape of the drum shell to which the low volume drum head is secured.

FIGS. 2A-2L illustrate an exemplary embodiment of a snare drum 200 that, for instance, can be included in the acoustical drum set 100. The snare drum 200 includes a low volume drum head 201, for instance as described above with respect to the low volume drum head, and a pellet chamber 202. When struck, the snare drum 200 outputs a relatively low volume sound, due to the presence of the low volume drum head 201, as pellets bounce within the pellet chamber 202.

A traditional acoustic snare drum creates a "snare" sound by using a series of wires (snare wires) pulled across the bottom head of a snare drum. When the snare drum is struck, the wires buzz (rattle, resonate) giving the snare drum its' distinctive sound. To create a sound similar to a traditional snare drum, the low volume snare drum 200 uses the enclosed pellet chamber 202 beneath the low volume drum head 201. The floor of the pellet chamber 202 can be a removable and interchangeable metal plate. The pellets enclosed within the pellet chamber 202 can be small pieces of metal, such as small ball bearings, shelving nibs, etc. When the low volume snare drum 200 is struck, the pellets can bounce against the metal plate floor of the pellet chamber 202. During use of the low volume snare drum 200, the pellets bouncing on the chamber floor plate can create a snare-like sound but at a relatively lower volume as compared to a traditional snare drum that has snare wires and a tensioned mylar drum head. The snare-like sound produced by the low volume snare drum 200 at a relatively low volume can result from the unique structural configuration of the low volume snare drum 200, including the low volume drum head 201 the pellet chamber 202, and related mechanisms.

As shown in the low volume snare drum 200 embodiment of FIGS. 2A-2L, the low volume drum head 201 can be positioned at a top of the pellet chamber 202. The low volume drum head 201 can be held in place by one or more head latches 209. The pellet chamber 202 can include one or more chamber sections. In the illustrated embodiment, the pellet chamber 202 can be formed from a one-piece chamber component that is supported at the chamber floor plate 205. In other embodiments within the scope of the present disclosure, the pellet chamber 202 can be formed from a multi-piece construction of components. This could, for instance, include four chamber section that are of the same configuration, each in the form of a section that is a 90 degree arc and interconnected to form a 360 degree enclosure (e.g., circle). The pellet chamber 202 can have a lower ledge, such as a lip support, to support the chamber floor plate 205 thereat. Another ledge, such as another lip support, can extend around the interior, such as a top interior, of a wall of the pellet chamber 202. This ledge can support the low volume drum head 201 and the pellet chamber 202. The walls of the pellet chamber 202 can define one or more apertures configured to permit increased sound output. Namely, the one or more apertures defined in the walls of the pellet chamber 202 can allow more sound to radiate out from the inside of the pellet chamber 202 when the low volume snare drum 200 is struck.

As shown in the illustrated embodiment, a base 204 can be formed at the drum leg structure 203. The base 204 can support a spindle 207 positioned beneath the chamber floor plate 205 (e.g., beneath a center of the chamber floor plate 205 as shown in the illustrated embodiment). The magnetic choke 206 is secured (e.g., screwed) onto the spindle 207. The magnetic choke 206 can include one or more magnets 208. The one or more magnets 208 can be configured to alter movement of the pellets 212 inside the pellet chamber 202 by imparting a magnetic force between the one or more magnets 208 and the pellets 212 within the pellet chamber 202 and such that changing the extent of this magnetic force (e.g., by moving the one or more magnets 208 closer to or further from the pellet chamber 202) changes the degree of movement of the pellets 212 within the pellet chamber 202. For example, the closer the one or more magnets 208 are to the pellet chamber 202, the greater the magnetic force between the one or more magnets 208 and the pellets 212 within the pellet chamber 202 and, thus, the lesser degree of movement the pellets 212 have within the pellet chamber 202. As a result, the snare-like sound produced by the low volume snare drum 200 can have a modified, tighter intensity and shorter duration. Similarly, the further the one or more magnets 208 are from the pellet chamber 202, the lesser the magnetic force between the one or more magnets 208 and the pellets 212 within the pellet chamber 202 and, thus, the greater degree of movement the pellets 212 have within the pellet chamber 202. As a result, the snare-like sound produced by the low volume snare drum 200 can have a modified, looser intensity and longer duration.

The magnetic choke 206, as shown here, can be a flat, generally X-cross-sectional shape, with one or more of the legs of the X shape having one or more recesses to receive a magnet 208. In the illustrated embodiment, one magnet 208 is included at each of the four legs of the X shape for a total of four magnets 208. The magnets 208 in the magnetic choke 206 can, for instance, lay parallel to the chamber floor plate 205. In the illustrated embodiment, each magnet 208 can be placed at a magnet plug 215, and the magnet plug 215 can be configured to receive and hold the magnet 208 thereat. Each magnet plug 215 can have a complementary connector (e.g., threading) for securing to a complementary connector (e.g., threading) at a respective recess on the magnetic choke 206. Thus, each magnet can be configured to be removably secured at a respective magnet plug 215, and each magnet plug 215 can be configured to be removably secured at a respective recess on the magnetic choke 206. Accordingly, this configuration can allow for customization of the low volume snare drum 200 by allowing for different magnets 208 to be interchanged. For instance, magnets 208 imparting varied magnetic force can be interchanged so as to vary the snare-like sound produced by the low volume snare drum 200 as desired for a particular application. The magnetic choke 206 can be threaded onto the spindle 207 (e.g., via a threaded bolt) which protrudes upward from the base 204 below. The magnetic choke 206 can be moved (e.g., spun) up or down, raising or lowering its proximity to the chamber floor plate 205 and, as a result, bringing the one or more magnets 208 closer to or further from the pellet chamber 202 and thus pellets 212 therein. As described above, when the magnetic choke 206 is spun closer to the chamber floor plate 205, the movement of the pellets 212 inside the pellet chamber 202 can be increasingly restrained, and when the magnetic choke 206 is lowered, and thus spun further from the chamber floor plate 205, the pellets 212 can move more freely. This can allow the drummer to adjust the duration and intensity of the snare buzz (rattle) produced by the low volume snare drum 200.

A head latch 209 can be positioned at, or near, the top of one or more legs 203 of the base 204, for instance with a spring loaded screw and nut. In the illustrated embodiment, four head latches 209 are included, with one head latch 209 positioned at a top portion of each of the four legs 203 of the base 204. To secure the head latch 209 at the snare drum leg 203, a male nub on the head latch 209 (e.g., at the bottom the head latch 209) can fit into a receiving socket on the top of the snare drum leg 203. This connection of the head latch 209 and snare drum leg 203 can be configured so that the head latch 209 can rotate (e.g., spin, such as in a clockwise and/or counterclockwise direction) relative to the respective snare drum leg 203. The head latch 209 can rotate, relative to the respective snare drum leg 203, between rotatably spaced apart (e.g., by one hundred and eighty degrees) locked and unlocked positions. When the head latches 209 are in the unlocked position, the low volume snare drum head 201 can be lifted off the pellet chamber 202 so as to allow for convenient access to the pellet chamber 202, for instance to inspect and/or change pellets 212. Changing the type of pellet and/or quantity of pellets 212 can alter the sound of the snare effect output from the low volume snare drum 200. As such, the head latches 209 can help to allow for customization of the sound output by the low volume snare drum 200.

Another feature of the low volume snare drum 200 can be the interchangeability of the chamber floor plate 205. Chamber floor plates of different material, for instance of different metallic material, such as aluminum, stainless steel, etc., can produce different qualities of the snare effect. As such, removing a chamber floor plate made of one type of material from the low volume snare drum 200 and replacing it with a chamber floor plate of made of another, different type of material can allow for additional customization of the low volume snare drum 200. The low volume snare drum 200 can include the chamber floor plate 205 removably secured in place at the low volume snare drum 200 so that the different chamber floor plates can be interchanged.

In the illustrated embodiment, a sound reflector plate 213 is shown associated with the low volume snare drum 200. The sound reflector plate 213 can be positioned beneath the low volume snare drum 200 (e.g., opposite the low volume drum head 201). The sound reflector plate 213 can be shaped as a parabolic disk, for example 4 to 24, 10 to 18, 12 to 16, or 13 to 14 inches in diameter. The sound reflector plate 213 can be made of a relatively hard material, such as metal, acrylic, wood, etc. The sound reflector plate 213 can be configured to reflect sound emanating from the underside of the low volume snare drum 200 upwards. As such, the low volume snare drum 200 is set on the sound reflector plate 213 creating a surface that bounces the sound output from the low volume snare drum 200 upwards towards the drummer. Sound reflector plates 213 of different materials produce different qualities (color, timbre, effect) to the sound reflected from the low volume snare drum 200, thereby allowing for different material sound reflector plates 213 for preferential customization to the drummer's tastes.

The illustrated embodiment of the low volume snare drum 200 further includes a percussion piece holder 214. The percussion piece holder 214 can include a base support 214 and one or more holders 217. In the illustrated embodiment, the percussion piece holder 214 includes the base support 214 and two holders 217 extending out from the base support 214. The holders 217 can be configured to receive a percussion instrument 218 thereat. The percussion piece holder 214 can be removably connected to the low volume snare drum 200. The percussion piece holder 214 can be configured to hold the percussion instrument 218 (e.g., a clave as shown in the illustrated embodiment, and in other embodiments can be cowbell, pipe, drum stick, etc.), such as at the one or more holders 217, near the low volume snare drum head 201. This can provide the drummer with a number of (e.g., one to four) additional playing surfaces near the snare drum head 201. The percussion piece holder 214 can be designed to hold different shaped percussion instruments. For example, the percussion piece holder 214 can include a circular groove for holding a cylindrical instrument (e.g., clave, pipe, drumstick, etc.) and a flat-top lip for a flat-bottom object (e.g., woodblock, etc.). The percussion piece holder 214 may also include holes so that a fastener cord (e.g., zip tie, rope, bungee, etc.) can be threaded through the percussion piece holder 214 and around the percussion instrument to further secure such percussion instrument in place at the percussion piece holder 214.

In some cases, when so included, the percussion piece holder 214 can also be utilized as a "backstop" for the butt end of the drum stick. For example, this can be useful when the drummer wants to play a "layover rimshot," a technique used in various types of musical genres. Typically, a layover rimshot is produced by resting the butt of the drumstick against the inside of a traditional snare drum's rim. The tip of the drum stick is laid over the drum head resting on top of the opposite rim. The drummer uses the butt of the stick as a pivot point, lifting the tip of the stick up and down to strike the rim. Using two percussion piece holders 214, one as a backstop and the other as a holder of the opposite "rim" (a percussion instrument substitute) can allow for this technique to be used on the low volume snare drum 200.

As shown in the illustrated embodiment, each leg 203 of the base 204 can have an accessory bolt 211 which screws tightly into the snare drum leg 203. Each leg 203 of the base 204 can have a groove (e.g., channel) on its outward face. The percussion piece holder 214 can have a protruding tongue that slides into the leg's groove from above. The accessory bolt 211 can be unscrewed to allow the percussion piece holder 214 to be installed onto the low volume snare drum 200. Then, the accessory bolt can be inserted through the percussion piece holder 214 and into the snare drum leg 203. The accessory bolt 211 can then be sufficiently tightened to secure the percussion piece holder 214 in place.

FIGS. 3A-3E show an embodiment of a low volume acoustic drum 300 that, for instance, can be included in the acoustical drum set of FIG. 1. For example, the low volume acoustic drum 300 can be one or more (e.g., each) of the high rack tom 102, the low rack tom 103, the floor tom 104, and the bass drum 105. The low volume acoustic drum 300 includes a low volume drum head 301 and a drum shell 302. The low volume drum head 301 can have characteristics the same as that described above with respect to the low volume drum head.

The drum shell 302 can be an opened top container, such as a cylinder or tube, made, for instance, of a polymer material, such as an injection molded plastic (e.g., polyethylene, such as high-density polyethylene (HDPE, or plastic #2), low-density polyethylene (LDPE, or plastic #4), or polypropylene (PP, or plastic #5). The low volume drum head 301 can be secured onto of the drum shell 302 by a number of means, including any of clamps, elastic cord, etc. In the embodiment shown here, the open end of the low volume drum shell 302 includes a circular lip 320 extending around the circumference of the drum shell 302, creating a "male" part, of the complementary connection to the low volume drum head 301. Also in the embodiment shown here, the low volume drum head 301 has a corresponding "female" part, of the complementary connection to the drum shell 302, in the form of a channel 321 formed into the bottom surface of the low volume drum head 301. This channel 321 can receive the lip 320 extending around the top of the drum shell 302 thereby securing the low volume drum head 301 to the drum shell 302. This connection between the low volume drum head 301 and the drum shell 302 can allow for easy attachment and removal without any tool.

The size of the drum shell 302 can determine the pitch, or tone, of the low volume acoustic drum 300. For example, in general, the larger the internal volume of the drum shell 302, the lower the pitch. For instance, the drum shell 302 of the high rack tom 102 can be the smallest internal volume, thus providing the highest pitch. As another example, the drum shell 304 of the bass drum 105, referred to herein as the low volume bass drum 300, can be the largest internal volume, thus providing the lowest pitch. In this way, the low volume drums disclosed herein can have the respective drum shell sizes configured to produce a pitch similar to those of traditional acoustic drums. In use, a drum stick striking the low volume drum head 301 (or low volume drum head 303, in the case of the low volume bass drum 300) can creates a low volume, relatively quiet thud. This then causes the drum shell 302 (or drum shell 304, in the case of the low volume bass drum 300) to resonate that thud, increasing the volume and adding tone. As a result, this combination creates a drum sound similar to a traditional acoustic drum, but at a lower volume due to the low volume drum head 301 (or low volume drum head 303, in the case of the low volume bass drum 300). Moreover, in certain embodiments, the drum shell 302, 304 can be relatively thin-walled, lightweight structure that can help it resonate in a way that a heavier structure (e.g., wood, acrylic, metal) may not be able.

Figure 3A:
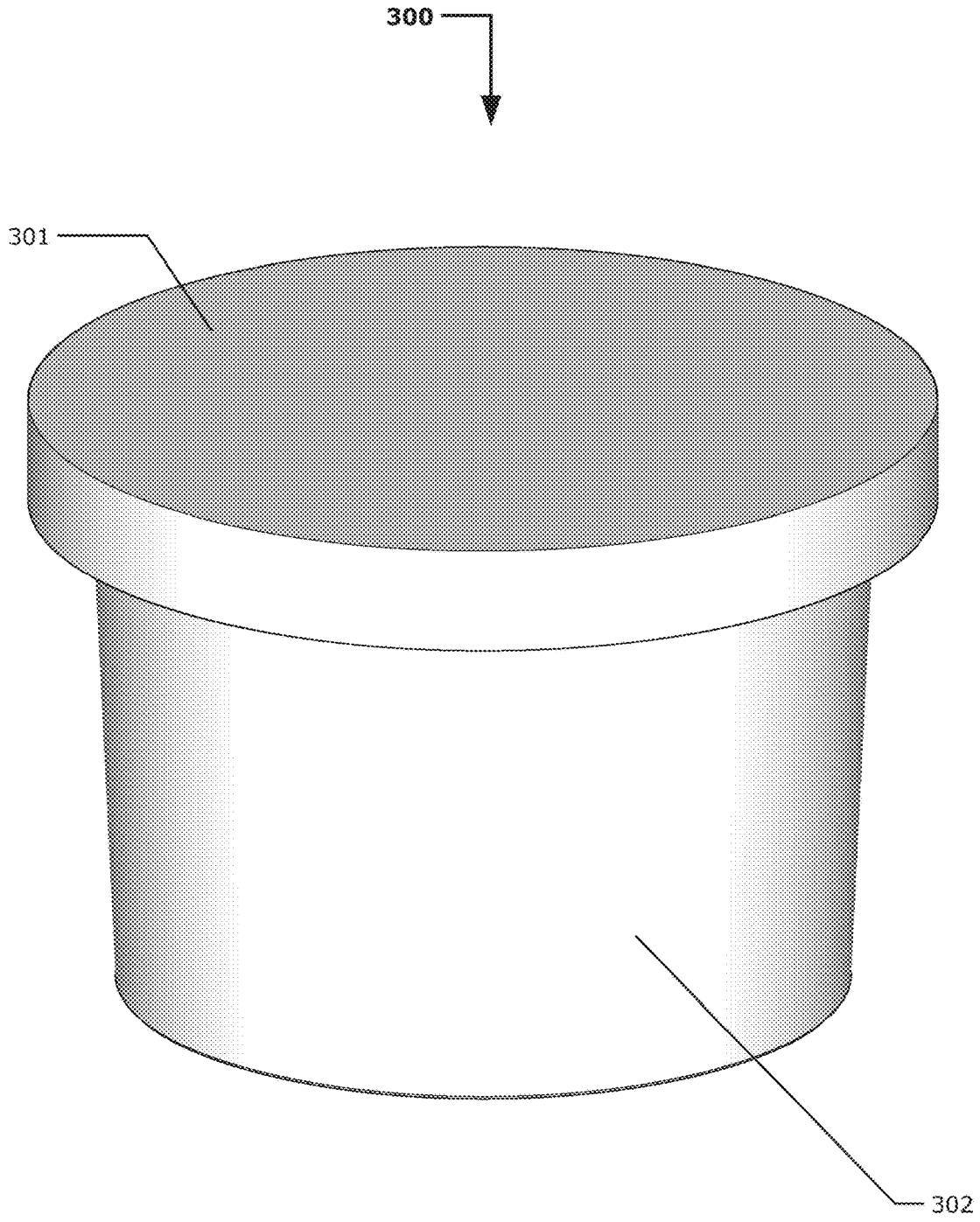
FIGS. 3A-3E show an embodiment of an acoustical drum that, for instance, can be included in the acoustical drum set of FIG. 1.
Figure 3B:
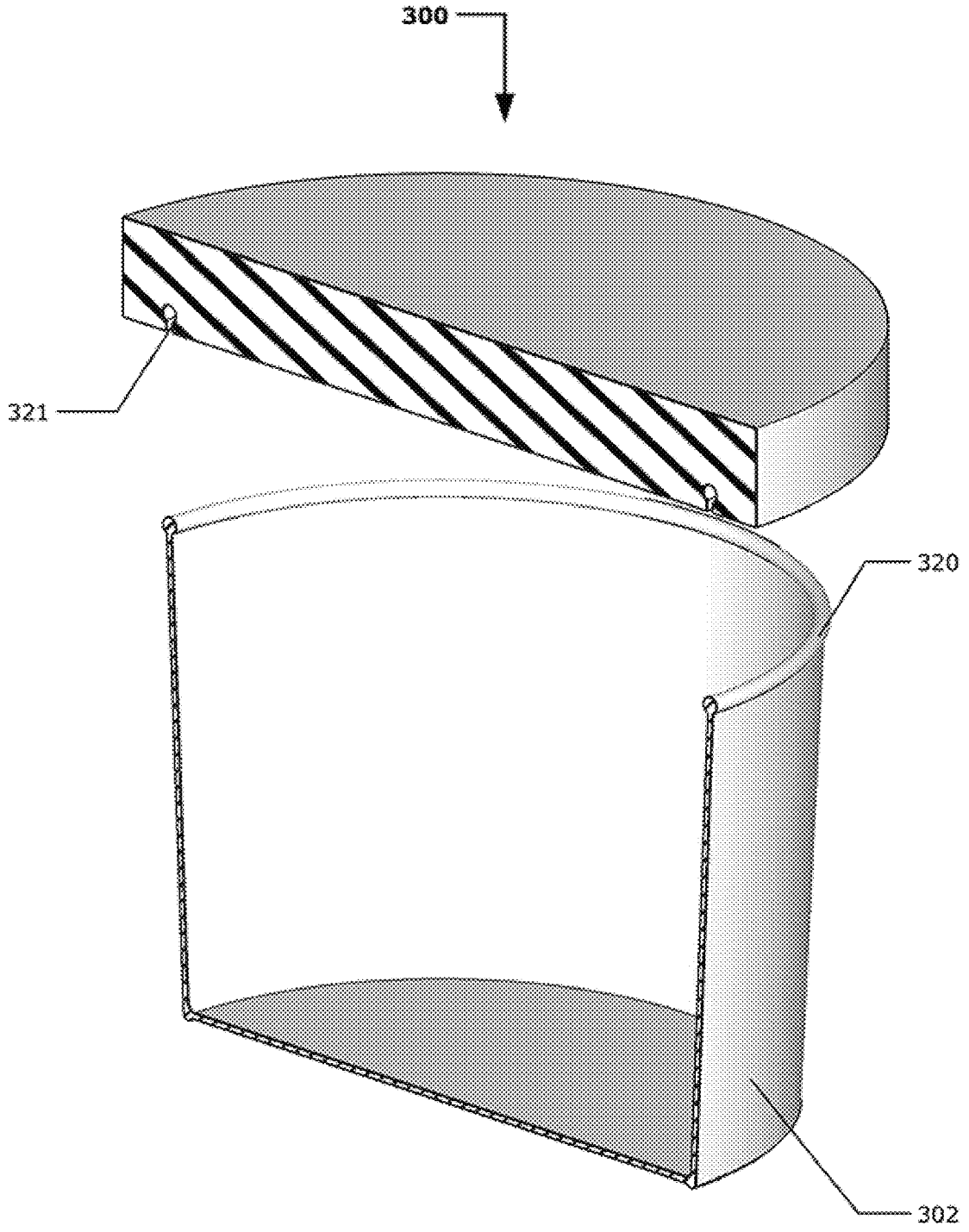
Figure 3C:
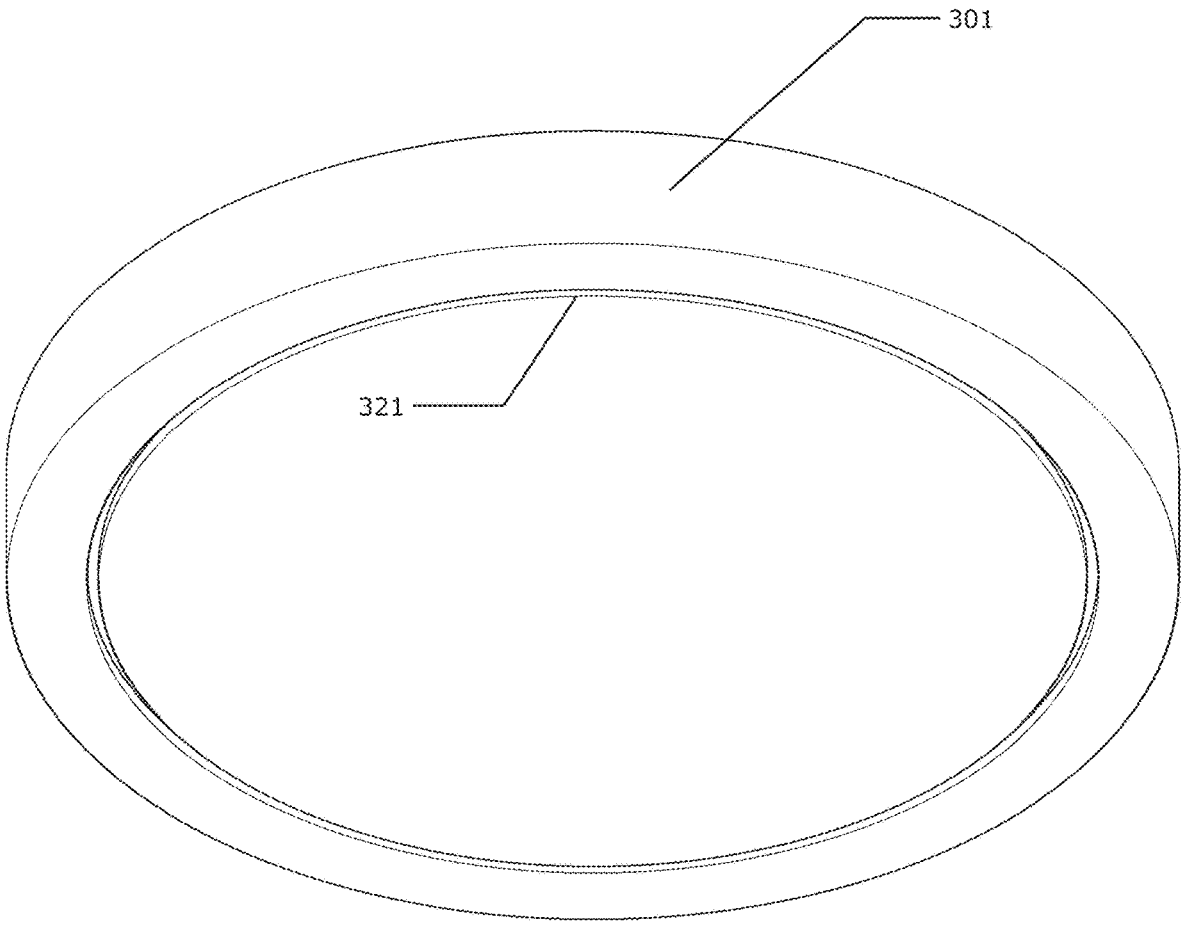
Figure 3D:
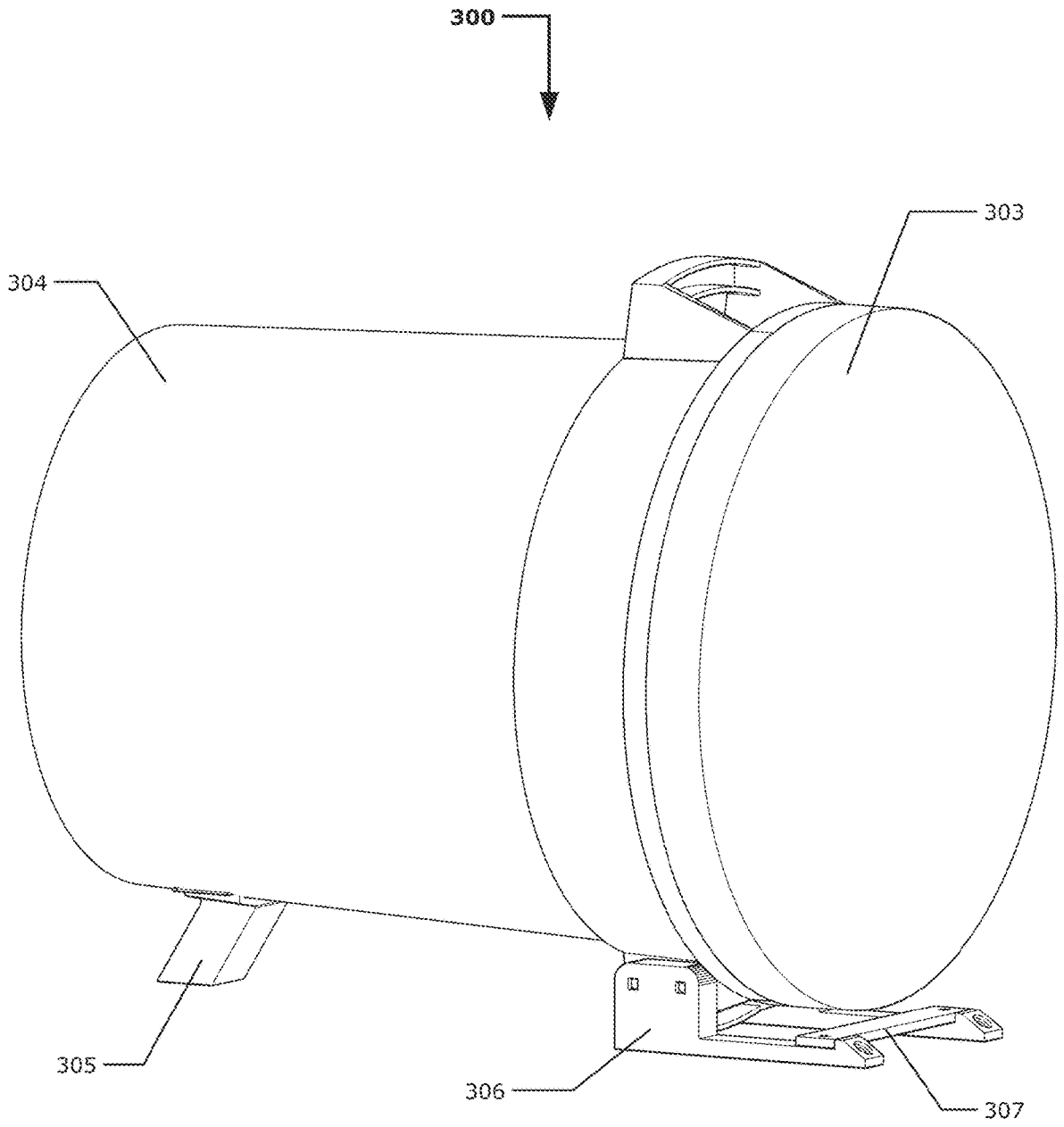
Figure 3E:
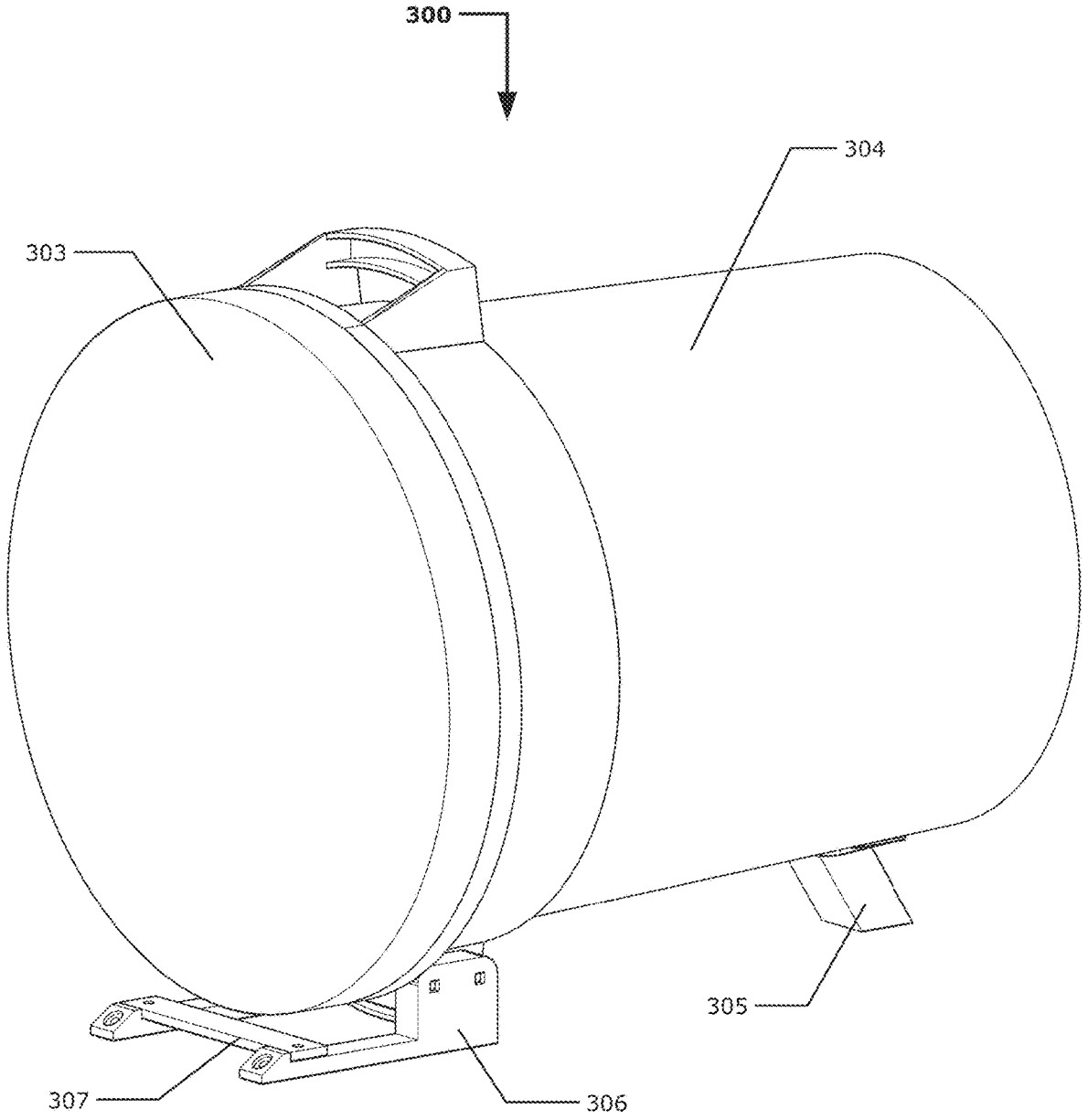
Figure 4A:
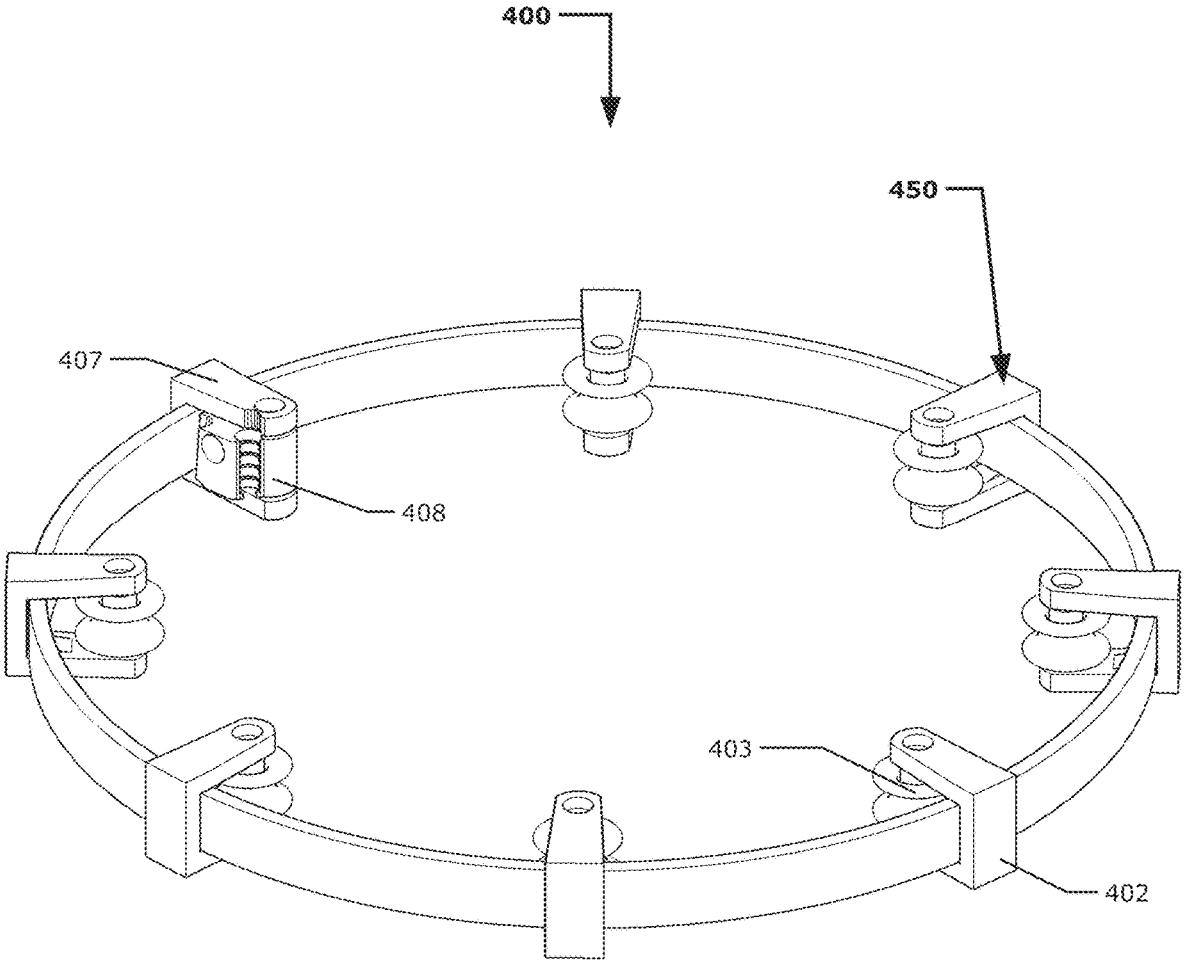
FIGS. 4A-4J show an embodiment of a mounting ring that, for instance, can be included in the acoustical drum set of FIG. 1.
Figure 4B:
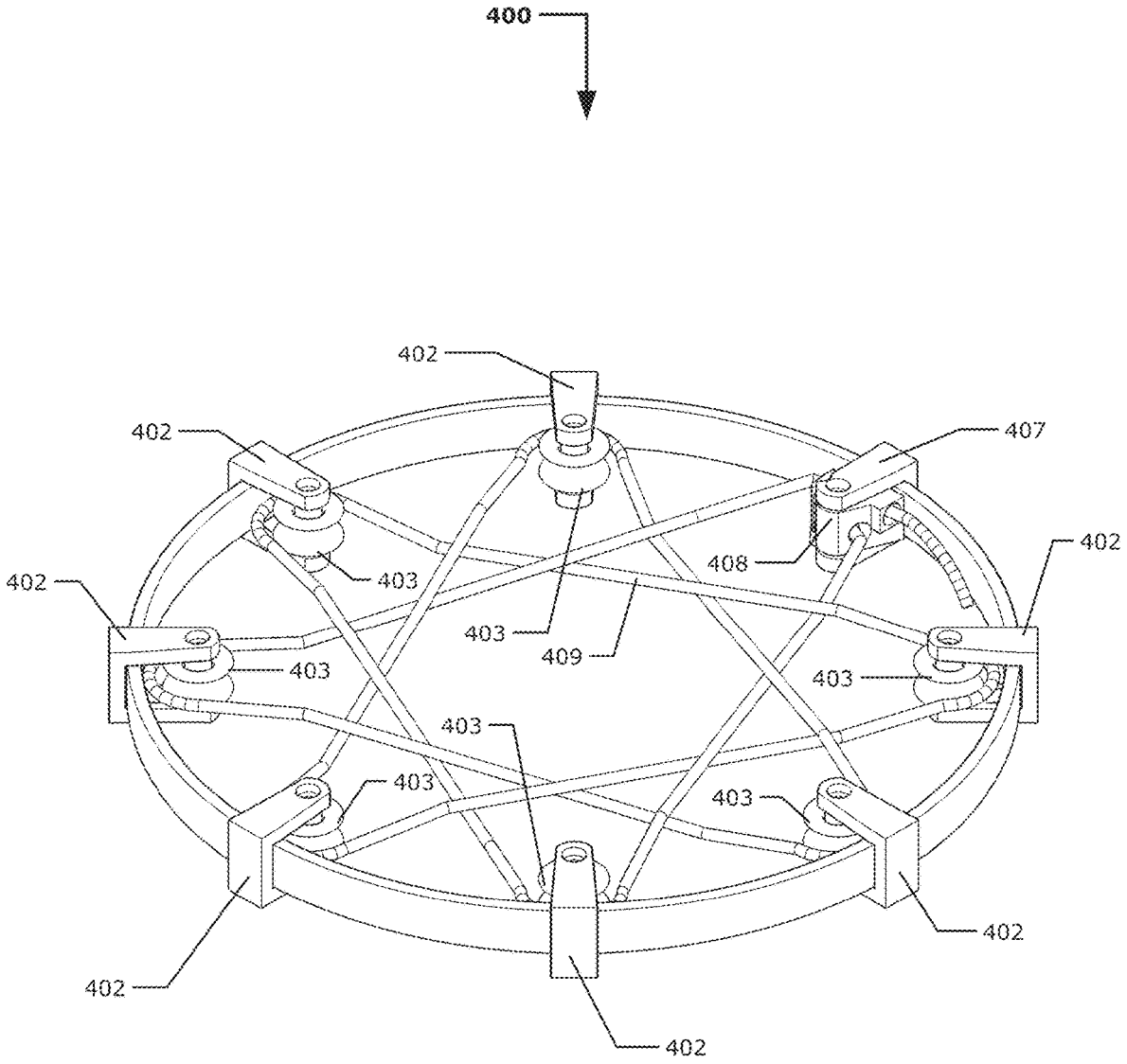
Figure 4C:
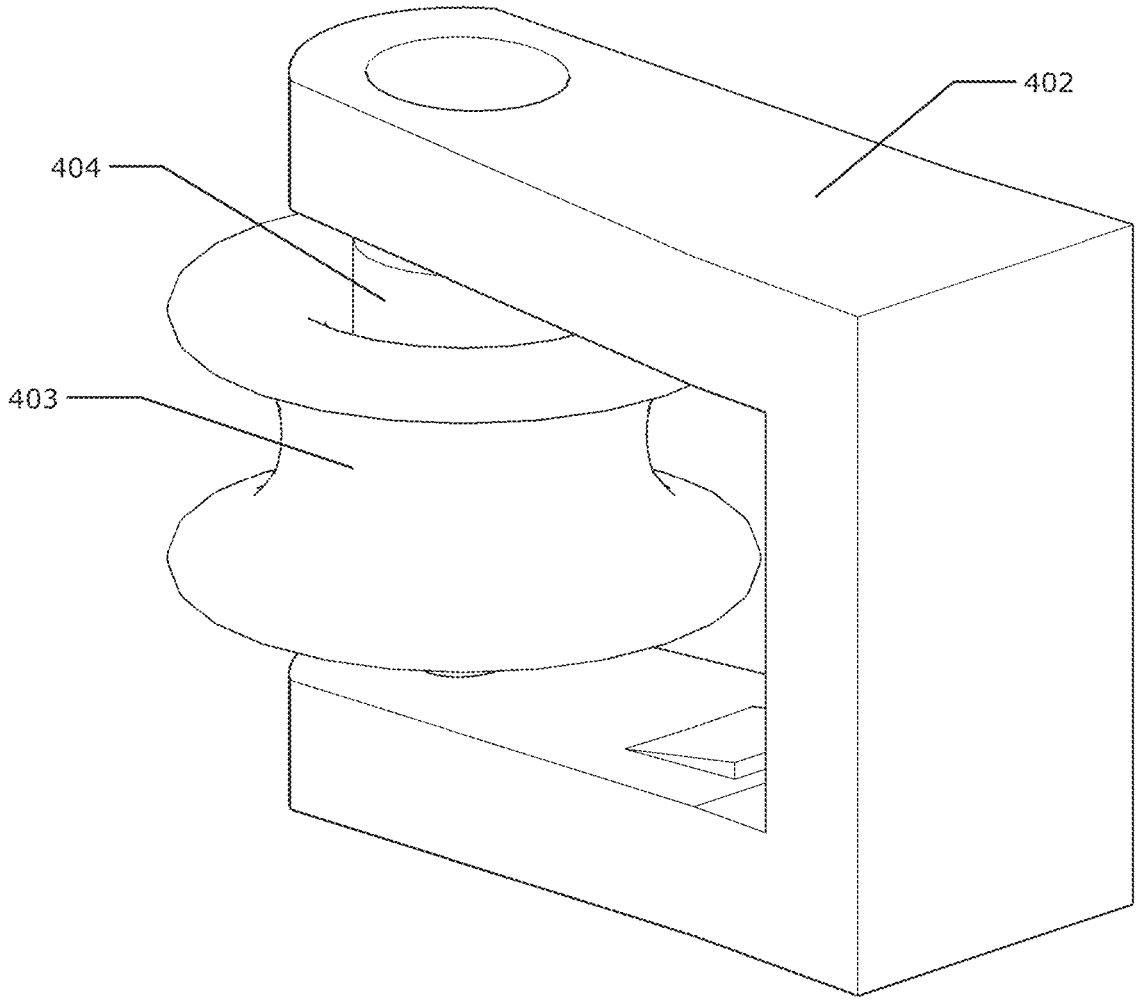
Figure 4D:
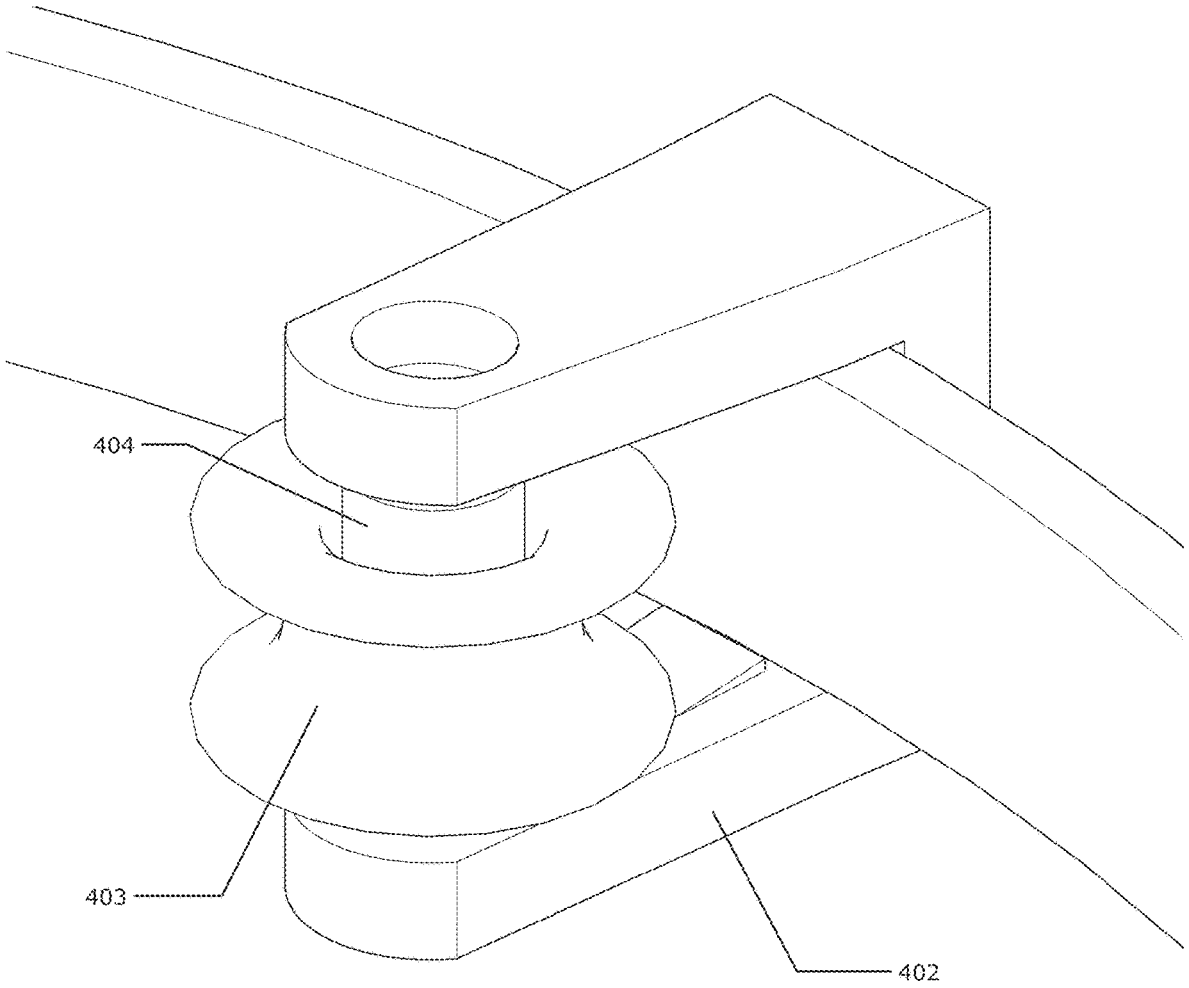
Figure 4E:
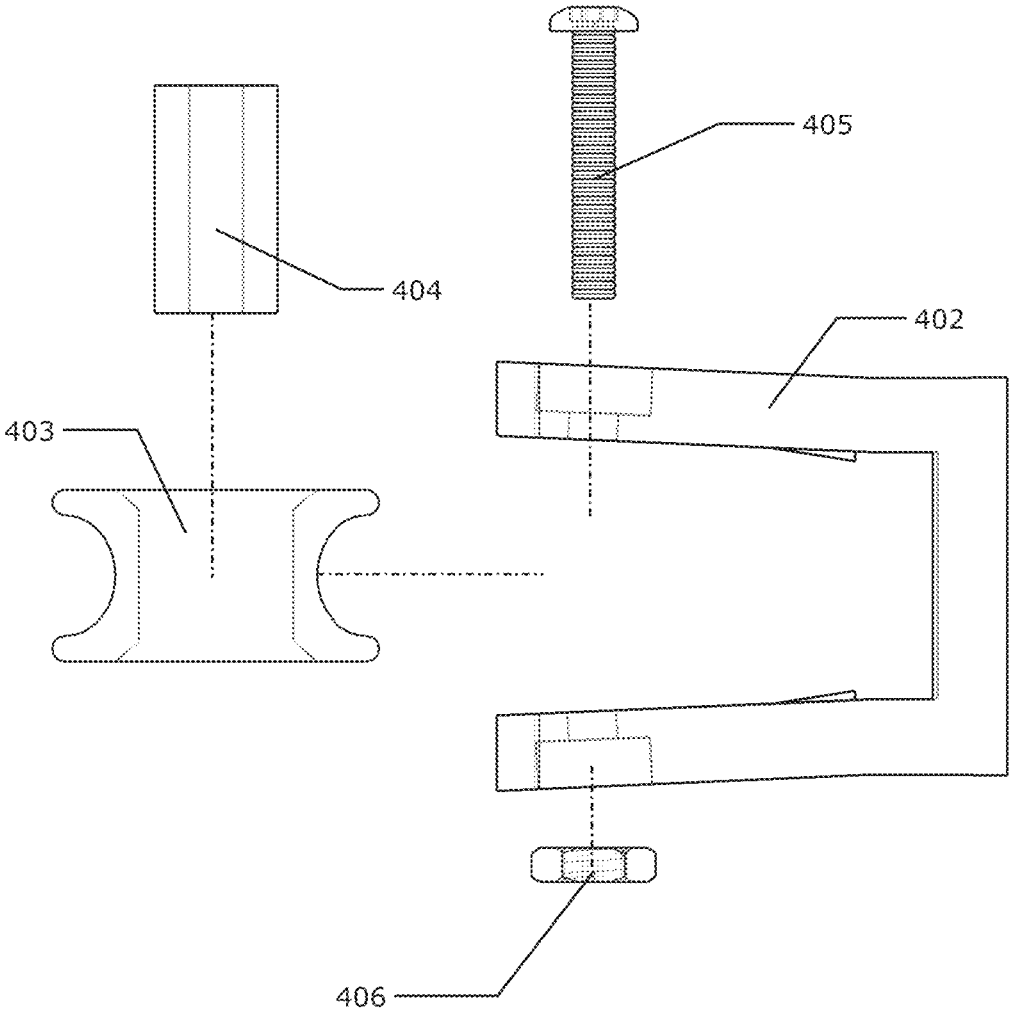
Figure 4F:
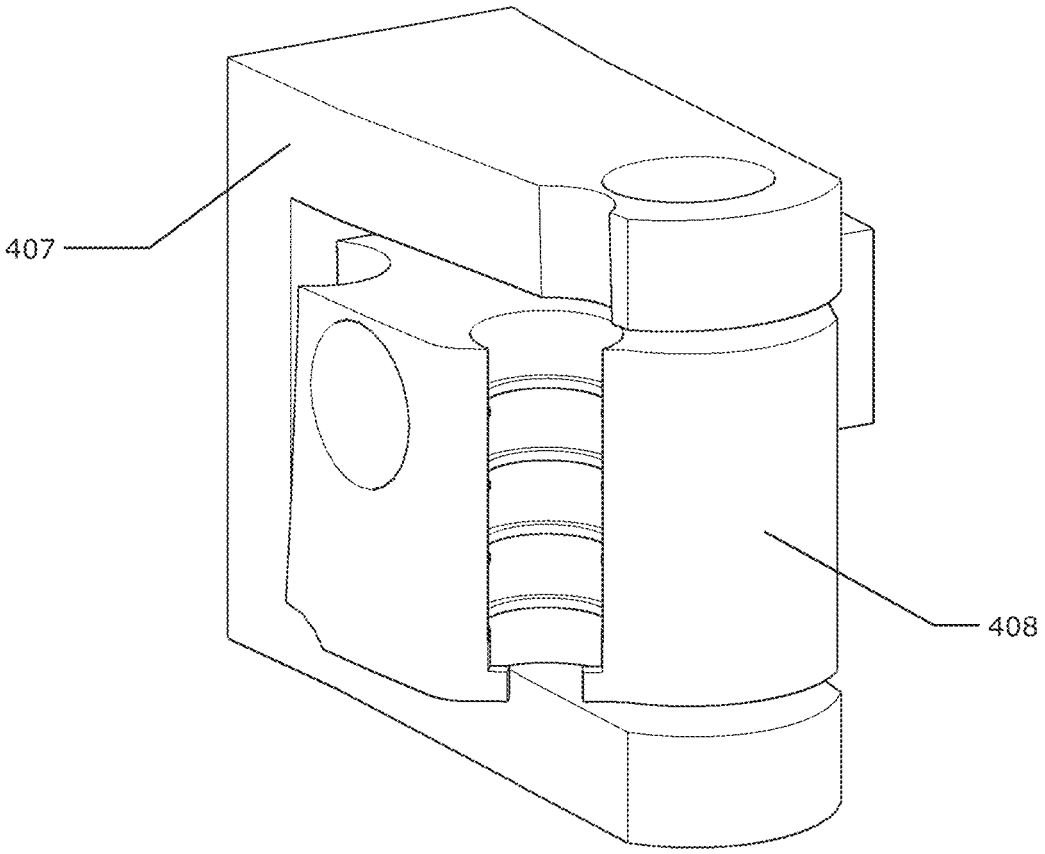
Figure 4G:
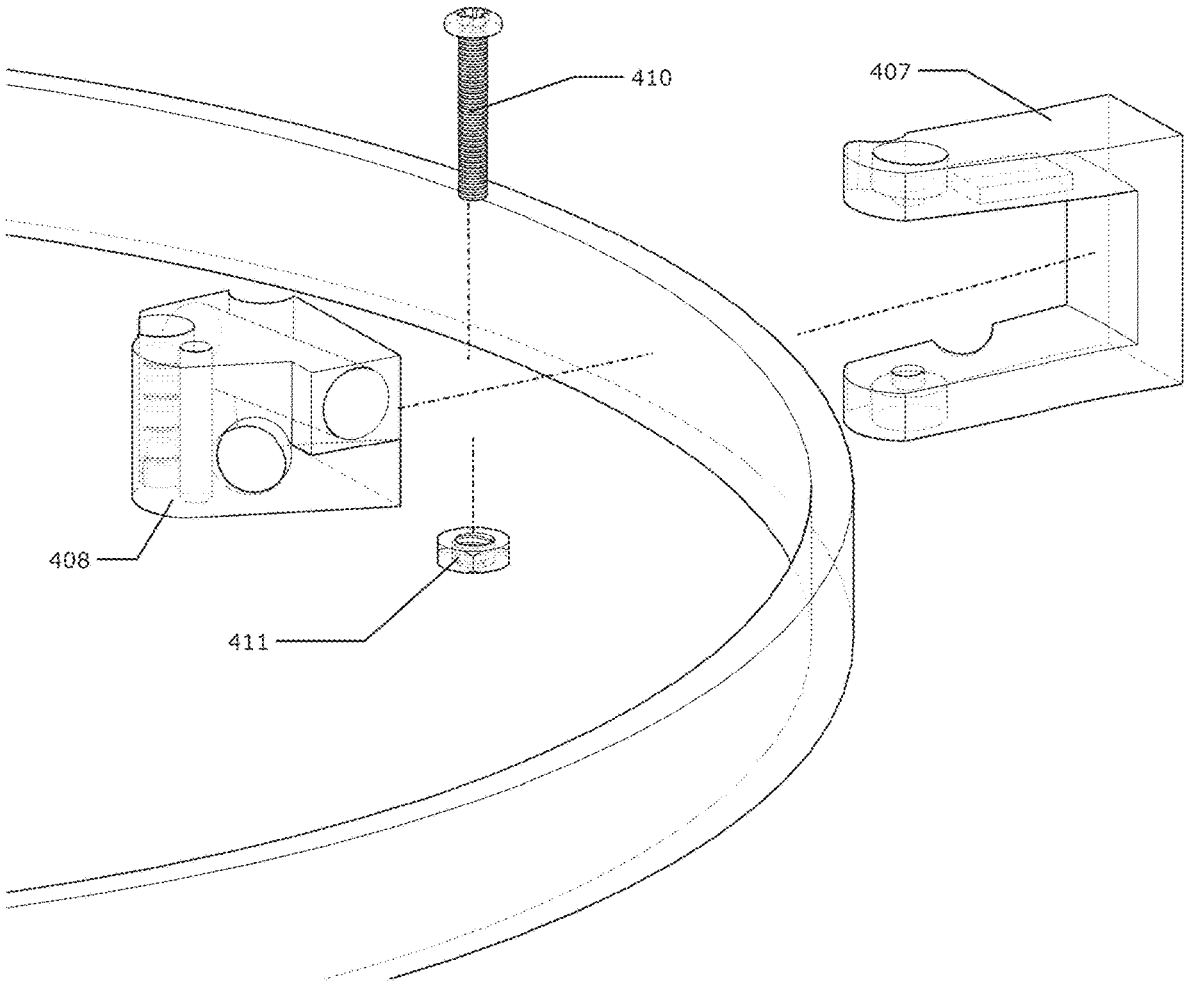
Figure 4H:
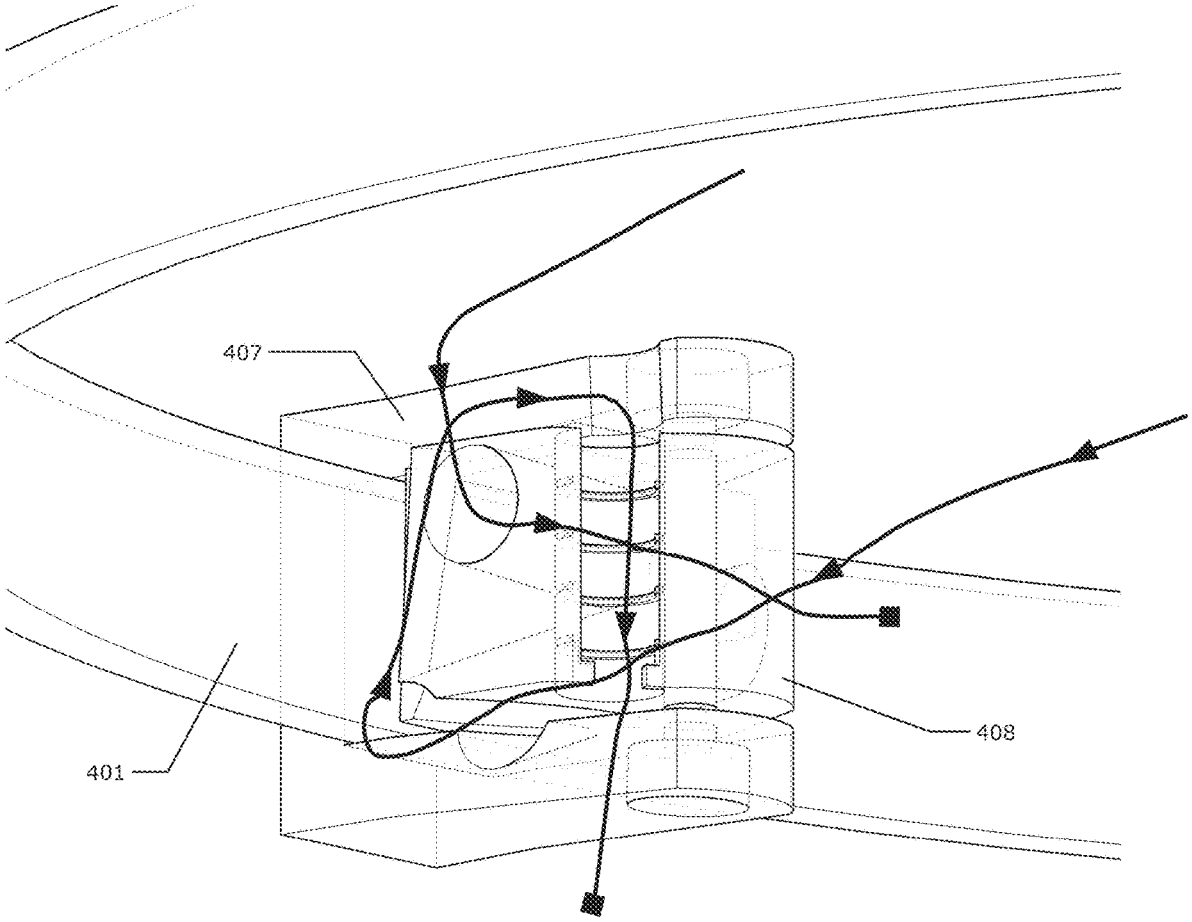
Figure 4I:
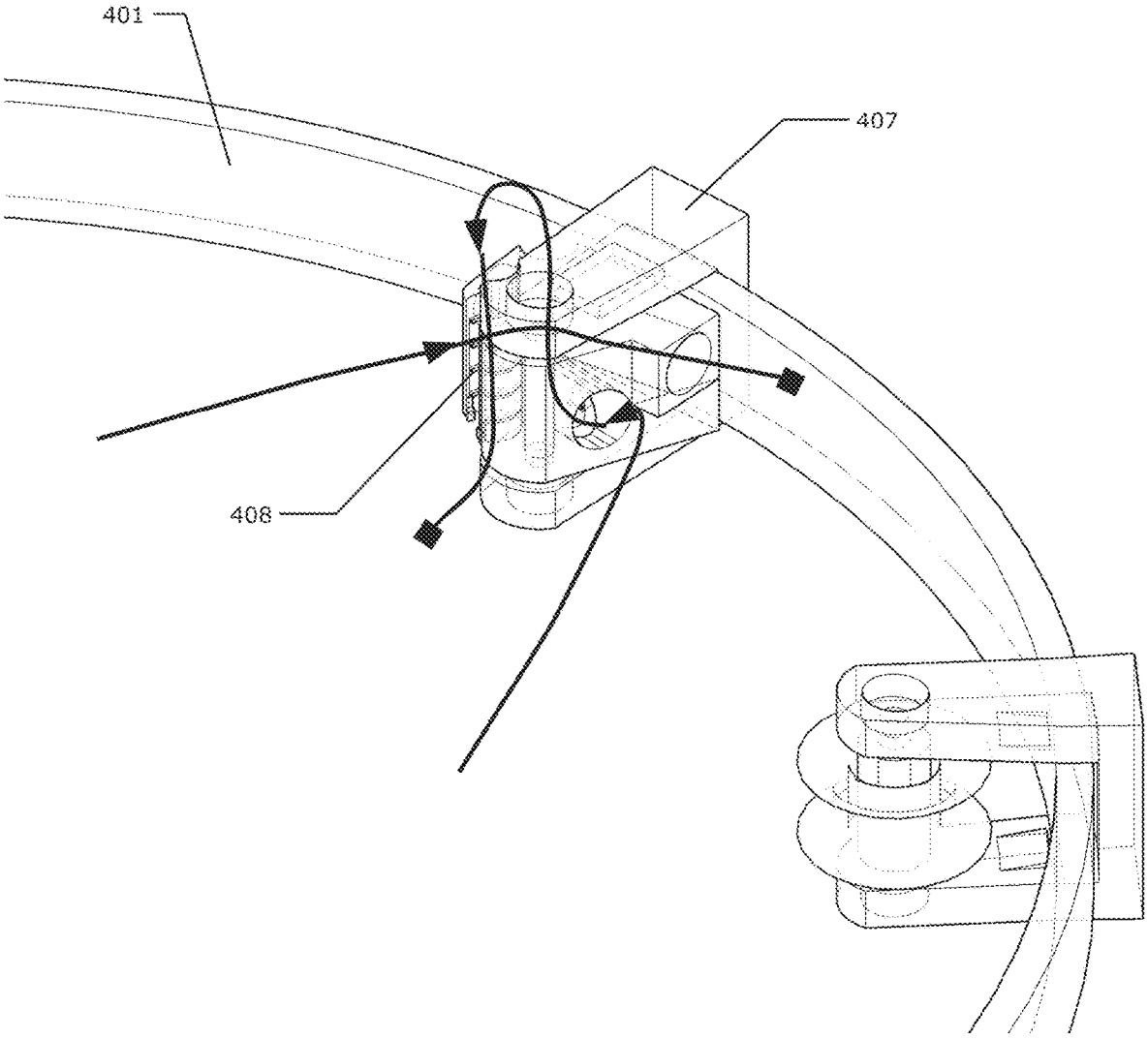
Figure 4J:
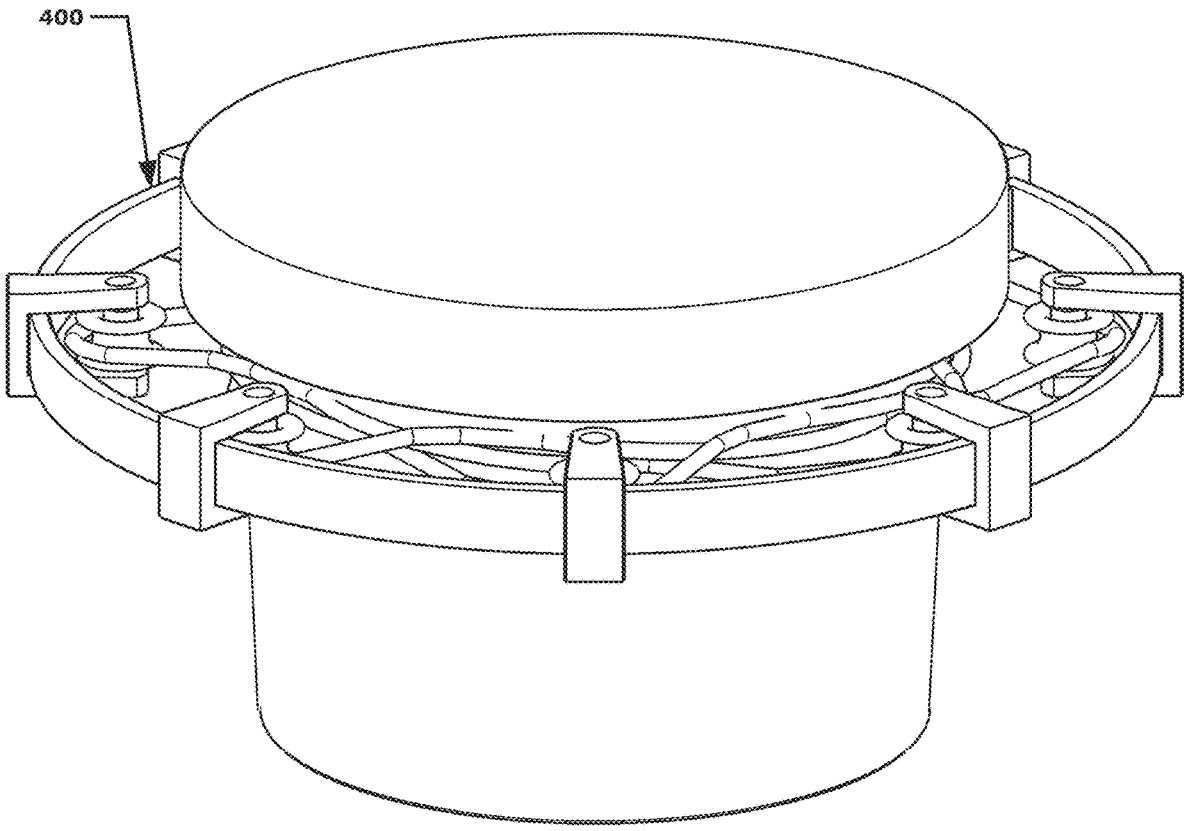

The low volume bass drum 300, shown for example in FIGS. 3D and 3E, includes the low volume bass drum head 303, the bass drum shell 304, a bass drum leg 305, a bass drum pedal receiver bar 307, and a pair of bass drum supports 306. The bass drum pedal receiver bar 307 can be a metallic (e.g., aluminum) bar attached to the bass drum supports 306. The bass drum pedal receiver bar 307 can be positioned to facilitate coupling to a traditional bass drum pedal for use with the low volume bass drum 300.

FIGS. 4A-4J show an embodiment of a mounting ring 400 that, for instance, can be included in the acoustical drum set 100. The mounting ring 400 can be configured to secure a low volume drums thereat.

Since the low volume drum can be relatively lightweight (and, in some cases, be somewhat flexible), traditional acoustic drum mounting hardware may not be needed. Traditional drum mounting systems use metal hardware connected to the drum shell (usually wood) at a single point. This type of heavy-duty mount may induce detrimental wear on the low volume drum, given the drum shell of the low volume drum is a more lightweight (and, in some cases, flexible) structure.

A mounting ring 400 can be used to mount each of the low volume rack toms 102, 103 and the low volume floor tom 104. For instance, as shown in FIG. 1, each of the low volume rack toms 102, 103 and the low volume floor tom 104 can have an associated mounting ring 400. The mounting ring 400 can include a ring 401 (e.g., circular), for instance made of a metallic material, such as aluminum. The ring 401 can be, for example, approximately 3 to 4 inches larger than the diameter of the low volume drum it is configured to hold. An elastic cord 409 (e.g., a bungee cord) is strung through a number of elastic cord sheaves 403. In some examples, such as that illustrated here, the strung cord 409 can form a general star pattern inside the ring 401. For instance, in the illustrated example, there are seven cord sheaves 403 resulting in the strung cord 409 forming an eight-point star shape. Once the cord 409 is appropriately strung through a suitable number if cord sheaves 403, the ends of the cord 409 can be secured at the elastic cord clutch 408.

Each elastic cord holder mechanism 450 can include of a pulley clamp 402 (e.g., generally "U" shaped as shown in the illustrated embodiment), an elastic cord sheave ("pulley wheel") 403, a spacer 404, a screw bolt 405 and a locking nut 406. The elastic cord 409 can be strung around the elastic cord sheaves 403, of one or more of the mechanisms 450, which can spin freely, allowing the elastic cord 409 to move freely at each of the contact points with the elastic cord sheaves 403. As noted, the elastic cord clutch 408 can secure the ends of the elastic cord 409. The elastic cord clutch mechanism can include a clutch clamp 407, for instance that is generally U-shaped, the elastic cord clutch 408, a screw bolt 410, and a locking nut 411. As can be seen in the diagrams shown in FIGS. 4H and 4I, one end of the elastic cord 409 can be threaded through the elastic cord clutch 408 and out to the first elastic cord holder mechanism. The working end of the cord can then be threaded through other cord holder mechanisms to a star shape inside the ring 401. The working end returns to the elastic cord clutch mechanism which can be configured to lock the elastic cord 409 into place thereat. The tension of the elastic cord 409 at the ring 401 can be conveniently adjusted by pulling the working end up from the elastic cord clutch 408, and feeding more or less cord into the interior star shape slack of the elastic cord 409. The working end of the elastic cord 409 is then pulled into the elastic cord clutch 408, locking the elastic cord 409 in place at sufficient tension to enable supporting the respective low volume drum thereat. Of note, adjusting tension of the elastic cord 409 can adjust an amount of bounce when the low volume drum is played while supported at the mounting ring 400. To secure the low volume drum at the mounting ring 400, the low volume drum can be inserted into the interior of the elastic cord star shape inside the ring 401. The mounting ring 400 can thus hold the low volume drum securely in place thereat without imparting undue stress onto the structure of the low volume drum, thereby reducing risk of compromising the integrity of the low volume drum shell and increasing the useful life of the low volume drum.

FIGS. 5A-5F show an embodiment of a stand 500 that, for instance, can be included in the acoustical drum set 100.

The stand 500 is configured to support one or more mounting rings 400, which in turn support one or more low volume acoustical drums. For example, a mounting ring 400 can be attached to two stands 500 via a stand ring coupler 550 at each stand 500. In addition to the stand ring coupler 550, the stand 500 can include a center tube 502, two leg tubes 501 and an adjustable post 503. The adjustable post 503 can have a spring loaded positioning adjustment button 504 mechanism which can selectively lock and unlock into corresponding holes in the center tube 502 to permit adjustment to the position (e.g., height) of the adjustable post 503. These corresponding holes can be spaced apart from one another along a length of the center tube 502 (e.g., at one inch increments along the longitudinal axis of the center tube 502). The adjustable post 503 can slide into center tube 502 in a telescoping arrangement. The stand ring coupler 550 can be positioned at a top portion of the adjustable post 503, such that adjusting the position of the adjustable post 503 correspondingly adjusts the position of the stand ring coupler 550.

The stand ring coupler 550 can include an angle adjustment ring connector 506, an angle adjustment post connector 505, a ring connector anchor 507, a ring stand connector knob and bolt 508 and a locking nut. The angle adjustment ring connector 506 can couple to (e.g., fit over, as shown in the illustrated embodiment) the ring 401 of the mounting ring 400. The bolt 508 can extend from the ring connector anchor 507, to the ring 401, and to the angle adjustment ring connector 506. The bolt 508 can be further secured with a locking nut, as appropriate, and the bolt 508 can secure together the ring connector anchor 507, ring 401, and angle adjustment ring connector 506. A channel on the top of the angle adjustment post connector 505 can be provided to receive any extending portion of the bolt 508.

The angle adjustment ring connector 506 can include a circular bevel-gear-shaped face running parallel to the outside of the ring 401 and at which the bolt 508 can be received. A corresponding, complementary gear-shaped face can be present on the top of the angle adjustment post connector 505. The face on the angle adjustment post connector 505 can include a channel running from a top area to a center area of the bevel gear-shaped face, and the bolt 508 can be received within this channel and protrude out the opposite side of the angle adjustment post connector 505. The ring stand connector knob 508 can be threaded over the bolt and tightened to connect the stand 500 to the mounting ring 400. The complementary gear shaped faces can couple (e.g., nest) together. When the ring stand connector knobs 508 at the top region of the stands 500 are loosened, the mounting ring 400 can be released so as to permit adjustment to the orientation of the mounting ring. For example, this can allow the angular orientation of the mounting ring 400, relative to the stand 500, to be adjusted as appropriate for a specific user and/or application of the low volume drum set. Then, tightening the ring stand connector knobs 508 can secure the mounting ring 400 at the desired angular orientation relative to the stand 500 (e.g., at preset angular orientation increments of ten degrees). The configuration of the mounting ring 400 as coupled to the stand 500 can be useful in allowing the user to tilt the playing surface, such as the low volume drum head of the low volume drum supported at the mounting ring 400, to an angular orientation suitable for that user's style and stature.

Figure 5A:
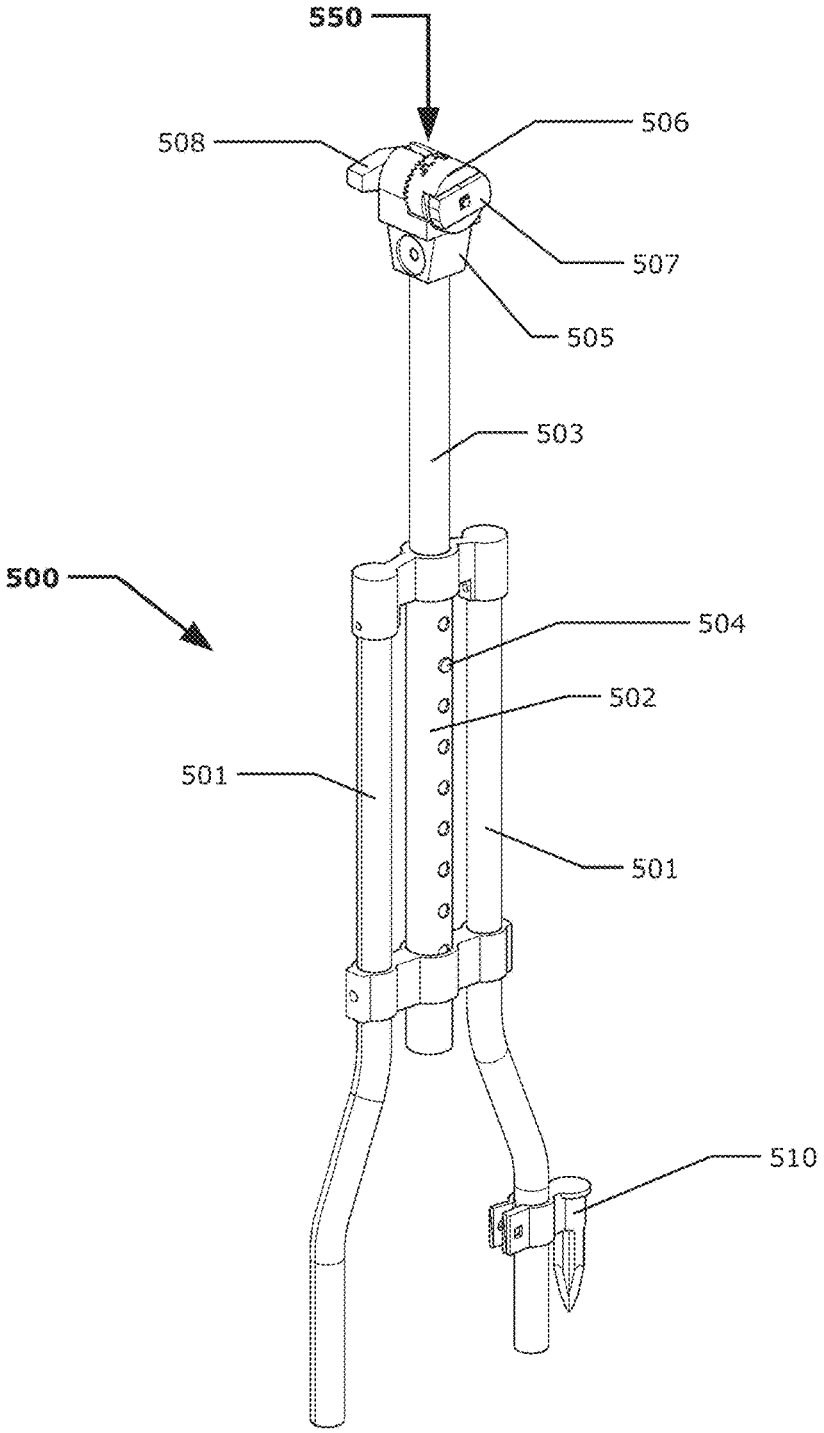
FIGS. 5A-5F show an embodiment of a stand that, for instance, can be included in the acoustical drum set of FIG. 1.
Figure 5B:
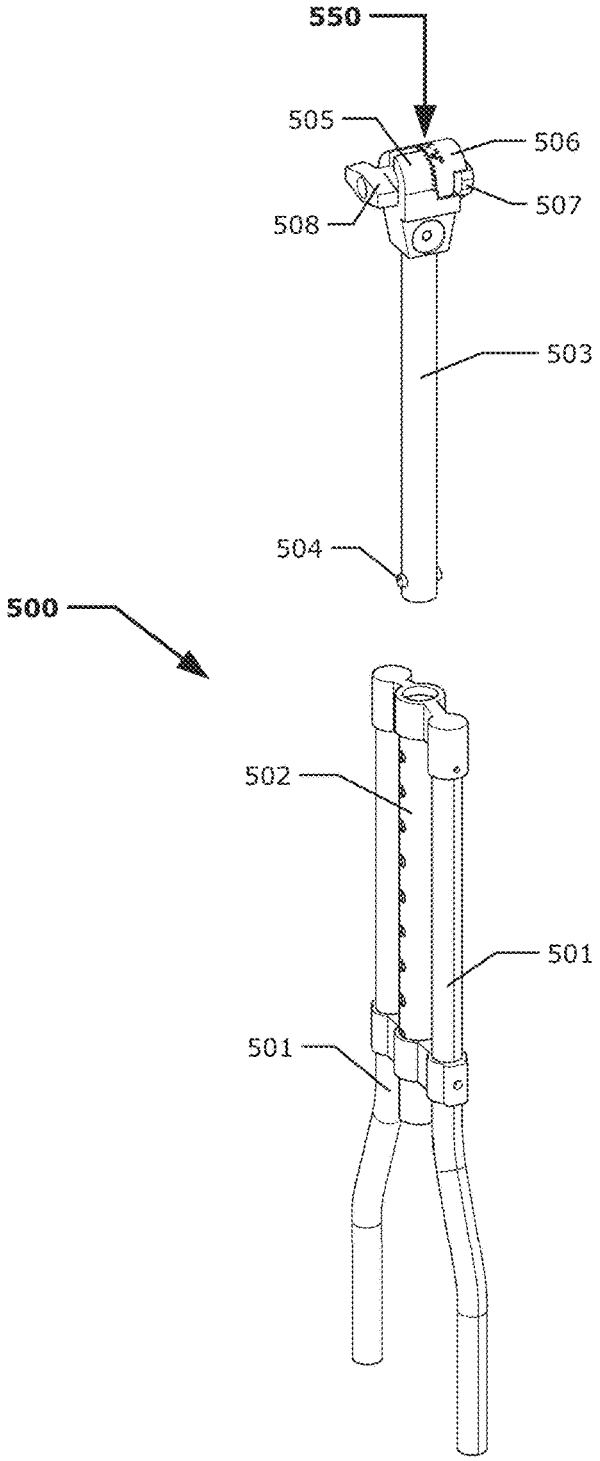
Figure 5C:
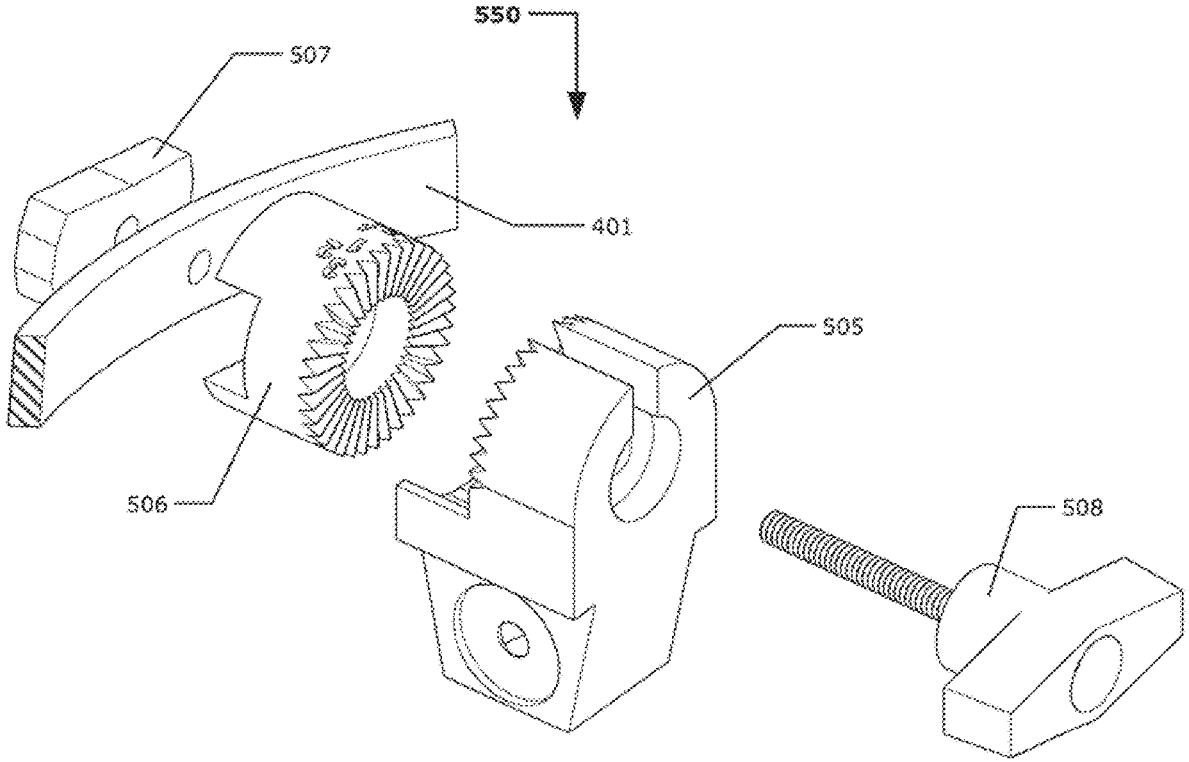
Figure 5D:
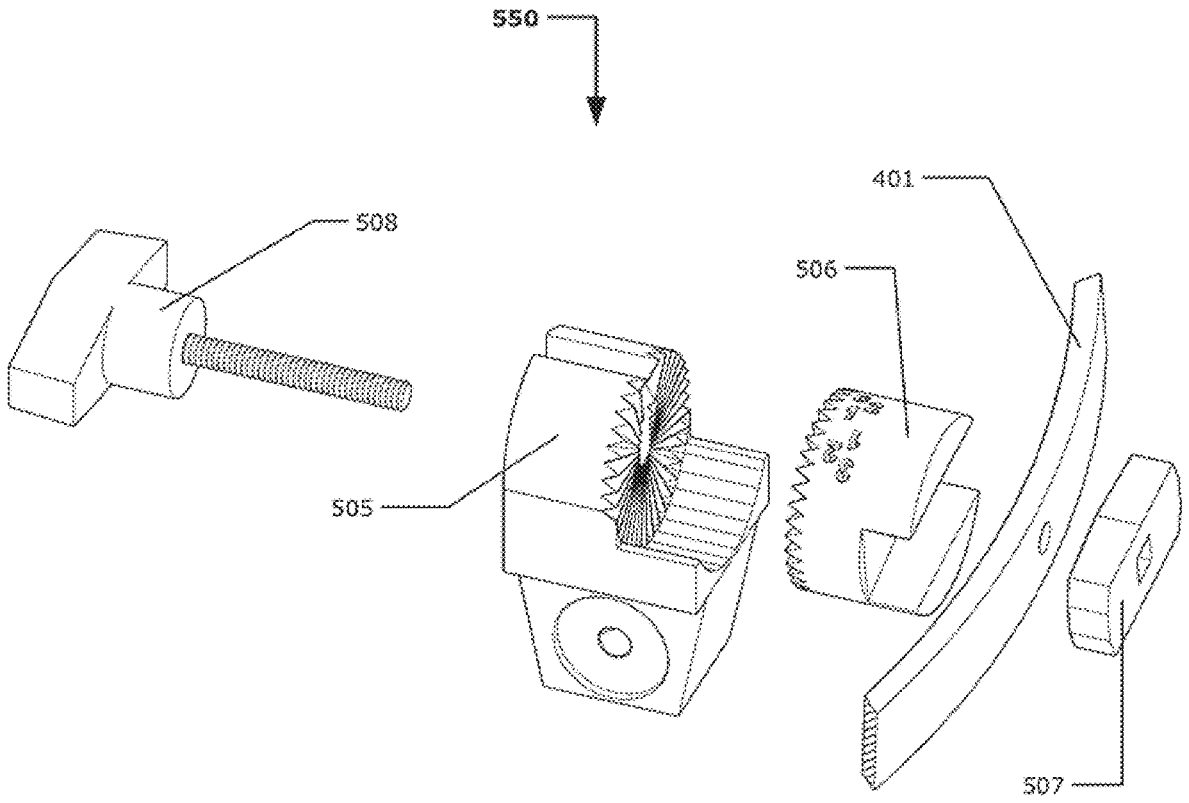
Figure 5E:
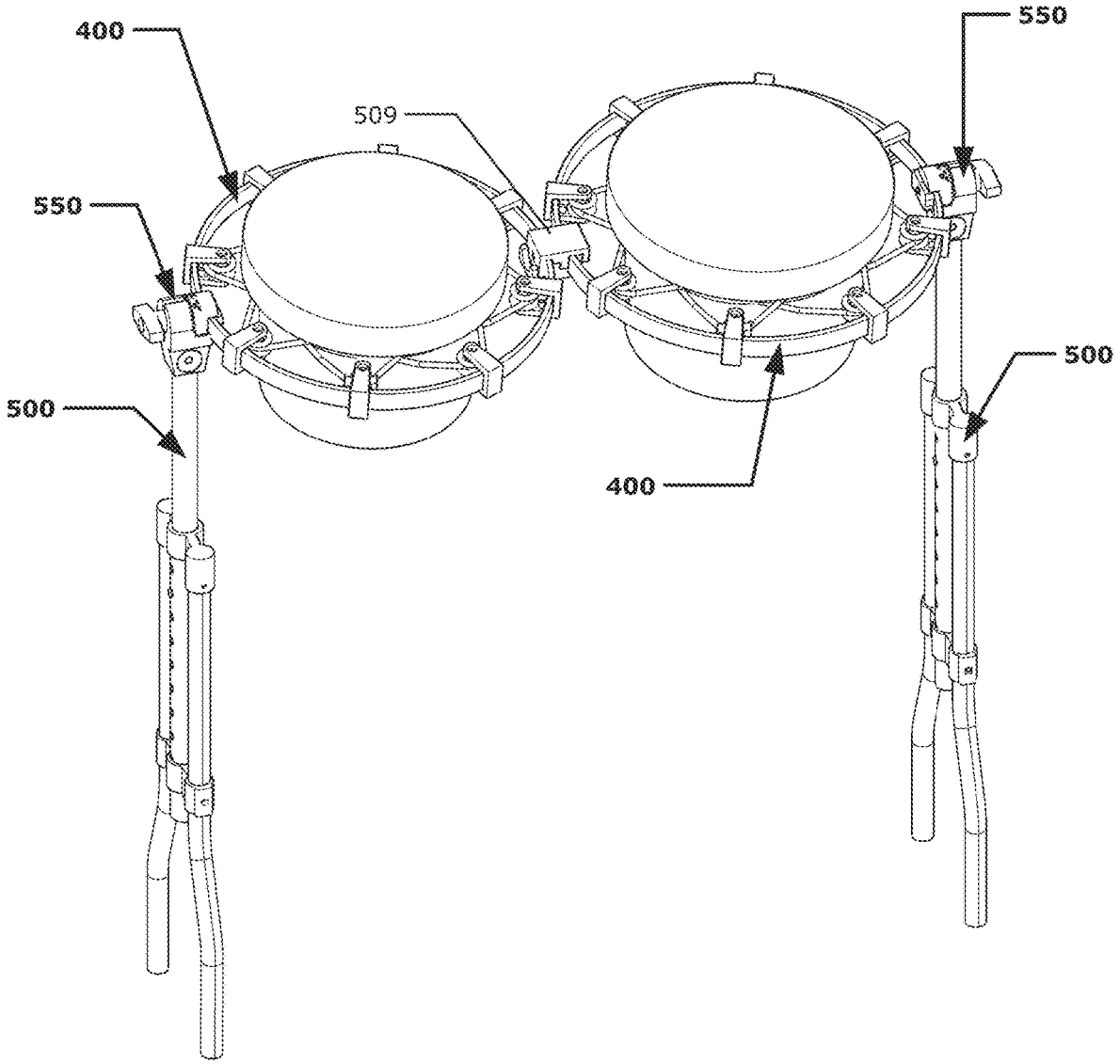
Figure 5F:
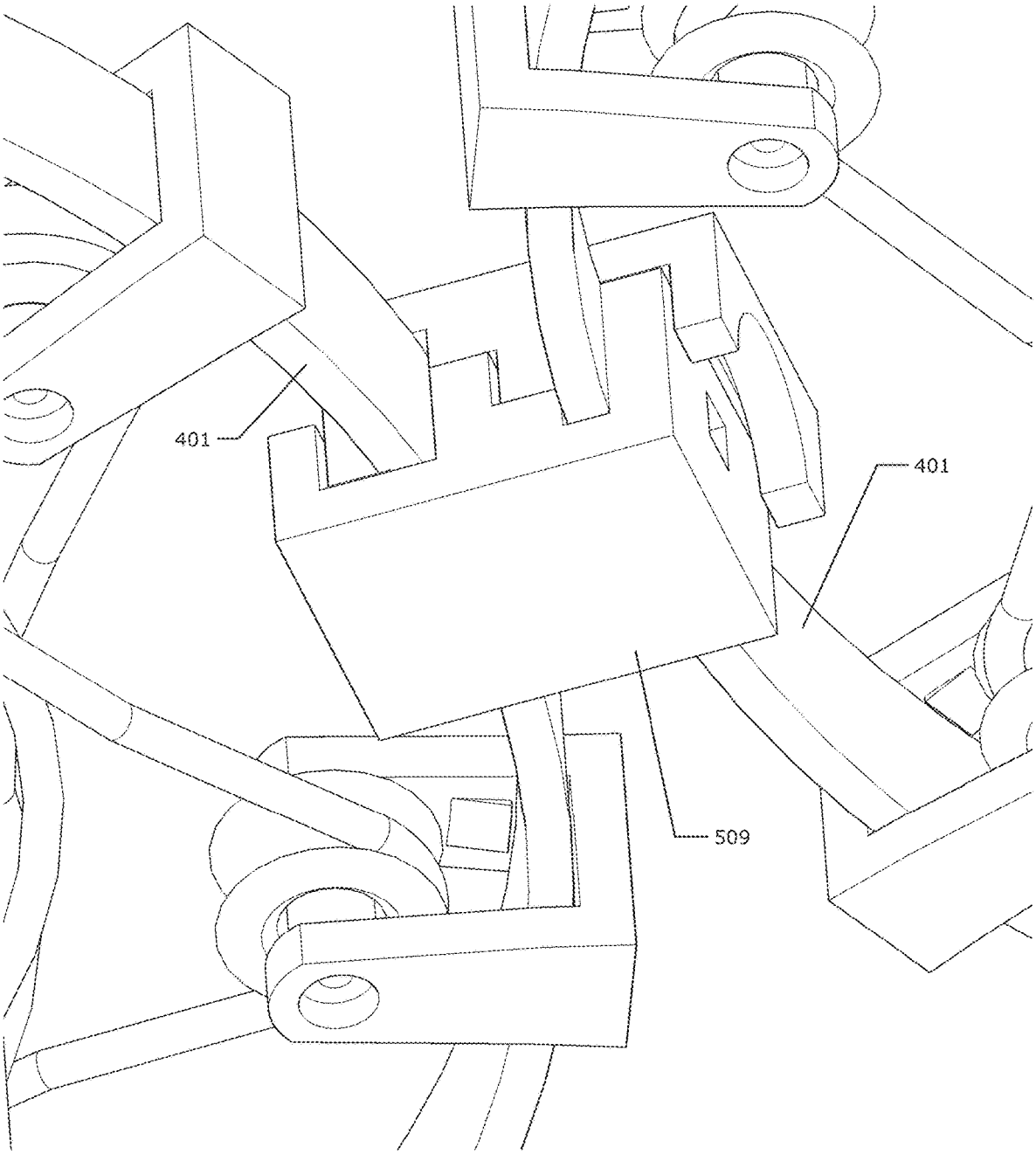

As shown in the embodiment of FIGS. 5E and 5F, the double tom ring connector 509 can be configured to connect two or more mounting rings 400 together. This can allow two or more low volume drums to be mounted using two stands 500, as shown, for example, in FIG. 5E. In the illustrated example, the ring 401 of each mounting ring 400 can be received through the double tom ring connector 509 at a channel defined therethrough. The two channels defined through the double tom ring connector 509 can be spaced apart and separated by and median wall of the double tom ring connector 509 as to provide added stability to the double tom ring connector 509 and, thus, the interconnection of the two mounting rings and low volume drums supported thereat.

FIGS. 6A-6L illustrate another exemplary embodiment of a snare drum 600. Except as otherwise described and illustrated here, the snare drum 600 can have features the same as, or similar to, those described and illustrated previously with respect to the snare drum 200 and, as such, like numerals denote like elements. As with the snare drum 200, the snare drum 600 can, for example, be included in the acoustical drum set 100 or used in isolation.

Figure 6A:
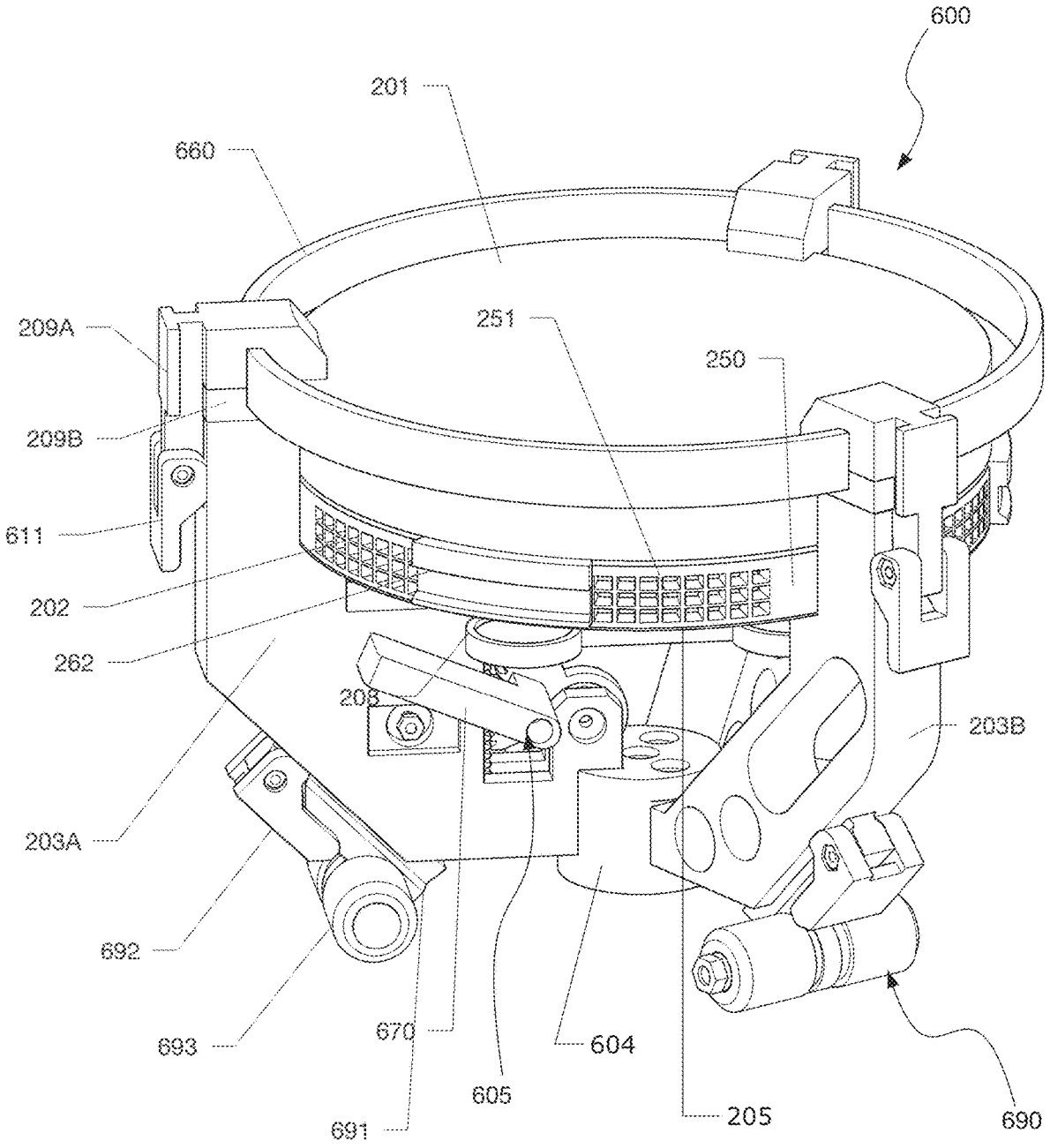
FIGS. 6A-6L show another embodiment of a snare drum that, for instance, can have some features similar to the snare drum embodiment shown in FIGS. 2A-2L and can be included in the acoustical drum set of FIG. 1.
Figure 6B:
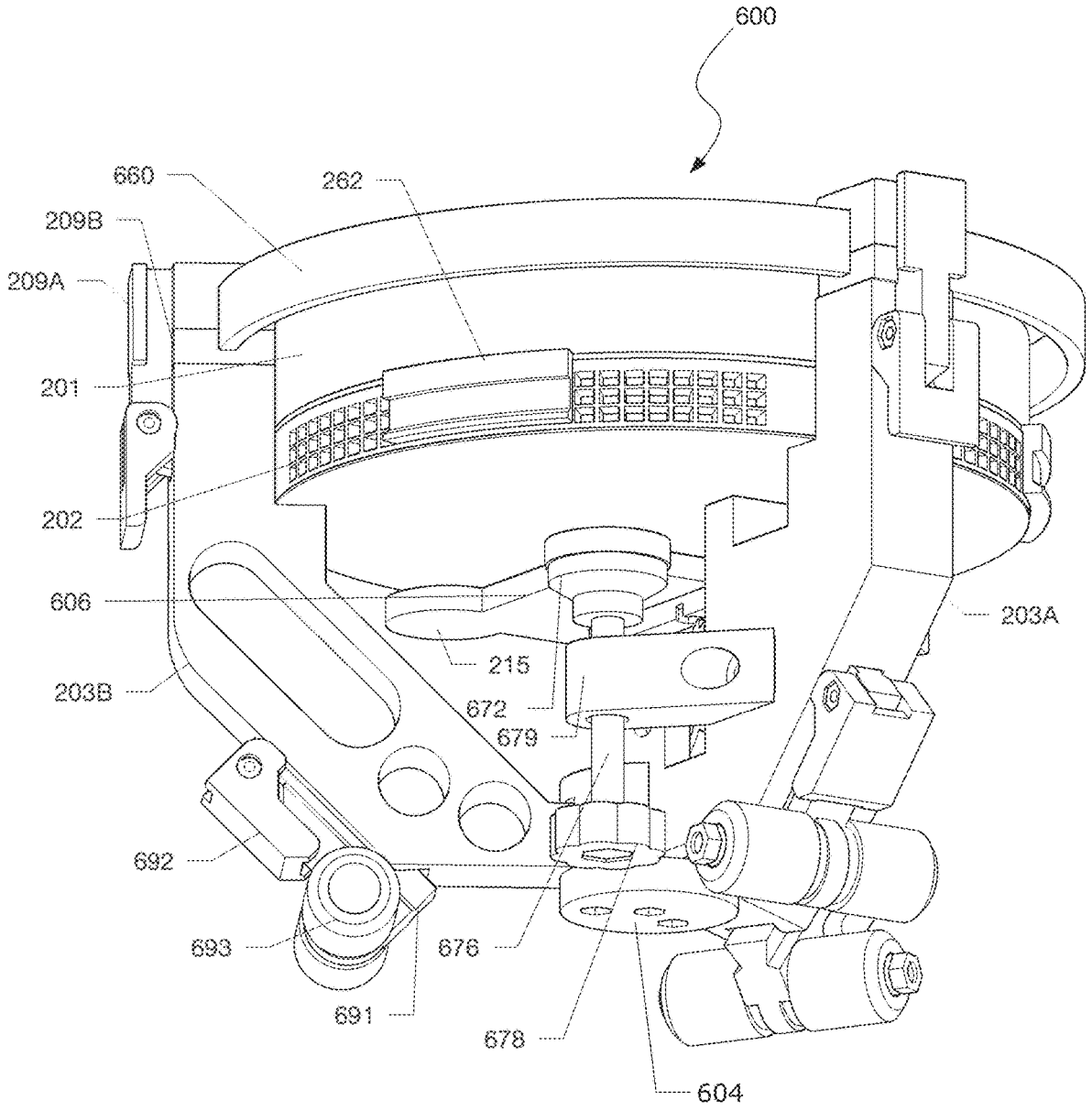

FIGS. 6A and 6B show, respectively, top and bottom portion perspective views of the snare drum 600. The snare drum 600 includes the low volume drum head 201 and the pellet chamber 202, for instance as described previously. When struck, the snare drum 600 outputs a relatively low volume sound, due to, for example, the presence of the low volume drum head 201, as pellets bounce within the pellet chamber 202, as described previously. The low volume drum head 201 can be positioned at a top of the pellet chamber 202, and the low volume drum head 201 can be held in place by one or more head latches 611. In some examples, the low volume drum head 201 can have a smaller size than the head of a traditional snare drum. For example, the low volume drum head 201 can have a diameter of less than twelve inches, such as between eight and twelve inches (e.g., between eight and ten inches, such as nine inches). This relatively smaller sized low volume drum head 201 can be useful in reducing the footprint of the snare drum 600 thereby making the snare drum 600 easier to transport, easier to use with a resonator, and more cost effective to manufacture.

The pellet chamber 202 can include one or more chamber sections or components, and the pellet chamber 202 can be supported at the chamber floor plate 205. Walls 250 of the pellet chamber 202 can define one or more apertures 251 configured to permit sound output from the pellet chamber 202. Namely, the one or more apertures 251 defined in the walls 250 of the pellet chamber 202 can allow sound to radiate out from the inside of the pellet chamber 202 when the low volume snare drum 200 is struck.

As shown in the illustrated embodiment, the snare drum 600 can include a base 604. The base 604 can be configured to support one or more structures of the snare drum 600. For example, the base 604 can receive and support one or more (e.g., each) of the drum leg structures 203A, 203B. The base 204 can also support a throw off mechanism 605 and associated magnetic choke 606 positioned beneath the chamber floor plate 205. As will be described further, the magnetic choke 606 can be moved, relative to the chamber floor plate 205, by the throw off mechanism 605. The magnetic choke 606 can include one or more magnets 208, and the one or more magnets 208 can be configured to alter movement of the pellets 212 inside the pellet chamber 202 by imparting a magnetic force between the one or more magnets 208 and the pellets 212 within the pellet chamber 202 and such that changing the extent of this magnetic force (e.g., by moving the one or more magnets 208 closer to or further from the pellet chamber 202 via the throw off mechanism 605) changes the degree of movement of the pellets 212 within the pellet chamber 202. For example, the closer the one or more magnets 208 are to the pellet chamber 202, the greater the magnetic force between the one or more magnets 208 and the pellets 212 within the pellet chamber 202 and, thus, the lesser degree of movement the pellets 212 have within the pellet chamber 202. As a result, the snare-like sound produced by the low volume snare drum 600 can have a modified, tighter intensity and shorter duration. Similarly, the further the one or more magnets 208 are from the pellet chamber 202, the lesser the magnetic force between the one or more magnets 208 and the pellets 212 within the pellet chamber 202 and, thus, the greater degree of movement the pellets 212 have within the pellet chamber 202. As a result, the snare-like sound produced by the low volume snare drum 600 can have a modified, looser intensity and longer duration.

As noted, the head latches 611 can be positioned at, or near, the top of one or more legs 203A, 203B. In the illustrated embodiment, head latches 611 are included at a top portion of each of the three total legs 203A, 203B. The head latches 611 and associated snare drum leg 203A, 203B can be configured so that the head latch 611 can rotate (e.g., pivot) relative to the respective snare drum leg 203A, 203B. The head latch 611 can rotate, relative to the respective snare drum leg 203A, 203B, between rotatably spaced apart locked and unlocked positions, as will be illustrated and described further. When the head latches 611 are in the unlocked position, the low volume snare drum head 201 can be lifted off the pellet chamber 202 so as to allow for convenient access to the pellet chamber 202, for instance to inspect and/or change pellets 212. Changing the type of pellet and/or quantity of pellets 212 can alter the sound of the snare effect output from the low volume snare drum 600. As such, the head latches 611 can help to allow for customization of the sound output by the low volume snare drum 600.

The magnetic choke 606, as shown here, can be a flat, generally X-cross-sectional shape, with one or more of the legs of the X shape having one or more recesses to receive a magnet 208. In the illustrated embodiment, one magnet 208 is included at each of the four legs of the X shape for a total of four magnets 208. The magnets 208 in the magnetic choke 606 can, for instance, lay parallel to the chamber floor plate 205. In the illustrated embodiment, each magnet 208 can be placed at a magnet plug 215, and the magnet plug 215 can be configured to receive and hold the magnet 208 thereat. In some examples, each magnet 208 can be configured to be secured (e.g., removably secured) at a respective magnet plug 215, and each magnet plug 215 can be configured to be secured (e.g., removably secured) at a respective recess on the magnetic choke 606. Accordingly, in those embodiments where the magnets 208 are removably secured, this configuration can allow for customization of the low volume snare drum 600 by allowing for different magnets 208 to be interchanged. As previously noted, the magnetic choke 606 can be moved (e.g., up or down) relative to the chamber floor plate 205, raising or lowering its proximity to the chamber floor plate 205 and, as a result, bringing the one or more magnets 208 closer to or further from the pellet chamber 202 and thus pellets 212 therein. As described above, when the magnetic choke 606 is moved closer to the chamber floor plate 205, the movement of the pellets 212 inside the pellet chamber 202 can be increasingly restrained, and when the magnetic choke 606 is moved further from the chamber floor plate 205, the pellets 212 can move more freely. This can allow the drummer to adjust the duration and intensity of the snare buzz (rattle) produced by the low volume snare drum 600.

Figure 6C:
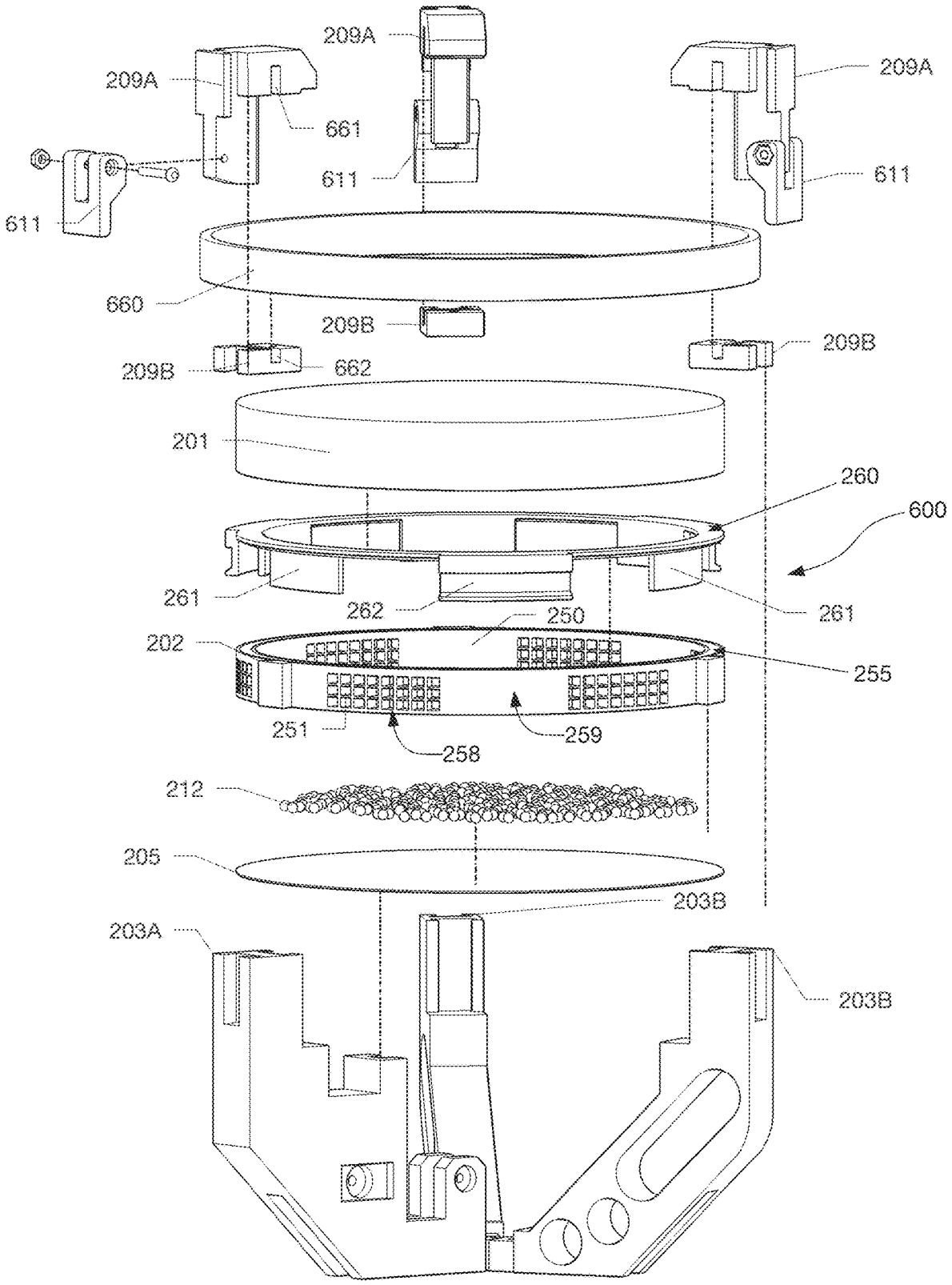

FIG. 6C shows an exploded view of the snare drum 600. In the illustration at FIG. 6C, the throw off mechanism 605 and associated magnetic choke 606 of the snare drum 600 are not shown and instead can be seen in the illustration at subsequent figures.

In the illustrated embodiment of the snare drum 600, the pellet chamber 202 includes a wall structure component 255, a selective sound control component 260, and the chamber floor plate 205. In additional embodiments, the pellet chamber 202 of the snare drum 600 can additionally include a chamber ceiling plate positioned between the selective sound control component 260 and the low volume drum head 201, and, in such embodiments, the ability to include such a chamber ceiling plate can allow for further acoustical customization as desired. The wall structure component 255 can include the walls 250 and the apertures 251 defined in the walls 250. In the illustrated embodiment, the wall structure component has multiple (e.g., six) spaced apart aperture regions 258 where the apertures 251 are defined in the walls 250. In between the aperture regions 258 are wall regions 259 where no apertures 251 are present. Thus, the aperture regions 258 are spaced apart from one another by the wall regions 259. In fact, in the specific example illustrated, the aperture regions 258 and the wall regions 259 alternate around a perimeter of the pellet chamber 202. The selective sound control component 260 can include one or more blocking baffles 261 and one or more actuation members 262. The selective sound control component 260 can be movably secured to the wall structure component 255 such that the selective sound control component 260 can move relative to the wall structure component 255. Namely, the selective sound control component 260 can be moved relative to the wall structure component 255 to selectively open or close some or all of the apertures 251. For example, the selective sound control component 260 can be moved relative to the wall structure component 255 to align one or more of the blocking baffles 261 at at least a portion of one or more of the aperture regions 258 to thereby impede the output of sound from the pellet chamber 202. Similarly, the selective sound control component 260 can be moved relative to the wall structure component 255 to align one or more of the blocking baffles 261 at at least a portion of one or more of the wall regions 259 to thereby permit the output of sound from the pellet chamber 202. In the illustrated embodiment, the one or more actuation members 262 can be positioned at an outer perimeter of the wall structure component 255, and the one or more blocking baffles can be positioned at an inner perimeter of the wall structure component 255. The one or more actuation members 262 can be used by a user (e.g., by pushing or pulling the actuation member 262) to move the blocking baffles 261 relative to the apertures 251 to thereby control sound output from the pellet chamber 202.

Also in the illustrated embodiment, the snare drum 600 includes a rim 660. The rim 600 can be made, at least in part, of a metallic material (e.g., aluminum) suitable for desired sound output upon being struck by a drum stick. As shown in the illustrated embodiment, the rim 660 can be secured in place at the snare drum 600, and spaced apart from the low volume drum head 201, by securement arms 209A and securement bases 209B. The head latches 611 can be rotatably (e.g., pivotally) connected to the securement arms 209A. Each of the securement arms 209A includes a rim receptacle 661, and each of the securement bases 209B includes a rim receptacle 662. A corresponding securement arm 209A can be aligned with a corresponding securement base 209B such that the respective rim receptacles 661, 662 are aligned with one another. And, the rim 660 can be received at the rim receptacle 661 of each of the securement arms 209A and at the rim receptacle 662 of each of the securement bases 209B to thereby secure the rim 660 in place at the snare drum 600. In the illustrated embodiment, the securement arms 209A and the securement bases 209B are configured to secure the rim 660 in place at the snare drum 600 such that the rim 660 lies in a plane that extends parallel to a plane in which the low volume drum head 201 lies.

Figure 6D:
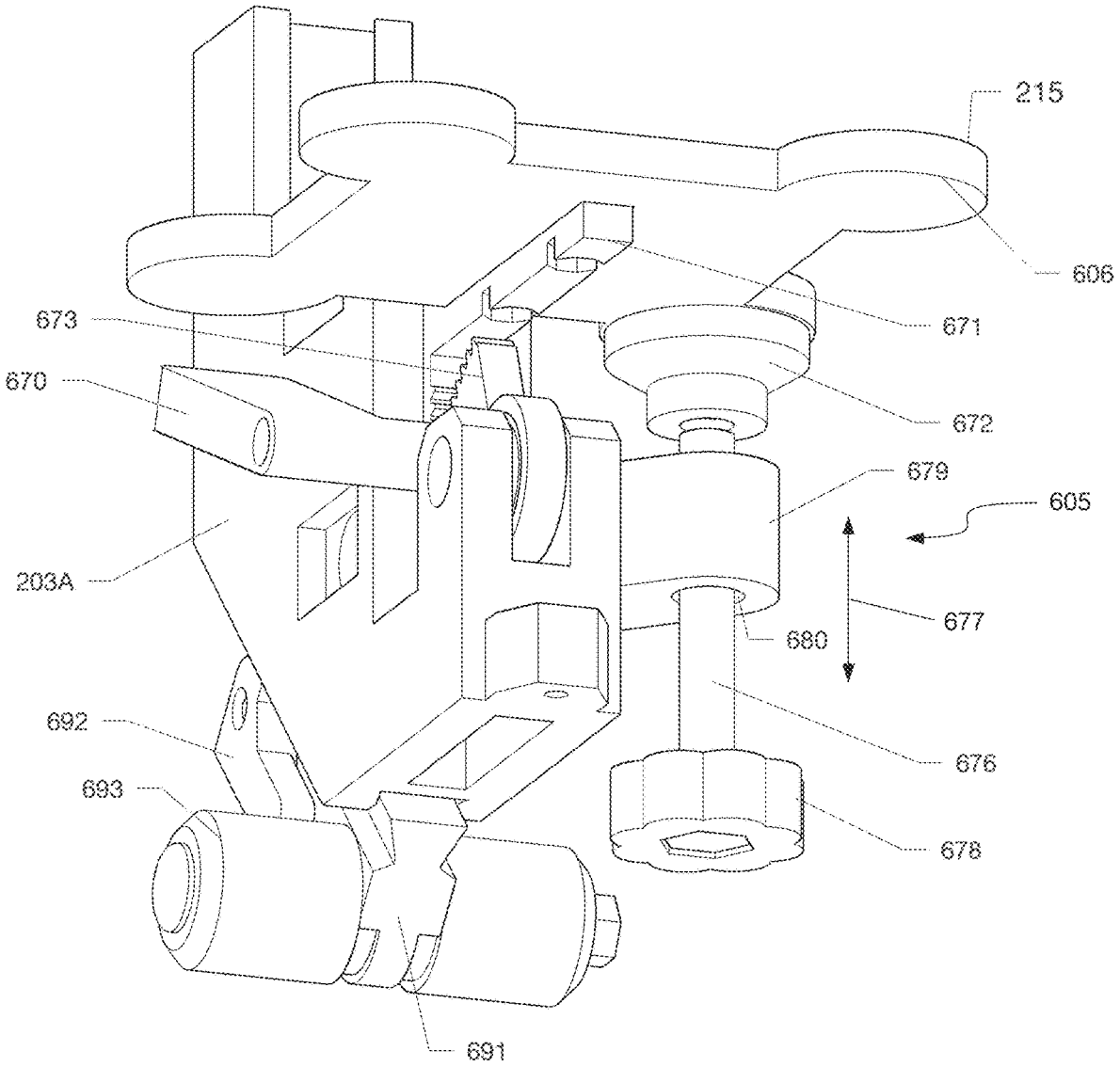
Figure 6E:
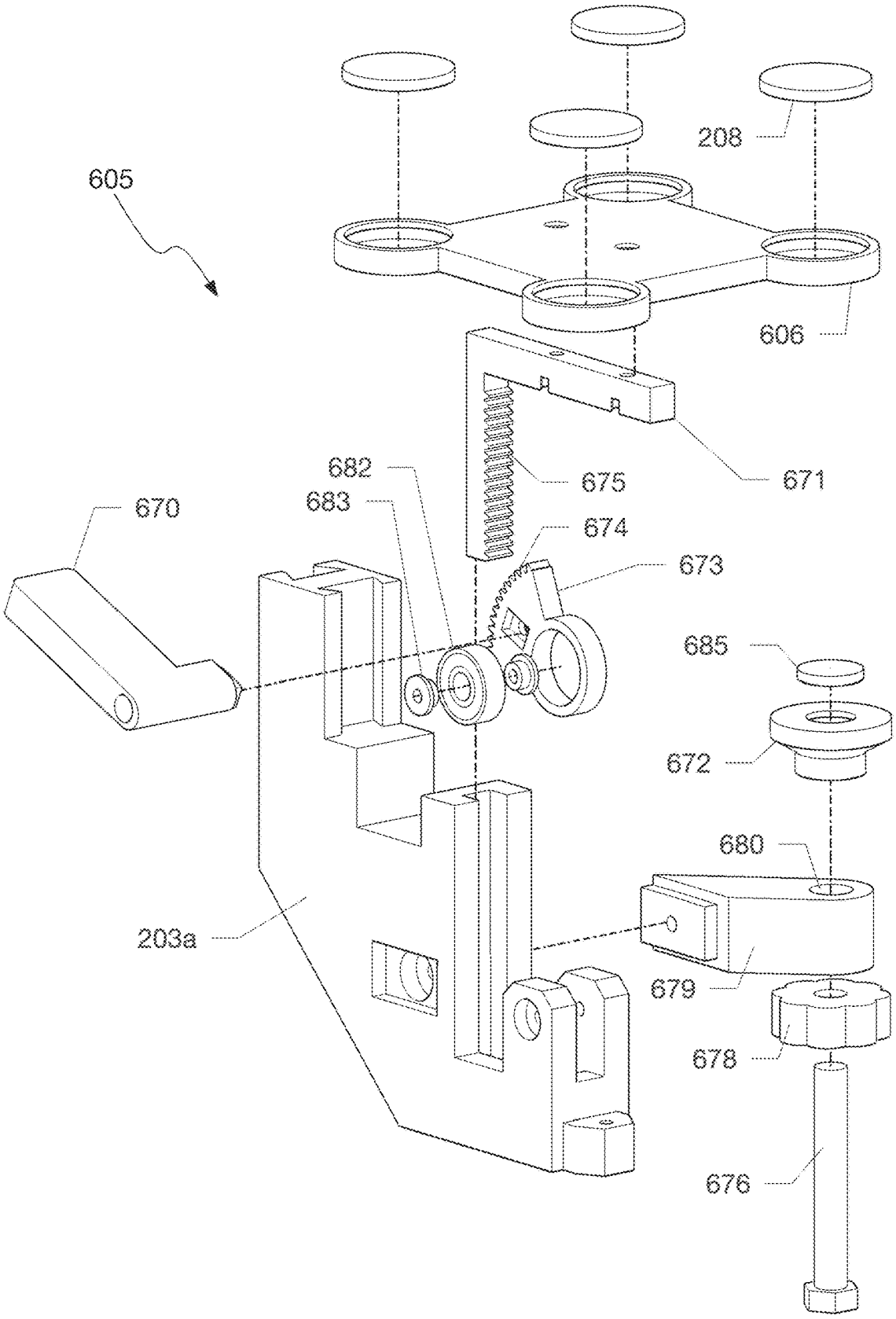
Figure 6F:
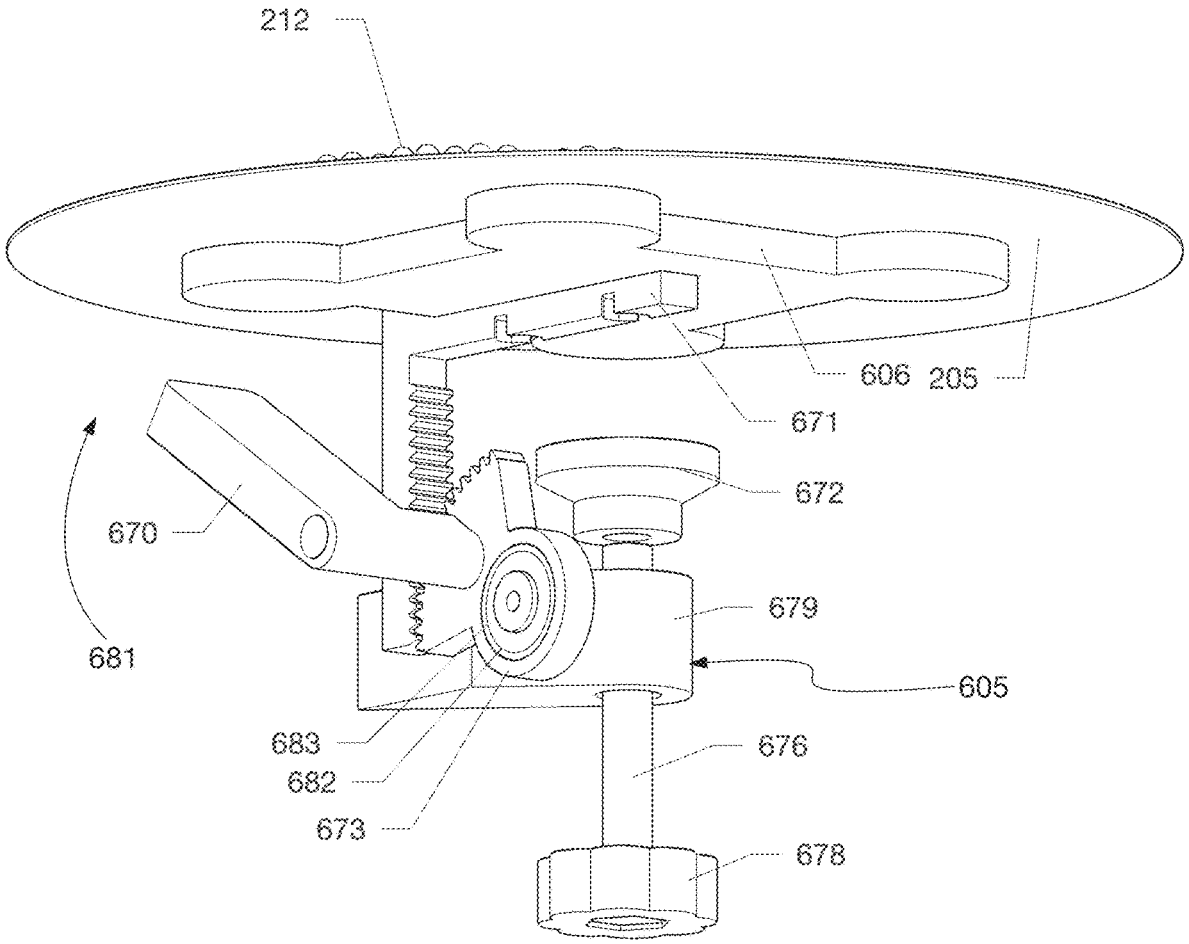
Figure 6G:
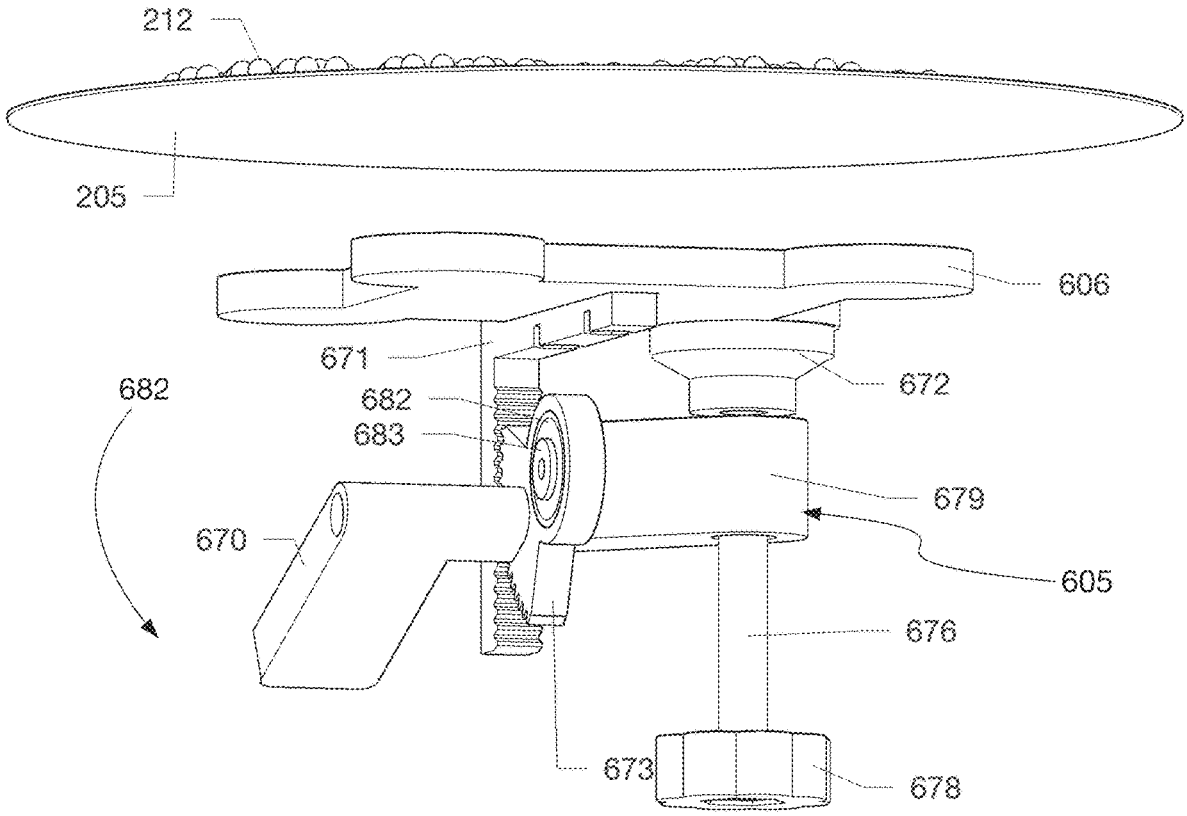

FIGS. 6D-6G illustrate the throw off mechanism 605. More specifically, FIG. 6D shows a perspective view of the throw off mechanism 605 and associated magnetic choke 606 of the snare drum 600, FIG. 6E shows an exploded view of the throw off mechanism 605 and associated magnetic choke 606, FIG. 6F shows a perspective view of the throw off mechanism 605 in one exemplary off position, and FIG. 6G shows a perspective view of the throw off mechanism 605 in one exemplary on position.

As noted, the magnetic choke 606 can be moved, relative to the chamber floor plate 205, by the throw off mechanism 605. The throw off mechanism 605 can include a throw off lever 670, a throw off actuation arm 671, and a throw off support member 672. The throw off lever 670 can be connected to the throw off actuation arm 671 via a throw off gear 673. In particular, the throw off gear 673 can include a first set of teeth 674 that mesh with a second set of teeth 675 on the throw off actuation arm 671. The throw off actuation arm 671 can be configured to transfer a motive force from the throw off lever 670 to the magnetic choke 606. For example, in the illustrated embodiment, the throw off actuation arm 671 is in contact with the magnetic choke 606 such that the throw off actuation arm 671 can act to move the magnetic choke 606 toward and away from the pellet chamber 202 (e.g., toward and away from the chamber floor plate 205) as the throw off lever 670 is moved. The throw off support member 672 can be configured to serve as a stop support for the magnetic choke 606 such that the magnetic choke 606 comes to rest at the throw off support member 672 and may not move further away from the pellet chamber 202 than the location at which the throw off support member 672 is located.

The throw off support member 672 can be movable independent of the throw off lever 670 (and the throw off support member 672 can also movable independent of the throw off gear 672 and throw off actuation arm 671). The throw off support member 672 can be supported at an adjustment shaft 676 which can be movable in a direction 677 such that as the adjustment shaft 676 moved in the direction 677 so too does the throw off support member 672. For example, an adjustment shaft actuator 678 can be included as part of the throw off mechanism 605 to cause the adjustment shaft 676 to selectively move in the direction 677. In one such embodiment, the adjustment shaft actuator 678 can be a knob that is rotated by a user to cause the adjustment shaft 676 to move in the direction 677 such that turning the adjustment shaft actuator 678 in one direction about a longitudinal axis of the adjustment shaft 676 causes the adjustment shaft 676, and thus the throw off support member 672, to move toward the pellet chamber 202 and turning the adjustment shaft actuator 678 in another, opposite direction about the longitudinal axis of the adjustment shaft 676 causes the adjustment shaft 676, and thus the throw off support member 672, to move away from pellet chamber 202. To provide further support to the adjustment shaft 676, a leg support 679 can be included to help provide additional stability to the adjustment shaft 676. The leg support 679 can include a holding aperture 680 through which the adjustment shaft 676 can extend and move relative to. The positioning of the throw off support member 672 can thus be adjusted to define a further stopping point for the magnetic choke 606 from the pellet chamber 202.

The throw off lever 670 can be actuated and, as a result, cause the magnetic choke 606 to move relative to the pellet chamber 202. For example, FIG. 6F shows the throw off mechanism 605 in one exemplary off position. To bring the throw off mechanism 605 to the exemplary off position, the throw off lever 670 can be moved in the direction 681. As the throw off lever 670 is moved (e.g., pivoted) in a direction 681, the throw off gear 673 can be caused to rotate, also in the direction 681, about a throw off gear bearing 682 coupled to a bushing 683, and thereby the first set of teeth 674 continue to mesh with additional teeth of the second set of teeth 675 (e.g., in a direction toward a bottom portion of the throw off actuation arm 671 and away from the pellet chamber 202). This rotation of the throw off lever 670 in the direction 681 can cause the throw off actuation arm 671 to move toward the pellet chamber 202 and, as a result, also move the magnetic choke 606 toward the pellet chamber 202 to an off position of the throw off mechanism 605. When the throw off mechanism 605 is in an off position, the magnetic choke 606 can be adjacent the pellet chamber 202, and thus adjacent (e.g., in contact with) the chamber floor plate 205. In the throw off mechanism off position, the magnets 208 at the magnetic choke 606 can impart a magnetic force on the pellets 212 in the pellet chamber 202 to cause the pellets 212 to resist movement within the pellet chamber 202 due to the imparted magnetic force. As a result, the throw off mechanism off position can eliminate, or reduce, movement of the pellets 212 within the pellet chamber 202 and, thereby, eliminate, of reduce, the "snare" sound that would otherwise be output from the pellet chamber 212 when the low volume drum head 201 is struck.

As shown in FIG. 6G, the throw off mechanism 605 is in one exemplary on position. To bring the throw off mechanism 605 to the exemplary on position, the throw off lever 670 can be moved in a direction 682. As the throw off lever 670 is moved (e.g., pivoted) in the direction 682, the throw off gear 673 can be caused to rotate, also in the direction 682, about the throw off gear bearing 682 coupled to the bushing 683, and thereby the first set of teeth 674 continue to mesh with additional teeth of the second set of teeth 675 (e.g., in a direction away from the bottom portion of the throw off actuation arm 671 and toward the pellet chamber 202). This rotation of the throw off lever 670 in the direction 682 can cause the throw off actuation arm 671 to move away from the pellet chamber 202 and, as a result, also move the magnetic choke 606 away from the pellet chamber 202 to an on position of the throw off mechanism 605. When the throw off mechanism 605 is in an on position, the magnetic choke 606 can rest at the throw off support member 672 and be spaced apart from the pellet chamber, and thus spaced apart from the chamber floor plate 205. In the throw off mechanism on position, the magnets 208 at the magnetic choke 606 can be spaced far enough from the pellets 212 in the pellet chamber 202 such that any magnetic force imparted on the pellets 212 is insufficient to substantially resist movement of the pellets 212 in the pellet chamber 202. As a result, the throw off mechanism on position can position the magnetic choke 606 further from the pellet chamber 202, than in the throw off mechanism off position, such that the pellets 212 within the pellet chamber 202 can move more freely, than in the throw off mechanism off position, and create the "snare" sound output from the pellet chamber 202 when the low volume drum head 201 is struck. As one example, the throw off mechanism on position can position the magnetic choke 606 relative to the pellet chamber 202 such that some magnetic force from the one or more magnets 208 is imparted on the pellets 212 are free to bounce within the pellet chamber 202 when the low volume drum head 201 is struck yet prevented from freely rolling around, due to the imparted magnetic force, when the snare drum 600 is not being played.

In some embodiments, such as that illustrated, the throw off support member 672 can include a throw off magnet 685. The throw off magnet 685 can be positioned at the throw off support member 672 such that the throw off magnet 685 has its polarity directed in the same orientation as the magnets 208 at the magnetic choke 606. In this way, the throw off magnet 685 can act to attract the magnetic choke 606 via the magnetic attraction force between the throw off magnet 685 and the magnets 208 at the magnetic choke 606. Accordingly, the throw off magnet 685 may be useful in retaining the magnetic choke 606 at the throw off support member 672 and thus in retaining the throw off mechanism 605 is in an on position. As one example, the magnets 208 and the throw off magnet 685 can be neodymium magnets, though in other examples other types of magnets can be suitable for use.

Figure 6H:
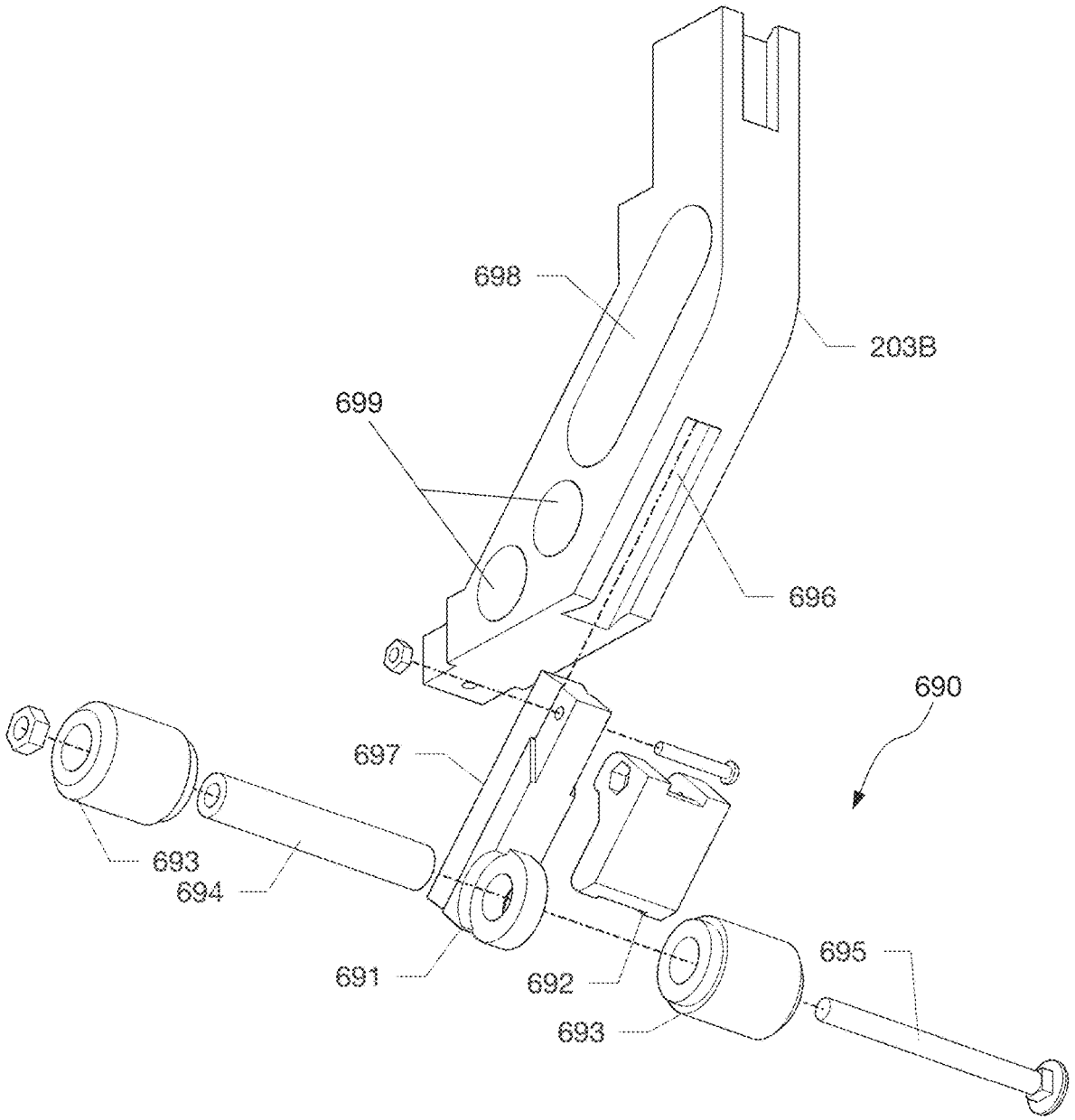

As shown in the illustrated embodiment, the snare drum 600 can include three leg structures 203A, 203B, this forming a tripod leg support for the snare drum 600. The tripod leg support can be useful in suitably balancing the snare drum 600 for use and can allow for the inclusion of one or more leg adjustment features to permit support adjustment for the snare drum 600 at various (e.g., nonuniform) surface elevations. FIG. 6H shows an exploded view of an adjustable leg structure 690 of the snare drum 600. In some examples, each of the three leg structures 203A, 203B can include the adjustable leg structure 690.

The adjustable leg structure 690 includes a movable foot 691, a foot locking mechanism 692, and one or more (e.g., two) surface foot supports 693. A pin shaft 694 can extend through the movable foot 691 and surface foot supports 693, and the pin shaft 694 can receive thereat a pin 695 to couple the surface foot supports 693 to the movable foot 691. The movable foot 691 can include a leg fitting 697 that is received at a foot receptacle 696 defined at the leg 203B. The leg fitting 697 can move relative to the foot receptacle 696 such that the movable foot 691 can move relative to the leg 203B and thereby cause the surface foot supports 693 to move out from, and inward toward, the leg 203B. The foot locking mechanism 692 can be actuated (e.g., pivoted) to both lock the movable foot 691 in place relative to the leg 203B and unlock the movable foot 691 so that the movable foot 691 can move relative to the leg 203B. As noted, multiple (e.g., each) of the legs, 203A, 203B can include the adjustable leg structure 690 which can allow the snare drum 600 to be suitably adjusted to provide a stable playing surface despite the underlying support surface at which the snare drum is rested.

As noted, the illustrated embodiment of the snare drum 600 includes three legs 203A, 203B. These three legs include one leg 203A associated with the throw off mechanism 605 and two legs 203B. In some examples, such as that shown here, one or both of the legs 203B can include a carrying handle 698. The carrying handle 698 can be a slot defined at the leg 203B and configured to receive a hand of a user therein to hold and carry the snare drum 600. Also in some examples, such as that shown here, one or both of the legs 203B can include one or more weight receptacles 699. The one or more weight receptacles 699 can be slots defined at the leg 203B and configured to receive one or more weight elements to thereby add additional mass to the snare drum 600. Such additional mass can be useful for stabilizing the snare drum 600 in place. Also, such additional mass from adding one or more weight elements at corresponding one or more weight receptacles 699 can be useful in altering the sound output by the snare drum 600 since this added mass can allow more efficient conversion of strike force via a drum stick into acoustic waves emanating from the snare drum 600. Moreover, the weight receptacles 699 can allow for selective and convenient use of weight elements at the snare drum such that the sound output from the snare drum 600 can be more customized without adding complexities to transport or assembly of the snare drum 600.

Figure 6I:
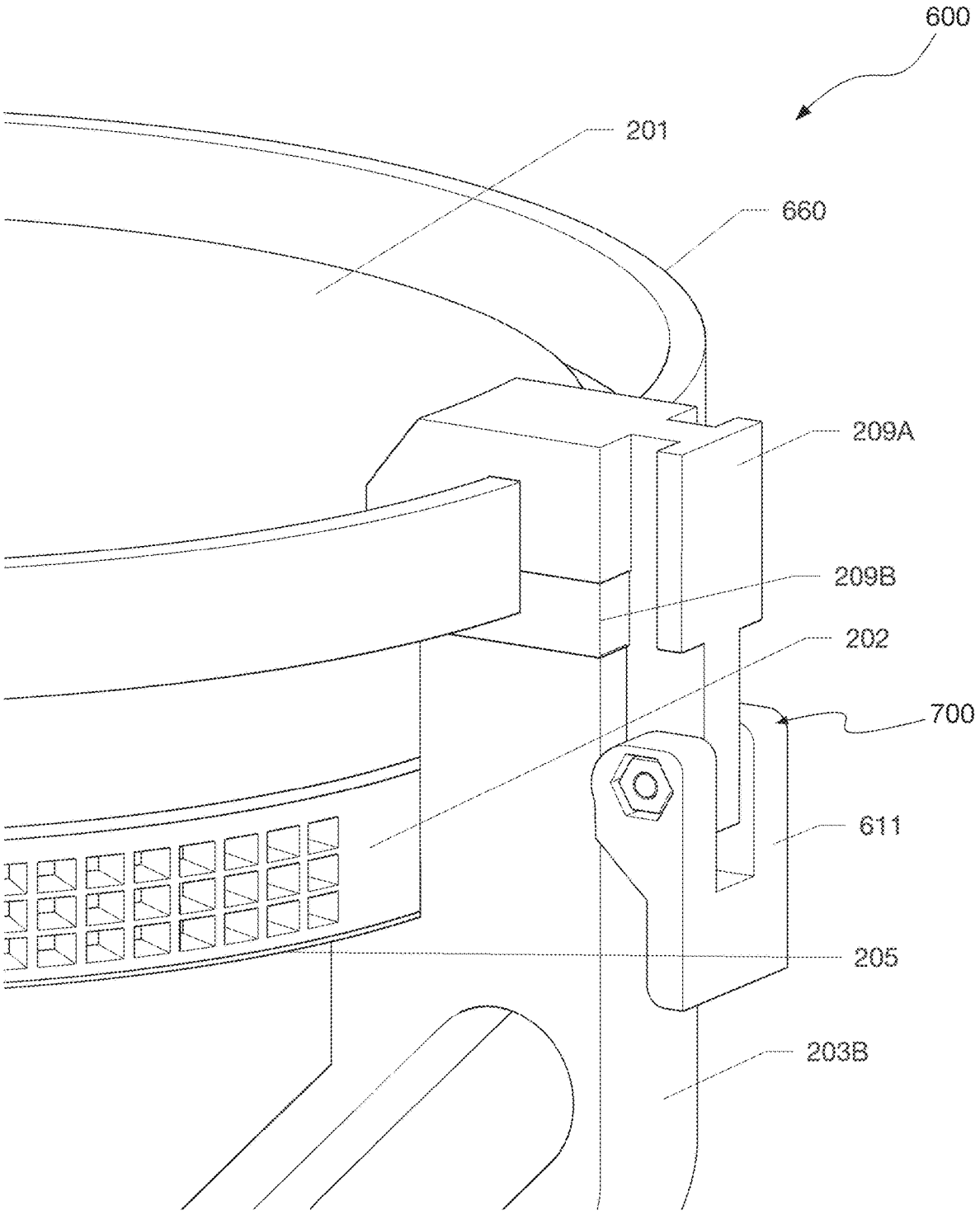
Figure 6J:
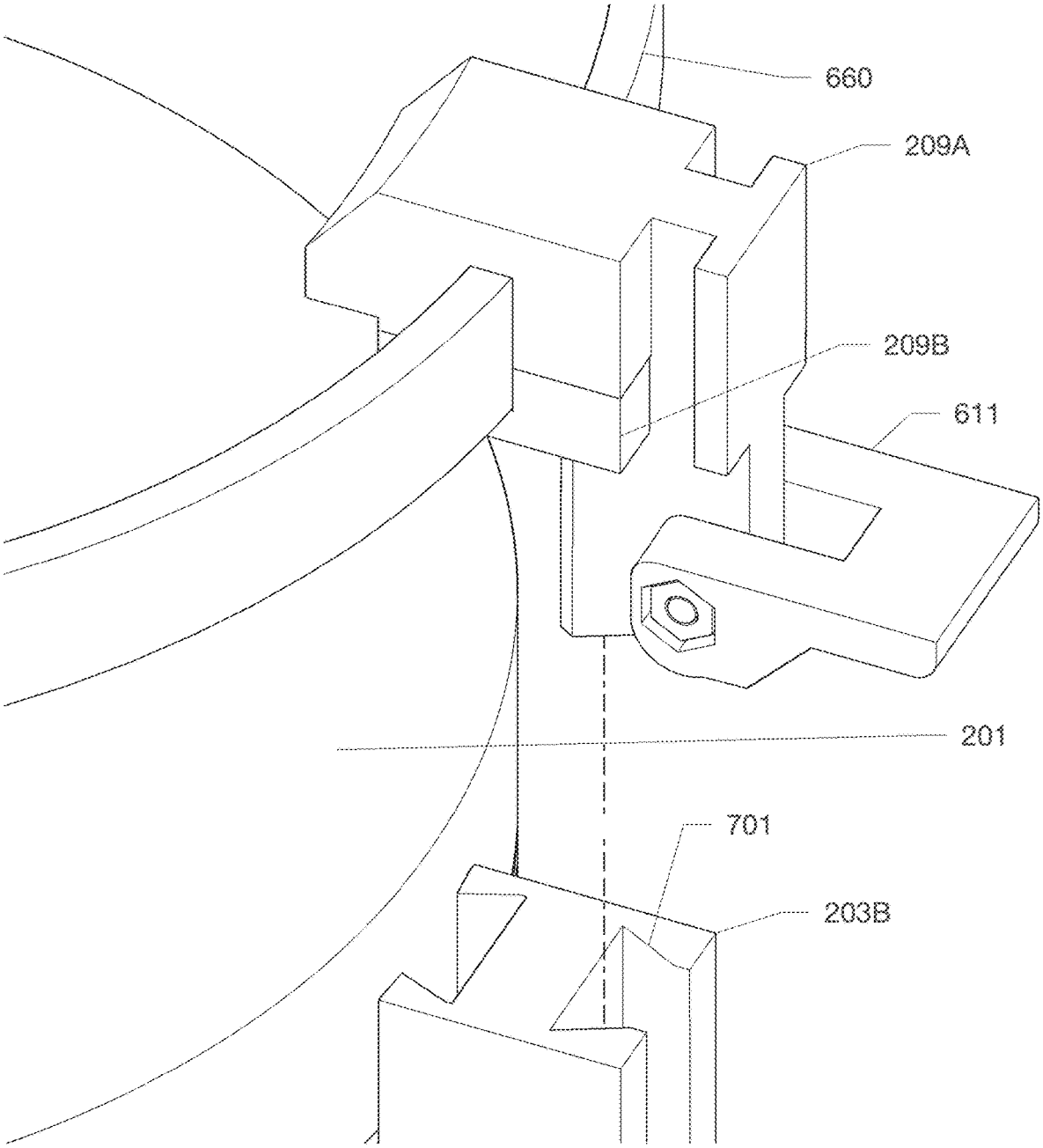

FIGS. 6I and 6J show a securement structure 700 for removably retaining the rim 660 at the snare drum 600. FIG. 6I is a perspective view of the securement structure 700 in a locked position at the leg 203B of the snare drum 600. And, FIG. 6J is a perspective view of the securement structure 700 in an unlocked position where the rim 660 can be removed from the snare drum 600. When the securement structure 700 is in the unlocked position, the low volume drum head 201 can also be removed from the snare drum 600.

The securement structure 700 can include the securement arm 209A, the securement base 209B, and a securement arm connector 701. In the illustrated embodiment, the securement arm 209A can include the head latch 611. As shown in FIG. 6I, the head latch 611 is in a locked position, which can act to secure the rim 660 at the snare drum 600. For example, when the head latch 611 is in the locked position, the head latch 611 can be configured to lock the securement arm 209A at the leg 203B to secure the rim 660 at the snare drum 600.

As shown in FIG. 6J, the head latch 611 can be actuated to an unlocked position. For example, the head latch 611 can be actuated to the unlocked position by rotating (e.g., pivoting) the head latch 611 relative to the securement arm 209A. When the head latch 611 is in the unlocked position, the rim 660 can be removed from the snare drum 600.

As seen best in FIG. 6J, the leg 203B includes the securement arm connector 701. The securement arm connector 701 can form a connector complementary to a corresponding connector at the securement arm 209A such that the securement arm connector 701 is configured to couple to the securement arm 209A. In the illustrated example, the securement arm 209A is configured to slide into a slot defined at the securement arm connector 701, and the head latch 611 is located so as to interface with the securement arm connector 701 when the securement arm 209A is at the slot defined at the securement arm connector 701. This coupling of the securement arm 209A at the securement arm connector 701, along with the head latch 611 actuated to the locked position, can be configured to retain the rim 660 at the snare drum 600.

Figure 6K:
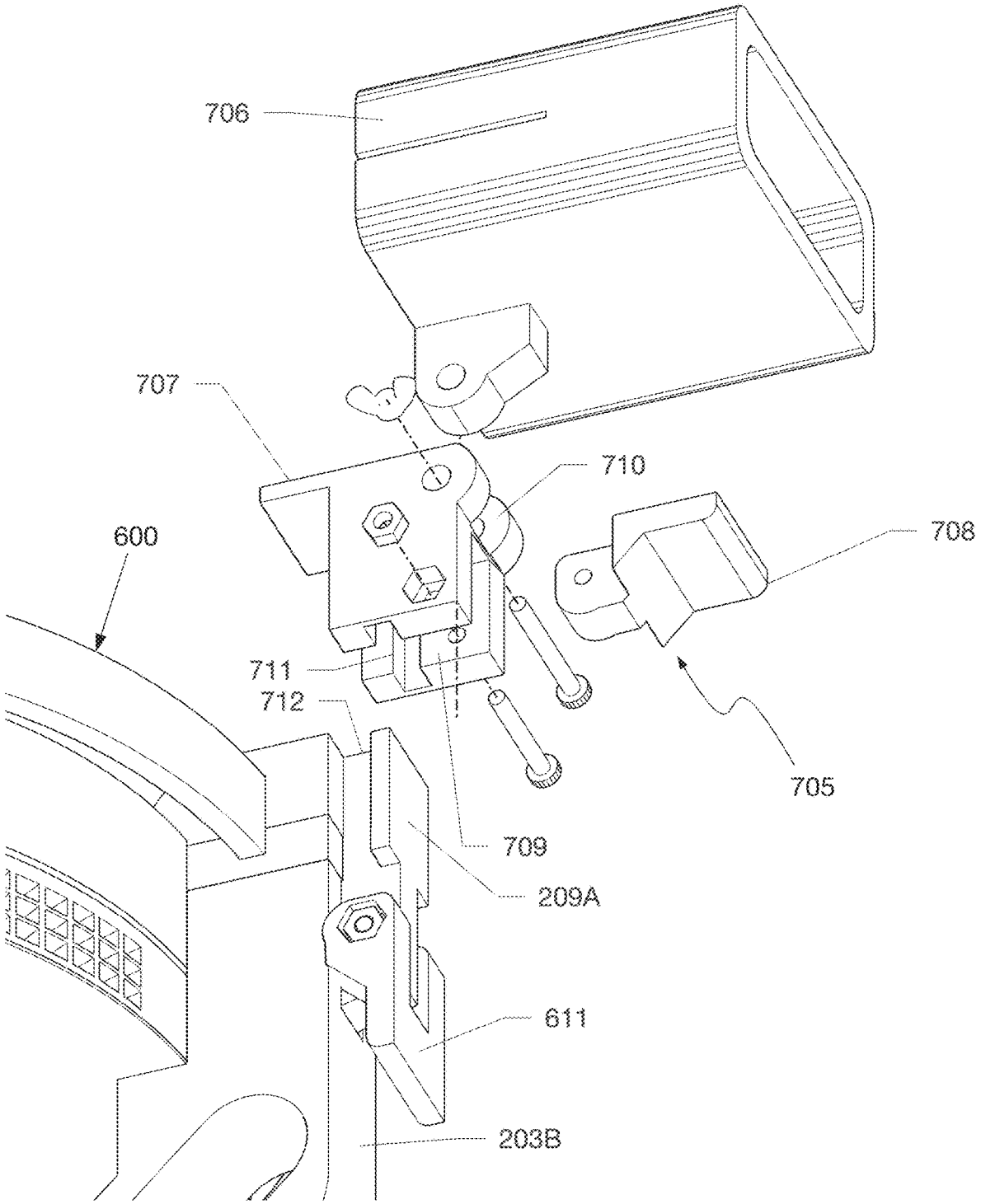
Figure 6L:
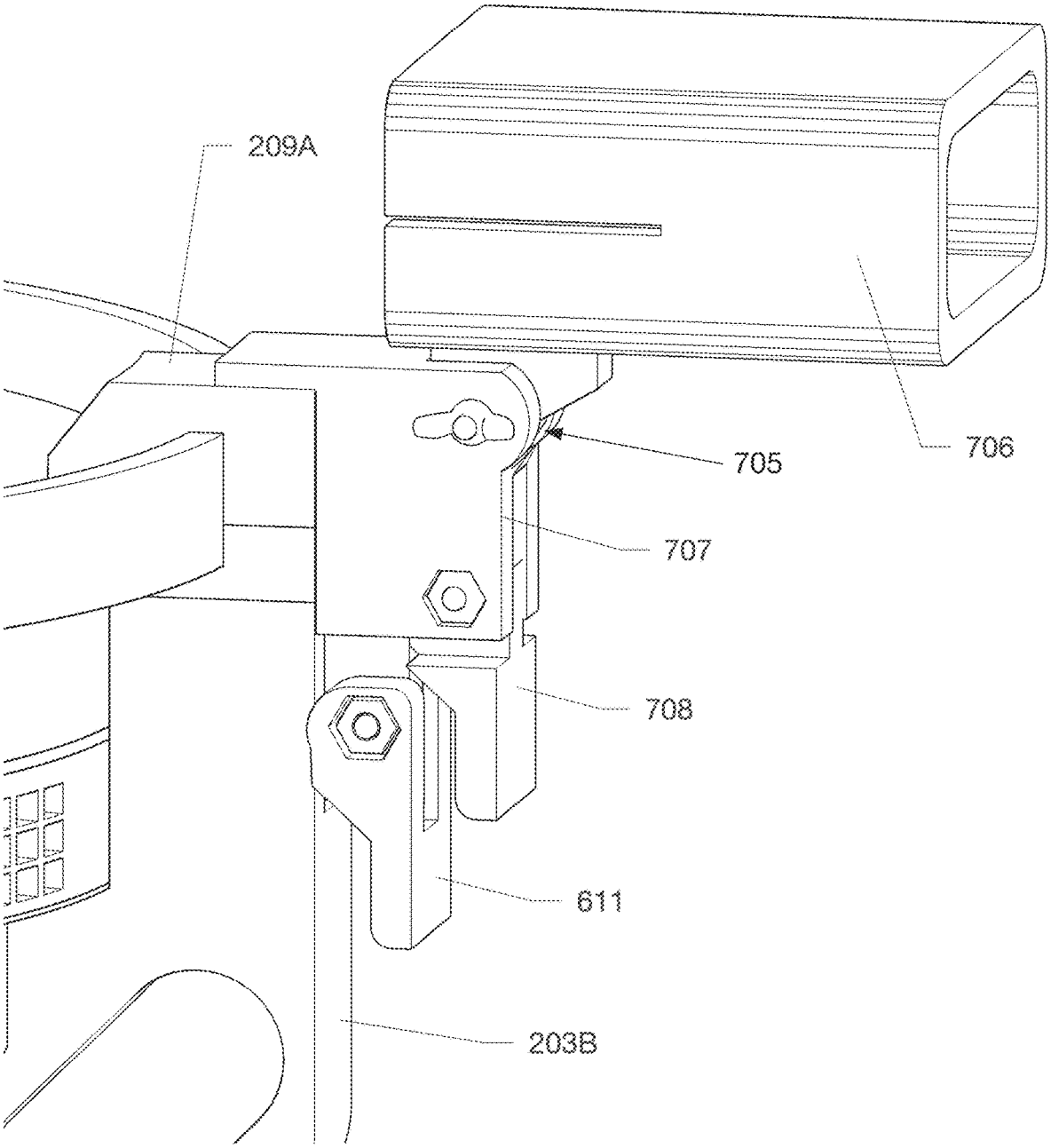

FIGS. 6K and 6L show an accessory holding mechanism 705 and an accessory 706 to be secured, via the accessory holding mechanism 705, at the snare drum 600. Specifically, FIG. 6K is an exploded view the accessory holding mechanism 705 of the snare drum 600, and FIG. 6L is a perspective view of the accessory holding mechanism 705 secured at the snare drum 600. In the illustrated embodiment, the accessory 706 is shown as a woodblock. Though, in other examples, the accessory 706 can be any variety of various types of percussion or other musical instruments, including a bell, clave, pipe, etc.

The accessory holding mechanism 705 can include an arm bracket 707 and an accessory holding lever 708. The arm bracket 707 is configured to be secured at the securement arm 209A, for example at an end portion of the securement arm 209A opposite the head latch 611. As shown in FIG. 6K, one or more retention pins can be used to secure the arm bracket 707 at the securement arm 209A. The accessory holding lever 708 can be rotatably coupled to the arm bracket 707 such that the accessory holding lever 708 can rotate (e.g., pivot) relative to the arm bracket 707. The accessory 706 can also be coupled to the arm bracket 707. Thus, the arm bracket 707 can include both a holding lever connector portion 709 and an accessory connector portion 710, where the holding lever connector portion 709 is configured to secure to the accessory holding lever 708 and the accessory connector portion 710 is configured to secure to the accessory 706. As seen in FIG. 6K, the arm bracket 707 can also include an arm connector portion 711 that is configured to secure to the securement arm 209A. In some examples, such as that illustrated here, each of the holding lever connector portion 709, accessory connector portion 710, and arm connector portion 711 can be spaced apart and define three separate connector portions.

The arm bracket 707 can be coupled to the securement arm 209A by securing the arm connector portion 711 at an arm bracket connector portion 712. With the arm bracket 707 placed at the securement arm 209A and the accessory holding lever 708 secured at the arm bracket 707, the accessory holding lever 708 can be actuated to a locked position, such as that shown in FIG. 6L. When in the locked position, the accessory holding lever 708 can be configured to lock the arm bracket 707 in place at the securement arm 209A. With the holding lever 708 in the locked position, the accessory 706 can be secured at the accessory holding mechanism 705. In particular, in the illustrated embodiment, the accessory connector portion 710 can be configured to couple to the accessory 706 so as to retain the accessory 706 at the accessory holding mechanism 705, and thus at the snare drum 600. In this way, the accessory holding mechanism 705 can be useful in providing a quick and easy way to provide an accessory musical instrument at the snare drum 600, and the accessory holding mechanism 705 can allow the particular accessory musical instrument to be easily interchanged with other accessory musical instruments at the snare drum 600.

Various non-limiting exemplary embodiments have been described. It will be appreciated that suitable alternatives are possible without departing from the scope of the examples described herein.

What is claimed is:

1. A drum comprising:

a low volume drum head;

a pellet chamber located beneath the low volume drum head, the pellet chamber configured to hold a plurality of pellets, and the pellet chamber defining a plurality of apertures in a wall of the pellet chamber; and a magnetic choke carrying at least one magnet, the magnetic choke configured to move relative to the pellet chamber so as to adjust a magnetic force imparted on the pellet chamber.

2. The drum of claim 1, wherein the low volume drum head includes a closed cell polymer material that has a density of one to five pounds per cubic foot.

3. The drum of claim 2, wherein the low volume drum head has a thickness of 1 to 3 inches.

4. The drum of claim 1, wherein the pellet chamber includes a wall structure component and a selective sound control component positioned adjacent to the wall structure component, wherein the wall structure component includes the wall and the plurality of apertures defined in the wall, and wherein the selective sound control component includes at least one blocking baffle.

5. The drum of claim 4, wherein the at least one blocking baffle is configured to move relative to the plurality of apertures so as to close the plurality of apertures when the at least one blocking baffle is moved into alignment with the plurality of apertures and open the plurality of apertures when the at least one blocking baffle is moved away from the plurality of apertures.

6. The drum of claim 5, wherein the selective sound control component is coupled to the wall structure component, and wherein the selective sound control component is configured to move relative to the wall structure component so as to move the at least one blocking baffle relative to the plurality of apertures.

7. The drum of claim 5, wherein the selective sound control component further includes an actuation member, and wherein the actuation member is configured to move the at least one blocking baffle relative to the plurality of apertures.

8. The drum of claim 4, wherein the pellet chamber further include a chamber floor plate, wherein the chamber floor plate includes a metallic material, and wherein the chamber floor plate is located at a first side of the pellet chamber and the low volume drum head is located at a second, opposite side of the pellet chamber.

9. The drum of claim 1, further comprising:

a throw off mechanism that is configured to move the magnetic choke relative to the pellet chamber.

10. The drum of claim 9, wherein the throw off mechanism is configured to move between an off position and an on position, wherein when the throw off mechanism is in the off position the magnetic choke is positioned adjacent the pellet chamber, and wherein when the throw off mechanism is in the on position the magnetic choke is positioned further from the pellet chamber than when the throw off mechanism is in the off position.

11. The drum of claim 10, wherein when the throw off mechanism is in the off position the magnetic choke is positioned adjacent the pellet chamber such that the at least one magnet is configured to impart the magnetic force on the pellet chamber to cause pellets to be held within the pellet chamber to resist movement within the pellet chamber, and wherein when the throw off mechanism is in the on position the magnetic choke is positioned further from the pellet chamber, than in the throw off mechanism off position, such that the at least one magnet is configured to impart magnetic force less than when the throw off mechanism is in the off position and permit the pellets to be held in the pellet chamber to move within the pellet chamber.

12. The drum of claim 9, wherein the throw off mechanism includes a throw off lever and a throw off actuation arm, wherein the throw off lever is connected to the throw off actuation arm via a throw off gear, and wherein the throw off actuation arm is configured to transfer a motive force from the throw off lever to the magnetic choke to move the magnetic choke relative to the pellet chamber when the throw off lever is moved.

13. The drum of claim 12, wherein the throw off gear includes a first set of teeth that mesh with a second set of teeth at the throw off actuation arm to transfer the motive force from the throw off lever to the magnetic choke.

14. The drum of claim 12, wherein the throw off mechanism further includes a throw off support member, and wherein the throw off support member is configured to serve as a stop for the magnetic choke such that the magnetic choke comes to rest at the throw off support member when the throw off mechanism is in an on position.

15. The drum of claim 14, wherein the throw off support member is configured to move independent of the throw off lever.

16. The drum of claim 1, further comprising:

a rim including a metallic material; and a securement structure configured to removably retain the rim at the snare drum at a position spaced apart from the low volume drum head.

17. The drum of claim 16, wherein the securement structure includes a securement arm and a securement base, the securement arm defining a first rim receptacle and the securement base defining a second rim receptacle aligned with the first rim receptacle, and wherein the rim is received at the first rim receptacle and the second rim receptacle to removably retain the rim at the snare drum at the position spaced apart from the low volume drum head.

18. The drum of claim 16, further comprising:

an accessory holding mechanism configured to hold a musical accessory, the accessory holding mechanism including an arm bracket and an accessory holding lever, the arm bracket configured to couple to the musical accessory, the arm bracket configured to be secured at the securement arm, the accessory holding lever rotatably coupled to the arm bracket such that the accessory holding lever can rotate relative to the arm bracket to a locked position at which the accessory holding lever is configured to lock the arm bracket in place at the securement arm.

19. The drum of claim 1, further comprising:

a leg supporting the low volume drum head and the pellet chamber, wherein the leg defines a carrying handle configured to receive a hand of a user to carry the drum, and wherein the leg defines a weight receptacle configured to receive one or more weight elements to add additional mass to the drum.

20. The drum of claim 19, wherein the leg includes an adjustable leg structure, the adjustable leg structure including a movable foot, a foot locking mechanism coupled to the movable foot, and a foot support coupled to the movable foot, the movable foot including a leg fitting, wherein the leg includes a foot receptacle at which the leg fitting is received, and wherein the leg fitting can move relative to the foot receptacle to move the foot support relative to the leg.

* * * * *